US009427086B2

(12) United States Patent
Willingham

(10) Patent No.: US 9,427,086 B2
(45) Date of Patent: Aug. 30, 2016

(54) APPARATUS AND SYSTEM FOR DYNAMICALLY CORRECTING POSTURE

(75) Inventor: William Preston Willingham, Park City, UT (US)

(73) Assignee: Backjoy Orthotics, LLC, Boulder, CO (US)

( * ) Notice: Subject to any disclaimer, the term of this patent is extended or adjusted under 35 U.S.C. 154(b) by 0 days.

(21) Appl. No.: 13/574,219

(22) PCT Filed: Jul. 21, 2010

(86) PCT No.: PCT/US2010/042785

§ 371 (c)(1),
(2), (4) Date: Jul. 19, 2012

(87) PCT Pub. No.: WO2011/090505

PCT Pub. Date: Jul. 28, 2011

(65) Prior Publication Data

US 2012/0299350 A1 Nov. 29, 2012

Related U.S. Application Data

(63) Continuation-in-part of application No. PCT/US2010/021881, filed on Jan. 22, 2010.

(60) Provisional application No. 61/147,053, filed on Jan. 23, 2009.

(51) Int. Cl.
*A47C 1/08* (2006.01)
*A47C 27/00* (2006.01)
(Continued)

(52) U.S. Cl.
CPC ..... *A47C 7/022* (2013.01); *A47C 3/12* (2013.01); *A47C 7/425* (2013.01); *A47C 9/002* (2013.01)

(58) Field of Classification Search
CPC ..... A47C 9/002; A47C 3/12; A47C 7/002; A47C 7/02; A47C 7/022; A47C 7/14; A47C 7/402; A47C 7/42; A47C 7/425; A61G 5/1043; A61G 2005/1045
USPC ..... 5/630, 632, 640, 648, 652, 653, 657, 5/691, 705, 722, 723; 297/258.1, 297/452.23–452.23; 3/630, 632, 640, 648, 3/652, 653, 657, 691, 705, 722, 723
See application file for complete search history.

(56) References Cited

U.S. PATENT DOCUMENTS 1,716,871 A 6/1929 Weldon
3,059,971 A * 10/1962 Alfred ..... 297/353
(Continued)

FOREIGN PATENT DOCUMENTS

JP 10-080928 3/1998

OTHER PUBLICATIONS

Notification of Transmittal of the International Searching Authority, International Search Report and Written Opinion dated Sep. 10, 2010 for International Application No. PCT/US2010/042785, filed Jul. 21, 2010, pp. 1-13, Alexandria, United States.
(Continued)

*Primary Examiner* — Nicholas Polito
*Assistant Examiner* — David R Hare
(74) *Attorney, Agent, or Firm* — Brooks Acordia IP Law, PC; Michael Zarrabian

(57) ABSTRACT

An orthopedic device for improving posture while sitting, having a foundation member including a front portion for upper legs and a bowl portion for lower pelvic area. The bowl portion has a central portion and an upwardly inclined lateral portion. The lateral portion and the front portion collectively surround the central portion. A platform portion is connected with a concave recessed portion. An arm portion is connected to the platform portion. The central portion has plural regions of varying flexibility and the lateral portion has plural regions of varying flexibility. A seating apparatus is connected with the orthopedic seating device.

35 Claims, 75 Drawing Sheets

(51) Int. Cl.

| | |
|---|---|
| ***A47C 7/18*** | (2006.01) |
| ***A47C 20/04*** | (2006.01) |
| ***A47C 7/02*** | (2006.01) |
| ***A47C 7/42*** | (2006.01) |
| ***A47C 3/12*** | (2006.01) |
| ***A47C 9/00*** | (2006.01) |

(56) References Cited

U.S. PATENT DOCUMENTS

| | | | | | |
|---|---|---|---|---|---|
| 3,376,070 | A | | 4/1968 | Johnson | |
| 3,463,547 | A | * | 8/1969 | Brennan et al. | 297/452.25 |
| 3,740,096 | A | * | 6/1973 | Bridger | 297/452.25 |
| 4,334,709 | A | | 6/1982 | Akiyama et al. | |
| 4,852,945 | A | * | 8/1989 | Rowles | A47C 7/46 297/452.28 |
| 4,915,447 | A | | 4/1990 | Shovar | |
| 4,953,913 | A | * | 9/1990 | Graebe | A47C 7/022 297/452.25 |
| 4,962,964 | A | | 10/1990 | Snodgrass | |
| 5,137,333 | A | | 8/1992 | Chee | |
| 5,163,737 | A | | 11/1992 | Navach et al. | |
| 5,344,211 | A | * | 9/1994 | Adat et al. | 297/230.14 |
| 5,419,615 | A | * | 5/1995 | Dozsa-Farkas | 297/301.2 |
| 5,456,519 | A | * | 10/1995 | Davis | 297/440.15 |
| 5,887,951 | A | * | 3/1999 | Willingham | 297/452.23 |
| 5,997,095 | A | | 12/1999 | Powell et al. | |
| 6,183,043 | B1 | * | 2/2001 | Nelson | 297/201 |
| 6,193,315 | B1 | * | 2/2001 | Hoshino | 297/353 |
| 6,299,248 | B1 | * | 10/2001 | Gennaro et al. | 297/230.13 |
| 6,336,895 | B1 | | 1/2002 | Dukes | |
| 6,378,947 | B1 | | 4/2002 | Barber et al. | |
| 7,201,446 | B2 | * | 4/2007 | Massara et al. | 297/284.4 |
| 7,216,388 | B2 | * | 5/2007 | Bieganek et al. | 5/653 |
| 7,395,566 | B2 | | 7/2008 | Hetzel et al. | |
| 7,396,082 | B2 | * | 7/2008 | Sanchez | 297/353 |
| 7,475,943 | B1 | * | 1/2009 | Huang | 297/284.4 |
| 7,607,738 | B2 | * | 10/2009 | Gregory et al. | 297/452.23 |
| 7,621,860 | B2 | * | 11/2009 | Burrell | 482/142 |
| 7,731,295 | B2 | | 6/2010 | Lin | |
| 8,671,482 | B2 | * | 3/2014 | Willingham | 5/653 |
| 8,678,504 | B1 | | 3/2014 | Bakker et al. | |
| 2006/0033370 | A1 | | 2/2006 | Jonas | |
| 2007/0028385 | A1 | | 2/2007 | Hetzel et al. | |
| 2007/0057562 | A1 | | 3/2007 | Gregory et al. | |
| 2008/0074866 | A1 | * | 3/2008 | Barker et al. | 362/142 |
| 2011/0101748 | A1 | | 5/2011 | Goetz | |
| 2011/0277246 | A1 | | 11/2011 | Willingham | |
| 2011/0298260 | A1 | | 12/2011 | Hsun-Chin | |
| 2012/0299350 | A1 | | 11/2012 | Willingham | |
| 2013/0043707 | A1 | * | 2/2013 | Yoon | 297/284.4 |
| 2014/0183924 | A1 | * | 7/2014 | Cvek | A47C 9/002 297/452.18 |

OTHER PUBLICATIONS

Notification of Transmittal of the International Searching Authority, International Search Report and Written Opinion dated Mar. 29, 2010 for International Application No. PCT/US2010/021881, filed Jan. 22, 2010, pp. 1-14, Alexandria, United States.

International Preliminary Report on Patentability and Written Opinion dated Aug. 4, 2011 for International Application No. PCT/US2010/021881, filed Jan. 22, 2010 from the International Bureau of WIPO, pp. 1-9, Geneva, Switzerland.

European Search Report and Search Opinion dated Jun. 1, 2012 for International Application No. EP 10733947.5 from European Patent Office, pp. 1-5, Munich, Germany.

International Preliminary Report on Patentability and Written Opinion dated Aug. 2, 2012 for International Application No. PCT/US2010/042785, from the International Bureau of WIPO, pp. 1-12, Geneva, Switzerland.

Japanese Office Action dated Dec. 18, 2012 for Japanese Application No. 548159/2011 from Japanese Patent Office, pp. 1-5, Tokyo, Japan [English-language translation attached, 8 pp.].

Canadian Office Action dated Apr. 3, 2013 for Canadian Application No. 2,750,303 from Canadian Intellectual Property Office, pp. 1-3, Canada.

U.S. Non-Final Office Action for U.S. Appl. No. 13/145,899 mailed Apr. 9, 2013.

International Search Report and Written Opinion for PCT/US14/58430, mailed May 22, 2015.

Israeli Office action for Israeli Patent Application No. 214056, mailed Apr. 9, 2014.

Non-Final Office action for U.S. Appl. No. 14/503,033, filed Feb. 12, 2016.

* cited by examiner

Kyphotic
lumbar spine

Lordotic
lumbar spine

APPARATUS AND SYSTEM FOR DYNAMICALLY CORRECTING POSTURE

CROSS-REFERENCE TO RELATED APPLICATION

This application is the U.S. National Phase Patent Application under 35 U.S.C. §371 of International Application No. PCT/US2010/042785 (published as WO 2011/090505 A1), filed on Jul. 21, 2010, which is a Continuation-in-Part of International Application No. PCT/US 10/021,881 (published as WO 2010/085707 A1) having an International filing date of Jan. 22, 2010, which claims the benefit of U.S. Provisional Patent Application Ser. No. 61/147,053 filed on Jan. 23, 2009. These applications, PCT/US2010/042785, PCT/US 10/021,881 and U.S. Application Ser. No. 61/147,053 are incorporated herein by reference in their entirety.

FIELD OF THE INVENTION

The present invention in general to orthosis and in particular to a seating orthosis.

BACKGROUND OF THE INVENTION

Chairs and sofas are typically constructed from posterior and lumbar supporting assemblies having generally a frame with a plurality of springs, a cushion or pad which rests on the springs, and an upholstery cover. These assemblies, although flexible due to their spring construction, assume a predetermined fixed shape which requires that for maximum comfort, persons using such furniture must adjust their body positions relative to these assemblies.

There are many ergonomic supports in the nature of chairs, sofas and the like which include flexible and resilient supporting portions which conform to the body to provide comfort. All of these posterior and lumbar supporting sitting surfaces, whether contoured or non-planar, have the ability to form a plurality of cantilevers which automatically adjust and conform to human body movement without mechanical parts, as opposed to adjusting the human body to conform to the supporting portion of the seating surface.

It is now understood that gluteal spreading, commonly known as "secretary spread" is as injurious to the pelvis and spine as incorrect posture. No matter how comfortable an ergonomic seating device is, continuous sitting on anthropometrically measured seating devices will in most humans result in repetitive stress injuries to the back. U.S. Pat. No. 5,887,951 provides a seating device having a uniform thickness member providing support for a user's pelvic area.

BRIEF SUMMARY OF THE INVENTION

The present invention provides an apparatus for improving posture while sitting. In one embodiment, the present invention provides an orthopedic device for improving posture while sitting. The orthopedic device, comprising a foundation member comprising a front portion configured to receive a user's upper legs and a bowl portion configured to receive a user's lower pelvic area, the bowl portion comprising a central portion and an upwardly inclined lateral portion. The lateral portion and the front portion collectively surround the central portion.

A platform portion is connected with a concave recessed portion. An arm portion is connected to the platform portion. The central portion has plural regions of varying flexibility and the lateral portion has plural regions of varying flexibility. A seating apparatus is connected with the orthopedic seating device.

In another embodiment the present invention provides an orthopedic seating device for improving posture while sitting. The orthopedic seating device comprising: a foundation member comprising: a front portion including at least one individual front section configured to receive a user's upper legs. A central portion includes a pair of adjacent individual central sections. A lateral portion includes a pair of upwardly inclined, partially adjacent, individual lateral sections flanking and partially surrounding the central sections. A platform portion is connected with a concave recessed portion.

An arm portion is connected to the platform portion. Each central section has plural regions of varying flexibility and each lateral section has plural regions of varying flexibility. The lateral sections and the front section collectively surround the central sections such that the central portion and the lateral portion together form a bowl portion configured to receive a user's lower pelvic area and to apply an upwardly and inwardly compressive force when the lower pelvic area of the user is disposed in the bowl portion.

The bowl portion is configured to rotate between a first position when the user's lower pelvic area is not disposed in the bowl portion, and a second position, rotationally forward of the first position, when the user's lower pelvic area is disposed in the bowl portion, thereby causing forward rotational tilting of the user's lower pelvic area into a forward lordotic position after the user's lower pelvic area is placed in the bowl portion. A seating apparatus is connected with the orthopedic seating device.

Other aspects and advantages of the present invention will become apparent from the following detailed description, which, when taken in conjunction with the drawings, illustrate by way of example the principles of the invention.

BRIEF DESCRIPTION OF THE DRAWINGS

FIG. 44A shows a rear view of a seating apparatus including an active orthopedic apparatus and equilibrium balance point system integrated in a cushion of a chair apparatus, showing a human anatomy in one position according to one embodiment of the invention.

FIG. 44B shows a rear view of a seating apparatus including an active orthopedic apparatus and equilibrium balance point system integrated in a cushion of a chair apparatus, showing a human anatomy in another position according to one embodiment of the invention.

DETAILED DESCRIPTION OF THE INVENTION

The present invention provides a method and apparatus for correcting posture and restricting gluteal spreading. One embodiment of the apparatus according to the invention comprises an orthopedic device for improving posture while sitting. The orthopedic device comprises a foundation member including a front portion configured to receive a user's upper legs, and a bowl portion configured to receive a user's lower pelvic area, the bowl portion comprising a central portion and an upwardly inclined lateral portion, wherein the lateral portion and the front portion collectively surround the central portion. The central portion has plural regions of varying (i.e., different) flexibility and the lateral portion has plural regions of varying flexibility. The bowl portion configured for applying an upwardly and inwardly compressive force when the lower pelvic area of the user is disposed in the bowl portion.

The bowl portion is configured to rotate on a supporting surface between a first position when the user's lower pelvic area is not disposed in the bowl portion, and a second position, rotationally forward of the first position, when the user's lower pelvic area is disposed in the bowl portion, to thereby cause a forward rotational tilting of the user's lower pelvic area into a forward lordotic position after the lower pelvic area is placed in the bowl portion. Example implementations of the orthopedic device according to the invention are described below.

Figure 1A:
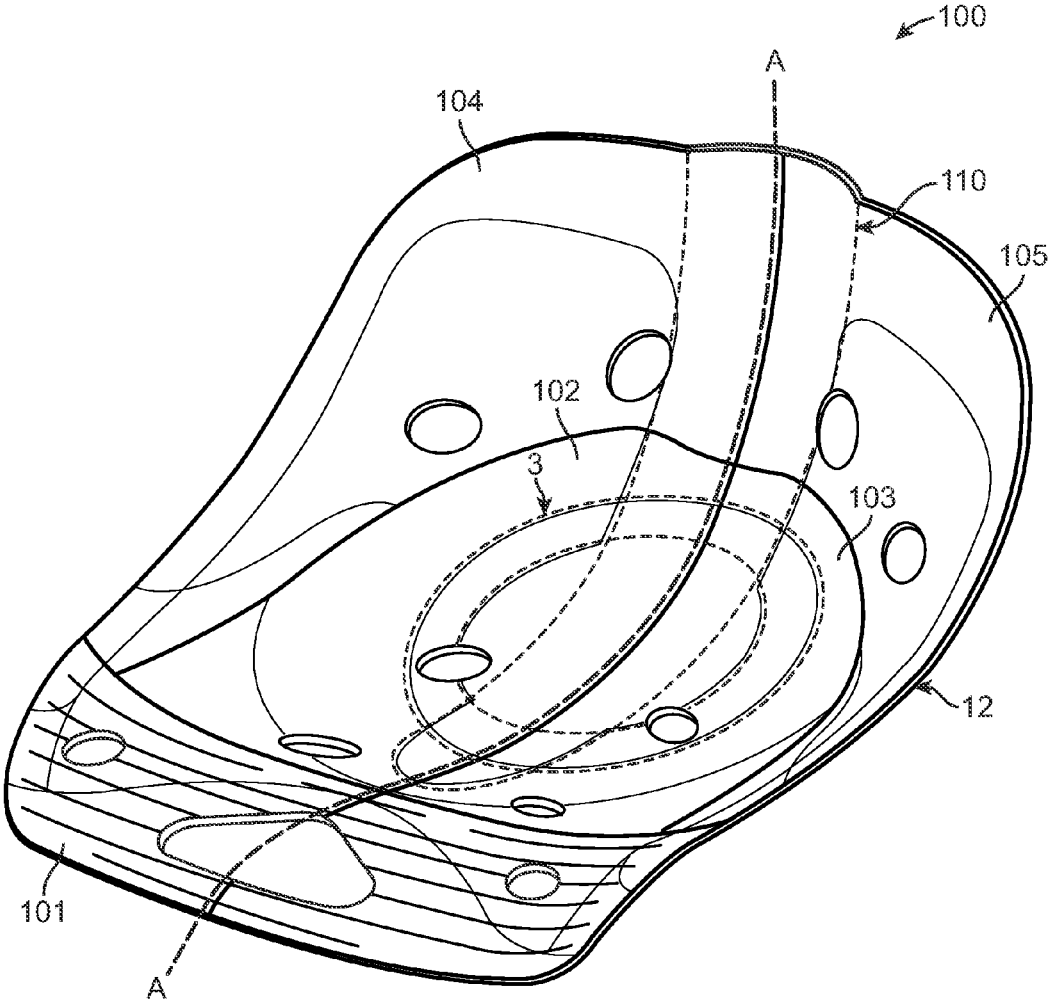
FIG. 1*a* shows a perspective view of a seating apparatus for correcting posture and restricting gluteal spreading in a human user, the seating apparatus having multiple varying thickness sections, according to an embodiment of the invention.
Figure 9:
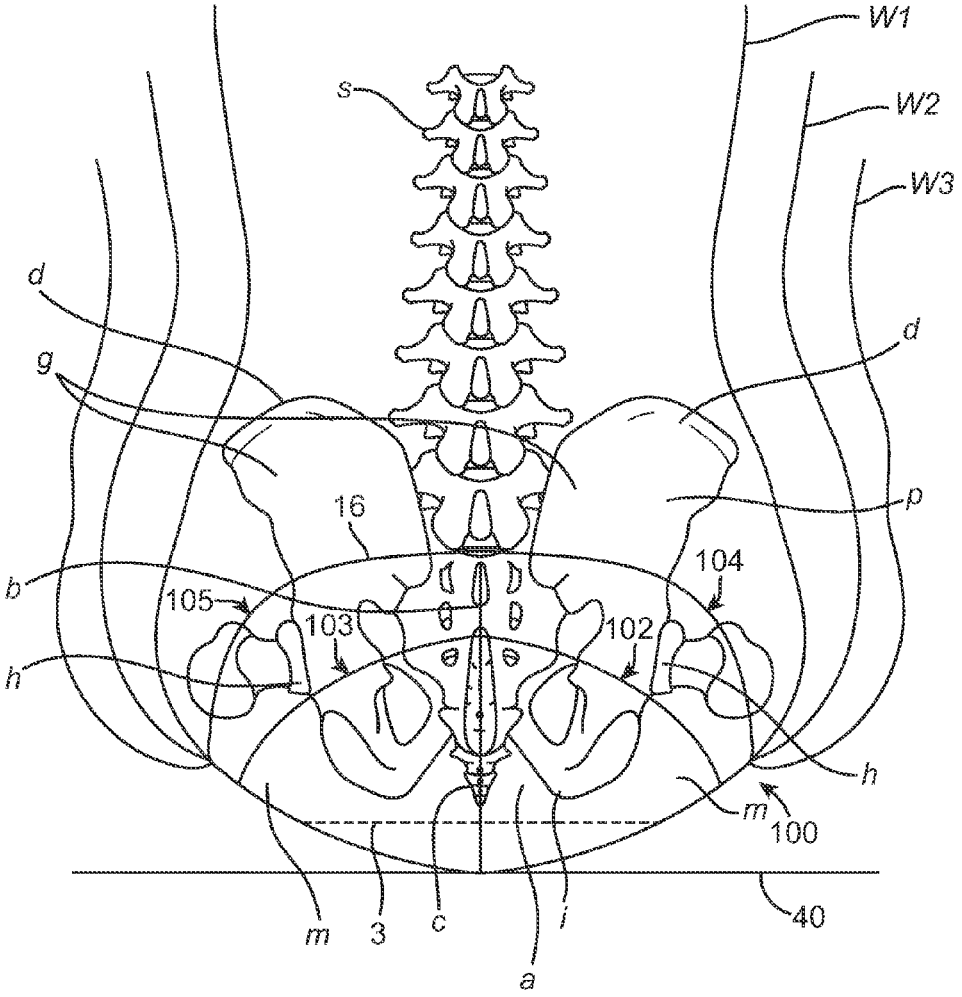
FIG. 9 shows a rear view of the seating apparatus of FIG. 1*a* with anatomy of the user seated in the seating apparatus, according to an embodiment of the invention.

FIG. 1*a* shows an example implementation of an orthopedic seating device (seating orthosis) 100 according to the invention, intended to be utilized by a seated user, which provides a forward tilting of the entire pelvis of the seated user as well as cupping and cradling effect around the lower pelvis and ischial tuberosities of the seated user. The ischial tuberosities are indicated at i in FIG. 9. Parts or components of the pelvic area depicted in FIG. 9 are as follows: a pubic arch, b sacrum, c coccyx, d crest of the ilium, f symphysis pubis crest, g posterior pelvic girdle, h hip socket, i ischial tuberosities, m muscle tissue, p pelvis, s spine, t thigh, w soft tissues of various widths.

In the perspective view shown in FIG. 1*a*, the device 100 comprises a foundation member 12. The device 100 further includes a padding layer 13 (FIG. 15), such as foam, on top of the foundation member 12. The padding layer 13 is only shown in FIG. 15 for clarity of depictions of the foundation member 12 in other figures.

The foundation member 12 comprises a front portion comprising at least one front section 101 configured to receive a user's upper legs. The foundation member further comprises a central portion comprising a pair of adjacent central sections 102 and 103. The foundation member further comprises a lateral portion comprising a pair of upwardly inclined, partially adjacent, lateral sections 104 and 105, flanking and partially surrounding the central sections 102 and 103.

Figure 4A:
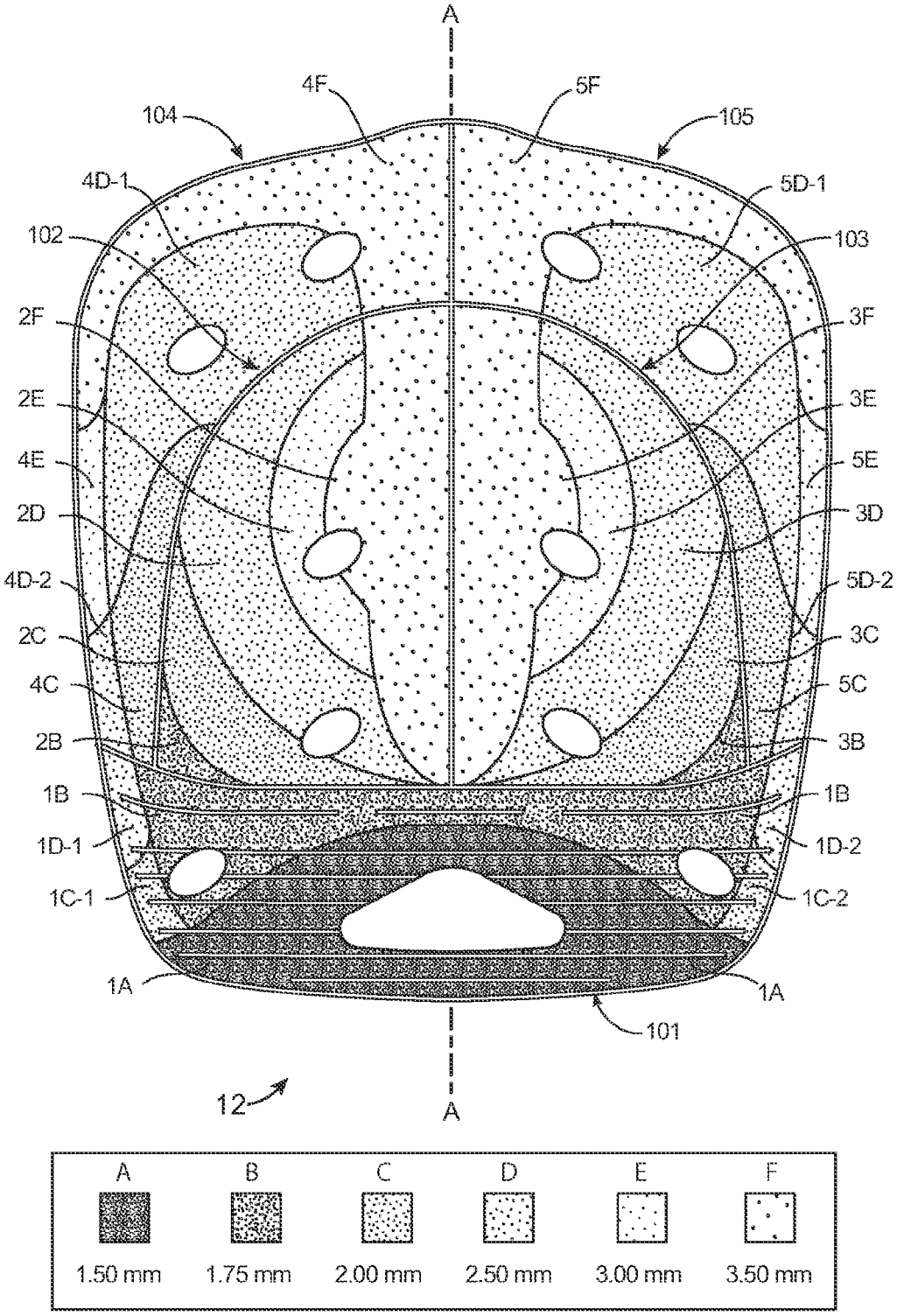
FIG. 4*a* shows an aerial top view of the seating apparatus of FIG. 1*a*, indicating varying thickness regions in the sections of the foundation member of the seating apparatus, according to an embodiment of the invention.

FIG. 4*a* shows an aerial top view of the foundation member 12, indicating varying thickness regions in the sections 101-105 of the foundation member 12. Each of the central sections 102 and 103 has plural regions of varying flexibility and each of the lateral sections 104 and 105 has plural regions of varying flexibility (FIG. 4*a*). The lateral sections 104, 105, and the front section 101 collectively surround the central sections 102 and 103, such that the central portion and the lateral portion together form a bowl portion 20 (generally indicated in FIGS. 8*a*, 8*b*, 10*b*). The bowl portion 20 is generally formed by sections 102, 103, 104 and 105. The bowl portion is configured to receive a user's lower pelvic area and to apply an upwardly and inwardly compressive force when the lower pelvic area of the user is disposed in the bowl portion.

Figure 1B:
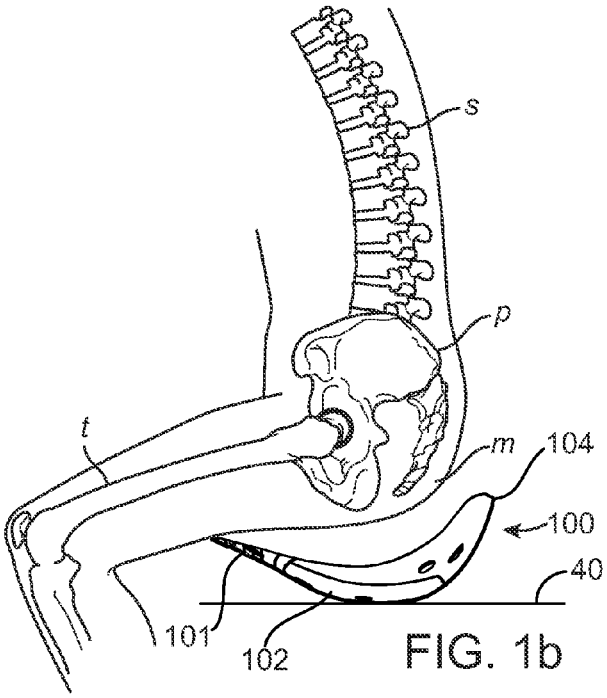
FIG. 1*b* shows a right side view of the seating apparatus of FIG. 1*a* on a supporting surface, with a representation of anatomy of a user in the act of sitting, approaching the seating apparatus, according to an embodiment of the invention.
Figure 1C:
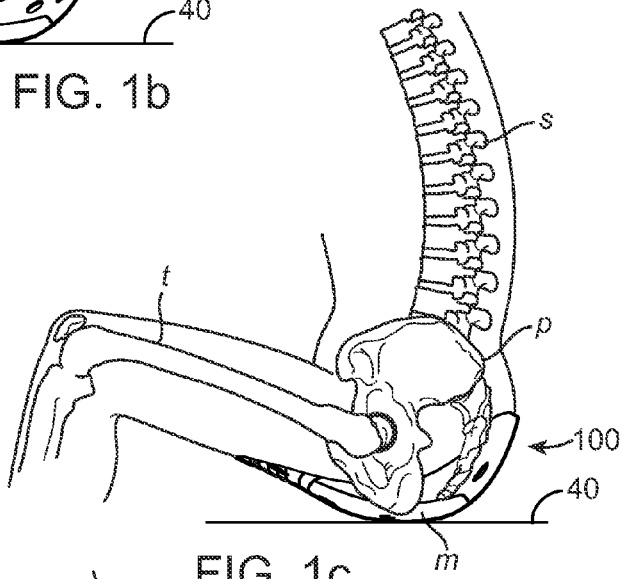
FIG. 1*c* shows a right side view of the apparatus of FIG. 1*b* with the user touching the seating apparatus, according to an embodiment of the invention.

FIG. 1*b* shows a right side view of the device 100 on a supporting surface 40, with a representation of anatomy of a user in the act of sitting, approaching the device 100. In FIG. 1*b*, the device 100 is in the first position (i.e., non-weight bearing position). FIG. 1*c* shows a transitional state with the user touching the device, continuing the act of sitting and continuing transfer of body weight to the device 100.

Figure 1D:
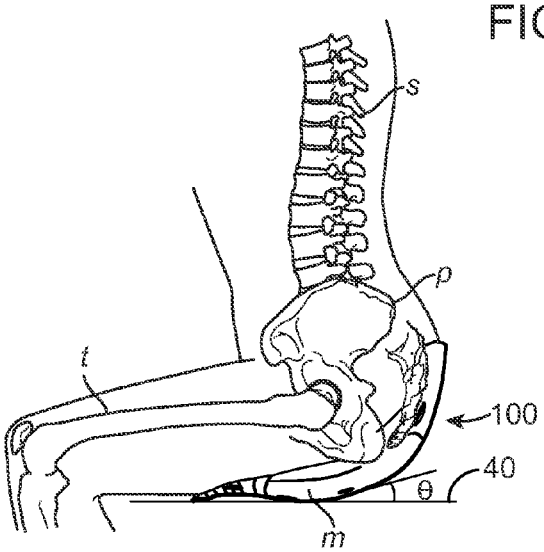
FIG. 1*d* shows a right side view of the apparatus of FIG. 1*c* with the user filling the seating apparatus until a secondary shape is achieved and a full forward lordosis of the pelvis and spine is achieved, according to an embodiment of the invention.

The bowl portion is further configured to rotate on a supporting surface 40 between a first position (FIG. 1*b*) when the user's lower pelvic area is not disposed in the bowl portion, and a second position (FIG. 1*d*), rotationally forward of the first position, when the user's lower pelvic area is disposed in the bowl portion, to thereby cause a forward rotational tilting of the user's lower pelvic area by an angle θ into a forward lordotic position after the lower pelvic area is placed in the bowl portion. FIG. 1*d* shows the user having completed the act of sitting the device 100, filling the device 100 with gluteus muscles of the user in the lower pelvic area, until a secondary shape is achieved and a full forward lordosis of the pelvis and spine is achieved, according to the invention. In FIG. 1*d*, the device 100 is in the second position (i.e., weight bearing position).

Figure 2A:
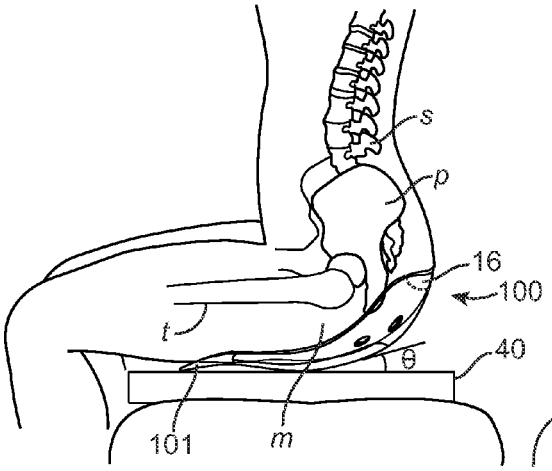
FIG. 2*a* shows a side view of a user seated on the seating apparatus of FIG. 1*a* disposed on a hard supporting surface, wherein the seating apparatus is in a weight bearing position, according to an embodiment of the invention.
Figure 2B:
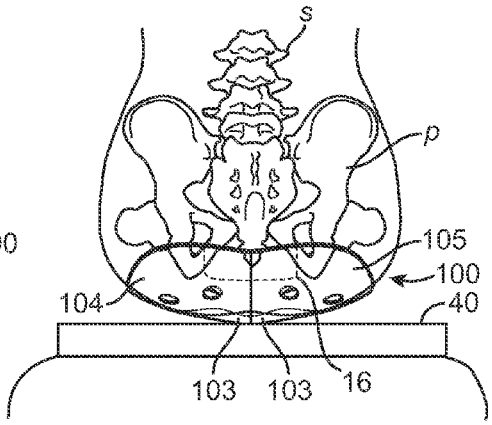
FIG. 2*b* shows a rear anatomical view of a user seated on the seating apparatus of FIG. 2*a*, according to an embodiment of the invention.
Figure 2C:
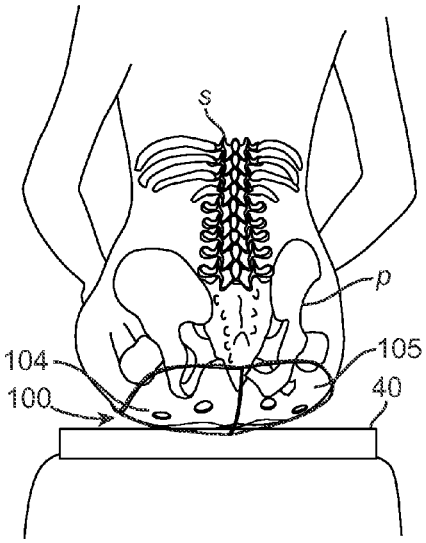
FIG. 2*c* shows a rear anatomical view of a user with twisting spine seated on the seating apparatus of FIG. 1*a* with the seating apparatus in torsion on its axis, according to an embodiment of the invention.
Figure 2D:
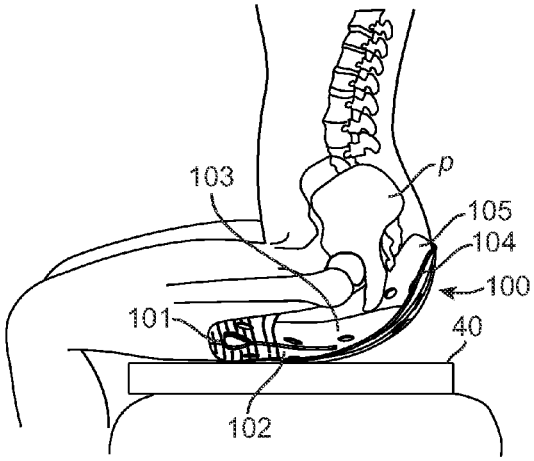
FIG. 2*d* shows a side anatomical view of a user with twisting spine seated on the seating apparatus of FIG. 2*c* with the seating apparatus in torsion on its axis, according to an embodiment of the invention.

FIG. 2*a* shows a side view of the user seated on the device 100 disposed on a hard supporting surface 40, wherein the device 100 is in the weight bearing position. FIG. 2*b* shows a rear view of a user seated on the weight bearing device 100 of FIG. 2*a*. Further, FIG. 2*c* shows a rear view of a user with twisting motion of the spine s as the user is seated on the device 100 with the foundation member 12 in torsion on its axes due to twisting motion of the user, wherein the device 100 is in the weight bearing position. FIG. 2*d* shows a side view of the illustration in FIG. 2*c*. The device 100 in the weight bearing positions shown causes a forward rotational tilting of the user's lower pelvic area into a forward lordotic position after the lower pelvic area is placed in the bowl portion.

Figure 2E:
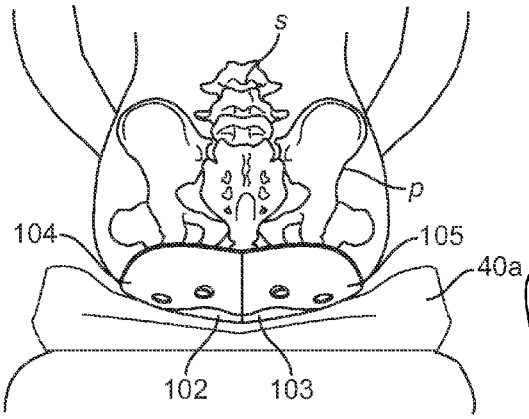
FIG. 2*e* shows a rear anatomical view of a user seated on the seating apparatus of FIG. 1*a* with the seating apparatus on a soft seating surface, according to an embodiment of the invention.
Figure 2F:
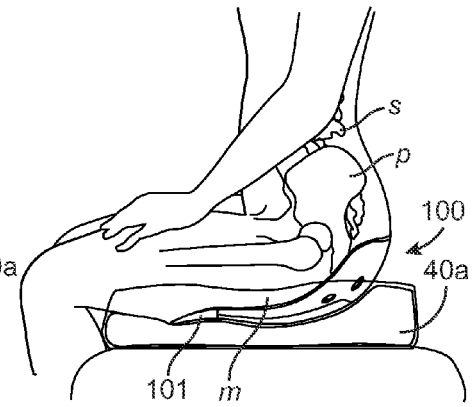
FIG. 2*f* shows a side anatomical view of a user seated on the seating apparatus of FIG. 2*f* with the seating apparatus on a soft seating surface, according to an embodiment of the invention.
Figure 2G:
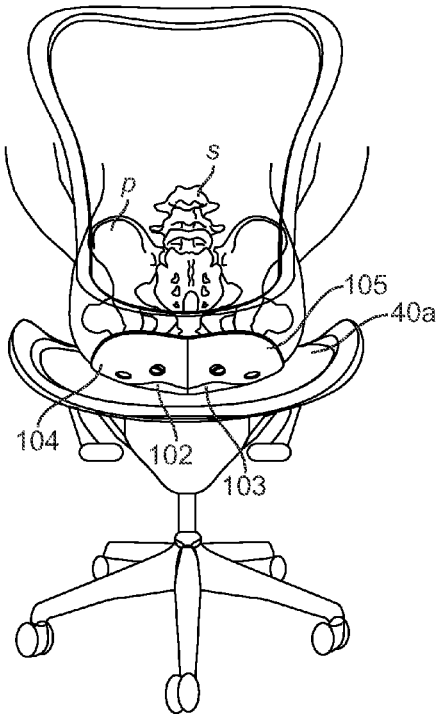
FIG. 2*g* shows a rear anatomical view of a user seated on the seating apparatus of FIG. 1*a* with the seating apparatus on a flexible fiber mesh suspended between a framed seat pan surface, according to an embodiment of the invention.
Figure 2H:
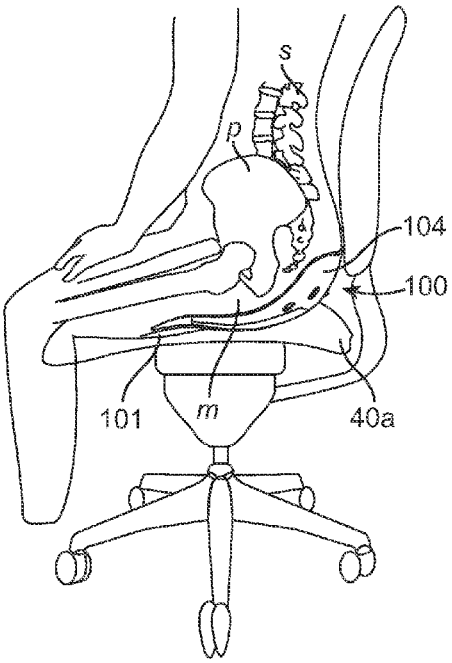
FIG. 2*h* shows a side anatomical view of a user seated on the seating apparatus of FIG. 2*h* with the seating apparatus on a flexible fiber mesh suspended between a frame seat pan surface, according to an embodiment of the invention.

FIG. 2*e* shows a rear view of the user seated on the device 100 disposed on a generally soft supporting surface 40*a* (e.g., a cushion), wherein the device 100 is in the weight bearing position. FIG. 2*f* shows a side view of the user seated on the weight bearing device 100 of FIG. 2*e*. FIG. 2*g* shows a rear view of the user seated on the device 100 disposed on a generally soft supporting surface 40*a* (e.g., flexible fiber mesh suspended between a framed seat pan surface), wherein the device 100 is in the weight bearing position. FIG. 2*f* shows a side view of a user seated on the weight bearing device 100 of FIG. 2*e*. The device 100 in the weight bearing positions shown causes a forward rotational tilting of the user's lower pelvic area into a forward lordotic position after the lower pelvic area is placed in the bowl portion.

In the perspective view of the device 100 shown in FIG. 1*a*, as noted the foundation member 12 comprises multiple sections 101, 102, 103, 104 and 105, configured to assume a highly advantageous weight bearing secondary shape during use when a user is seated on the device 100. As described in more detail further below.

In response to a user sitting on the device 100, the action of the sections 101, 102, 103 and 104 (collectively forming a bowl portion or central bowl portion, as referred to herein), causes cupping and cradling of gluteus muscles of the user in the lower pelvic area. When a user is seated on the device 100, the foundation member 12 continually applies dynamic support to stabilize the pelvis and holds the pelvis in a correct lordotic curve, regardless of how a sitting user moves while seated. The plural regions of varying flexibility in the foundation member 12 allow the foundation member 12 to effectively "reset" in shape such that the user is held essentially in a constant, perpetuating process of tilting of the user's lower pelvic area into a forward lordotic position after the lower pelvic area is placed in the bowl portion. This provides a distinct orthopedic benefit, which is greater than any benefit brought about by conventional seating devices specifically designed to provide pelvic stabilization and comfort for a seated user.

Section 101 is generally referred to as a front section. Central sections 102 and 103 are generally referred to as center or central portion sections. Lateral sections 104 and 105 are generally referred to as rear and/or side sections. Each of the sections 101-105 has one or more regions of varying (different) flexibility which collectively provide the foundation member 12 with a highly advantageous weigh bearing (secondary shape) in said second position. As described further below, in one example of the invention, the foundation member 12 is made of memory retentive nylon or plastic material. In the embodiments described herein, different flexibility regions of the foundation member 12 are achieved by regions of different relative thickness of the foundation member material which collectively provide the foundation member 12 with a highly advantageous weigh bearing (secondary shape) during use. Thicker regions are less flexible to bending forces than thinner regions.

FIG. 4*a* shows an aerial top view of the foundation member 12, indicating varying (different) thickness regions in the sections 101-105 of the foundation member 12. The thickness of the regions varies in depth looking directly down on the drawing sheet of FIG. 4*a* (the regions have different cross-sections in terms of thickness). In this example, section 101 includes regions 1A, 1B, 1C-1, 1C-2, 1D-1, 1D-2. Section 102 includes regions 2B, 2C, 2D, 2E, 2F. Section 103 includes regions 3B, 3C, 3D, 3E, 3F. Section 104 includes regions 4C, 4D-2, 4E, 4D-1, 4F. Section 105 includes regions 5C, 5D-2, 5E, 5D-1, 5F.

Figure 4B:
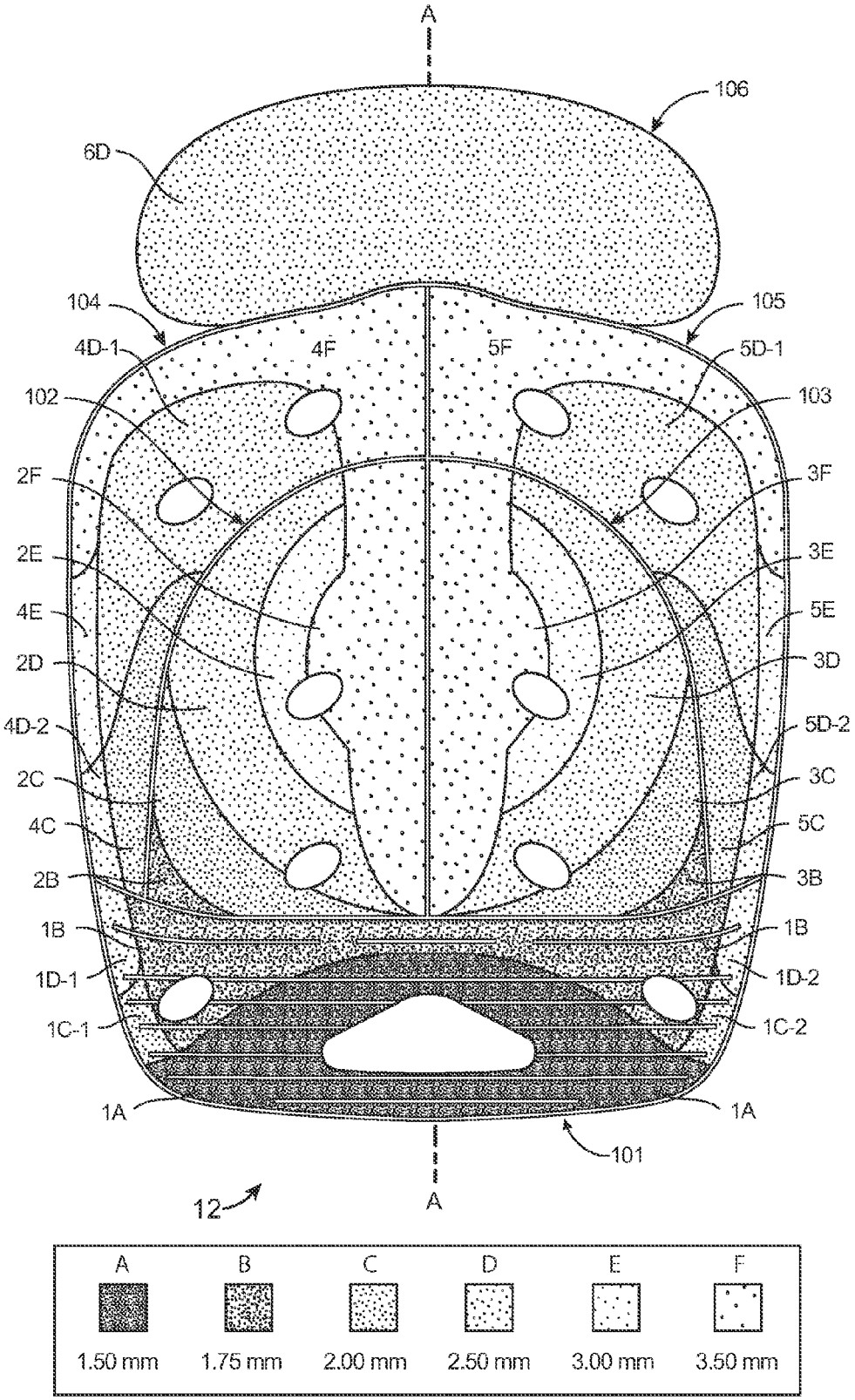
FIG. 4*b* shows an aerial top view of the seating apparatus of FIG. 1*a* with an optional back section, indicating varying thickness regions in the sections of the foundation member of the seating apparatus, according to an embodiment of the invention.
Figure 4C:
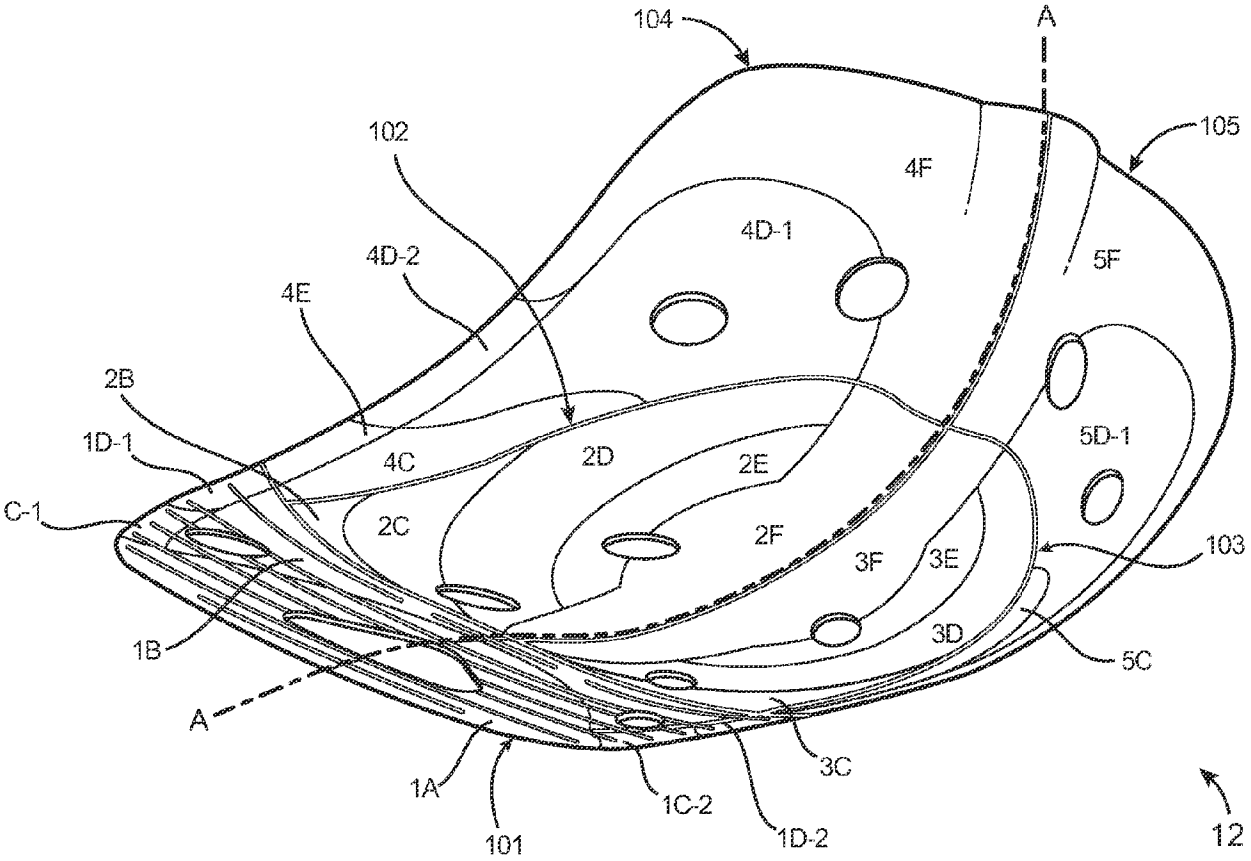
FIG. 4*c* shows a perspective view of the seating apparatus of FIG. 4*a*, indicating varying thickness regions in the sections of the foundation member of the seating apparatus, according to an embodiment of the invention.

FIG. 4*a* illustrates example gradations in thickness for the various regions of sections 101-105 by different stippling, wherein the corresponding stippling in the legend in the bottom of the drawing sheet shows example approximate thicknesses from about 1.5 mm (darkest or most densely stippled indicated by thickness indicator "A") to about 3.5 mm (lightest or least densely stippled, indicated by thickness indicator "F"), for the various regions. For example, regions with thickness A are about 1.5 mm thick, regions with thickness B are about 1.75 mm thick, regions with thickness C are about 2.0 mm thick, regions with thickness D are about 2.5 mm thick. Regions with thickness E are about 3.0 mm thick. Regions with thickness F are about 3.5 mm thick. Other relative thickness ranges may be utilized. FIG. 4*c* shows a perspective view of the foundation member 12 of FIG. 4*a*, indicating varying thickness regions in the sections of the foundation member 12.

In FIG. 4*a*, said thickness indicators A through F are used as part of the naming of the regions of the foundation member 12. Regions 4F and 5F are the thickest regions (e.g., 3.5 mm thick), whereas region 1A is the thinnest region. For the regions on the left side of central (i.e., longitudinal) axis A-A in FIG. 4*a*, the following is a listing of sets of regions, decreasing in order from thickest to thinnest: {4F, 2F}, {4E, 2E}, {2D, 4D-1, 4D-2, 1D-1}, {2C, 4C, 1C-1}, {1B, 2B}, and {1A}. Regions on the right of the center line A-A are of same thickness as corresponding regions on the left of center line A-A. Specifically, the following is a listing of sets of regions on the right side of line A-A, decreasing in order from thickest to thinnest: {5F, 3F}, {5E, 3E}, {3D, 5D-1, 5D-2, 1D-2}, {3C, 5C, 1C-2}, {1B, 3B}, and {1A}.

The regions 1A and 1B of section 101 are relatively thinner and more flexible regions of the foundation member 12. The regions 2F, 3F, 4F, 5F are relatively thicker and least flexible regions of the foundation member 12. A generally "M" shaped zone of the foundation member 12 comprises the regions 2F, 3F, 4F, 5F, 4E, 3E, 4D-2, 5D-2, 1D-1, 1D-2. Dovetailed with the generally "M" shaped zone is a generally "U" shaped zone that comprises regions 4D-1, 5D-1, 4C, 5C, 2D, 3D, 2C, 3C, 1B, 1A in the foundation member 12, wherein the lowest part of the "U" shaped zone (region 1A) is thinnest and so most flexible.

Figure 3A:
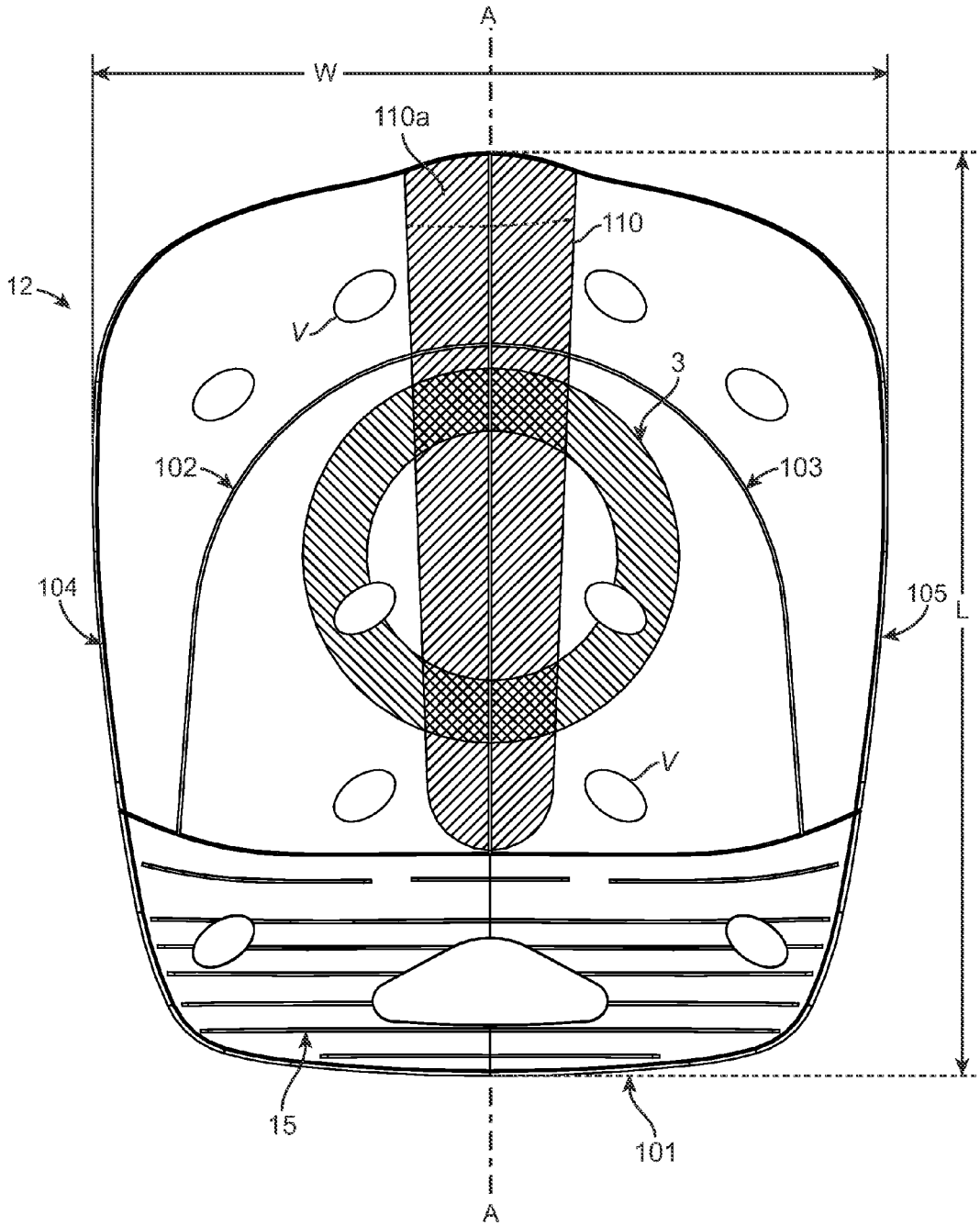
FIG. 3*a* shows an aerial top view of the seating apparatus of FIG. 1*a*, indicating width and length of the seating apparatus having multiple sections, along with a concave channel along the long axis of the seating apparatus, according to an embodiment of the invention.
Figure 3B:
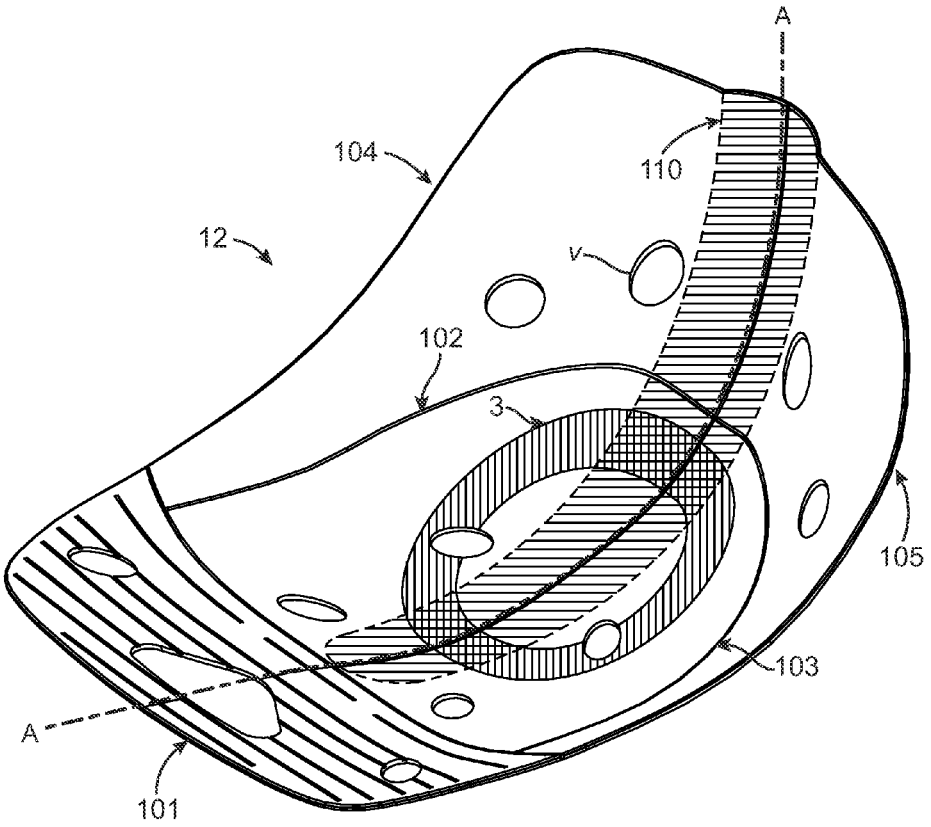
FIG. 3*b* shows a perspective view of the seating apparatus of FIG. 3*a*, indicating a concave channel along the long axis of the seating apparatus, according to an embodiment of the invention.
Figure 17A:
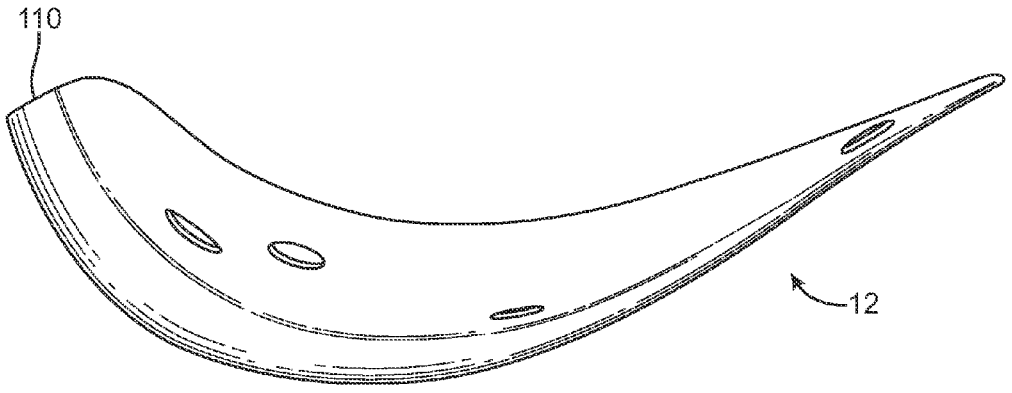
FIG. 17*a* shows a side view of the foundation member of a seating apparatus in FIG. 1*a* with a recessed concave channel detail, according to an embodiment of the invention.
Figure 17B:
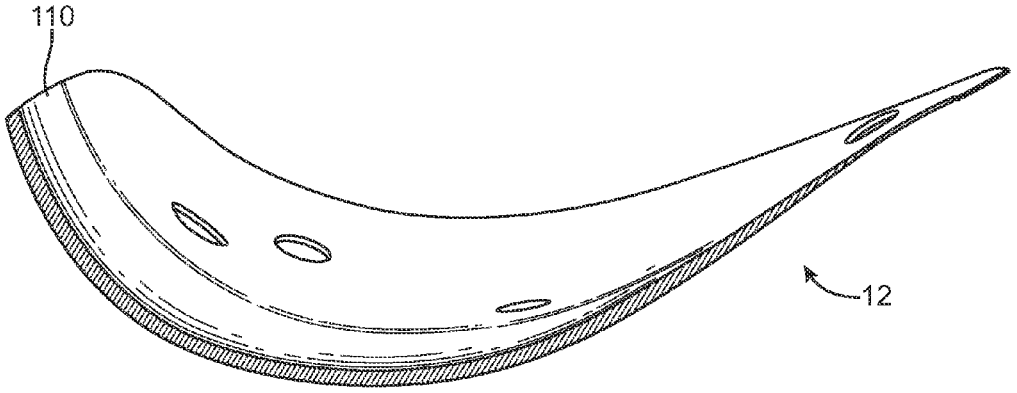
FIG. 17*b* shows a cross section of the foundation member in FIG. 17*a*, in a cutting plane along lines A-A in FIG. 1*a*.

FIG. 3A shows an aerial top view of the foundation member 12, indicating width W and length L of the foundation member 12. FIG. 3B shows a front top perspective view of the foundation member 12 of FIG. 3A. As illustrated, the foundation member 12 includes a concave channel (i.e., concave recessed portion) 110, extending partially along the axis A-A, protruding from the underside of the foundation member 12. Portions of the regions 2F, 3F, 4F and 5F, form said recessed concave channel 110. As indicated in FIG. 4A, the rear and side regions 4F, 5F of sections 104, 105, are among the thickest and least flexible regions of the foundation member 12. Similarly, the regions 2F, 3F of sections 104, 105 are among the thickest and least flexible regions of the foundation member 12. As such, the concave channel 110 is formed of thickest and least flexible regions of the foundation member 12. The concave channel 110 also provides a concave coccyx cup area 110*a* (FIG. 3*a*), allowing the variable coccyx angles so as to keep the surface of the device 100 in the area 110 from ever coming in contact with the lower Sacral joints and coccyx. FIG. 17*a* shows a side view of the foundation member 12 and FIG. 17*b* shows a cross section of the foundation member in FIG. 17*a*, in a cutting plane along lines A-A in FIG. 1*a*, showing the concave channel 110.

Example average dimensions for the device 100 are about W=12.625 inches (i.e., 32.35 cm) wide, and about L=14.625 inches (i.e., 37.6 cm) long (FIG. 3*a*). By contrast, the average size for conventional seta pans (e.g., flexible woven mesh, foam, plastic or wood) is about 21.6 inches wide and about 17.9 inches long (another example is a seat pan 20.25 wide and 21.25 long). Such conventional seat pan dimensions apply to a static sub seat pan. Unlike conventional seat pans, the device 100 does not simply conform to the gluteus shape of a seated user, but rather counter-intuitively, the sections 104 and 105 move inward and upward to cup the gluteus. The supporting surface may be a conventional static seat pan upon which the device 100 may be placed. The conventional seat can be made from a number of materials, woven, flexible fibers suspended between metal framework, contoured foam padding in various densities and hard materials such as plastics, woods and metals.

The concave channel 110 comprises a downwardly extending recess portion at the rear portion 16 of the sections 104 and 105 (regions 4F and 5F), continues throughout sections 102 and 103 (regions 2F and 3F), symmetrically along the longitudinal centerline/axis A-A. The concave channel 110 ends just before section 101. The concave channel 110 is disposed at approximately the location of the coccyx of a user seated on the central bowl portion 20, with the area 110*a* serving to remove the possibility of considerable pressure being applied to the coccyx area of the seated user.

Figure 5:
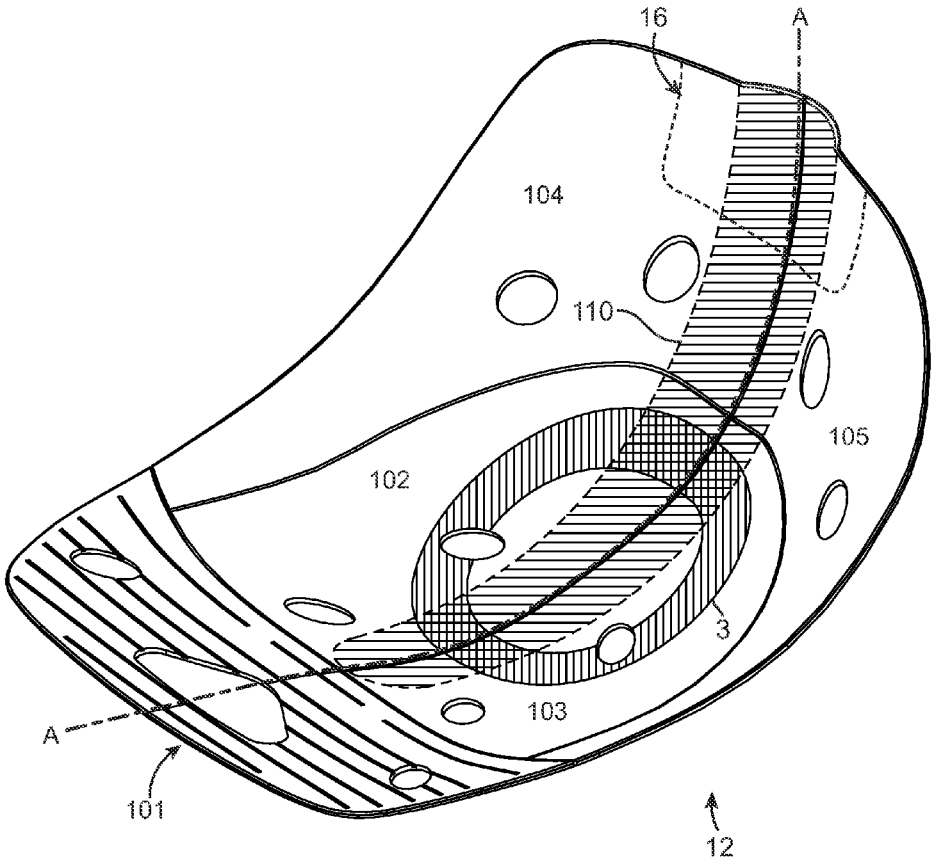
FIG. 5 shows a perspective view of the seating apparatus of FIG. 3*b*, indicating the concave channel and a rear portion of the seating apparatus, according to an embodiment of the invention.

FIG. 5 shows a perspective view of the foundation member 12 of FIG. 3B illustrating the concave channel 110, and further indicating a rear portion (segment) 16 of the foundation member 12. The rear 16 includes portions of the regions 4F and 5F of sections 104, 105.

Figure 18A:
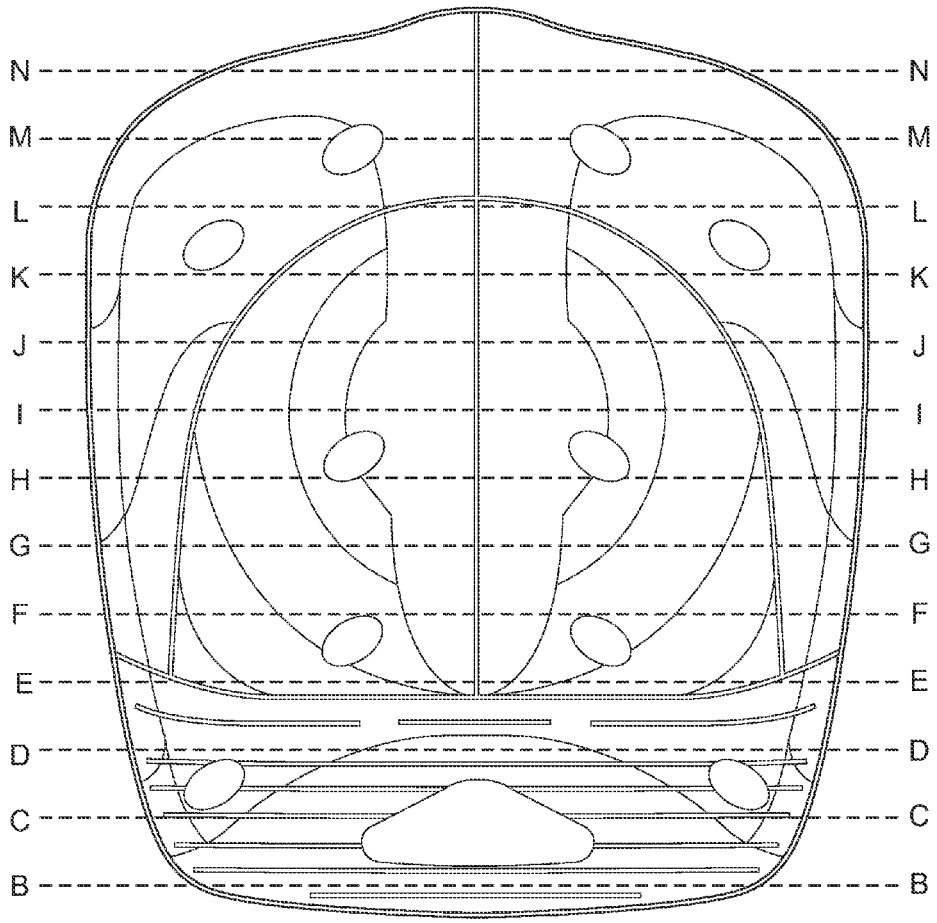
FIG. 18*a* shows a top aerial view of the foundation member of the seating apparatus in FIGS. 3A-3B, according to an embodiment of the invention.
Figure 18B:
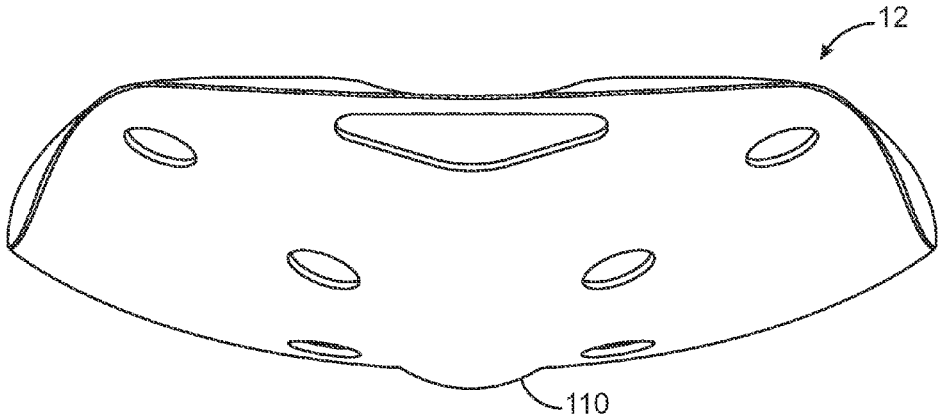
FIG. 18*b* through FIG. 18*n* show cross-sections B-B, C-C, D-D, E-E, F-F, O-O, H-H, I-I, K-K, L-L, M-M, N-N, respectively, as indicated in FIG. 18*a*.
Figure 18C:
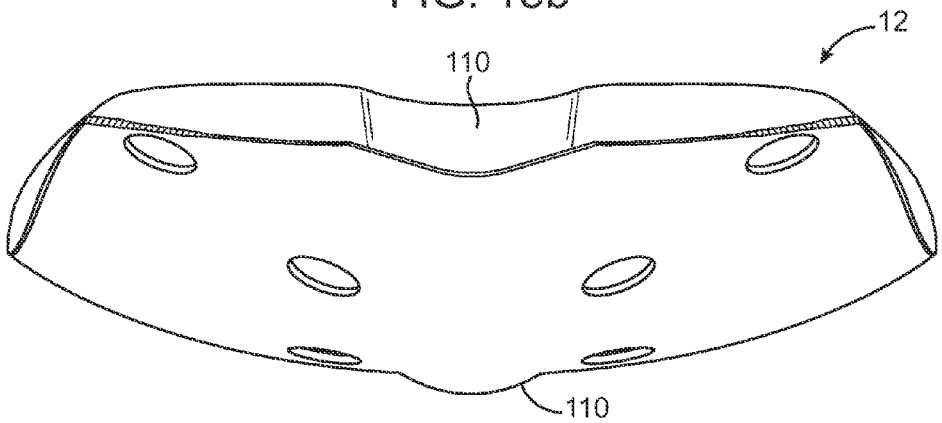
Figure 18D:
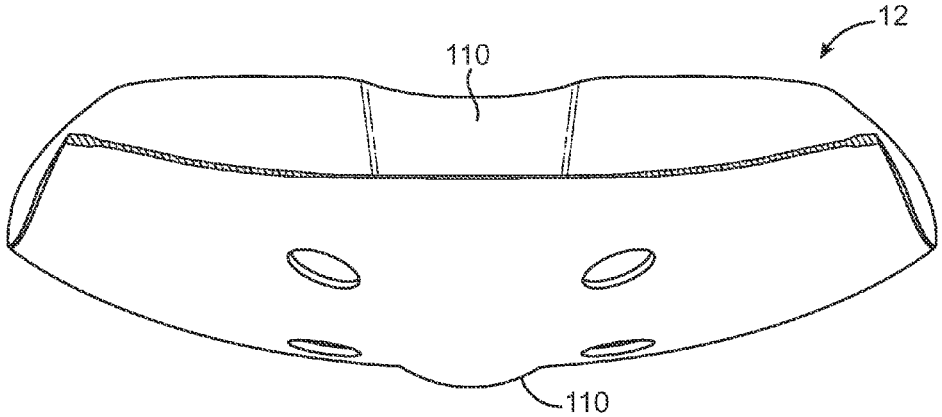
Figure 18E:
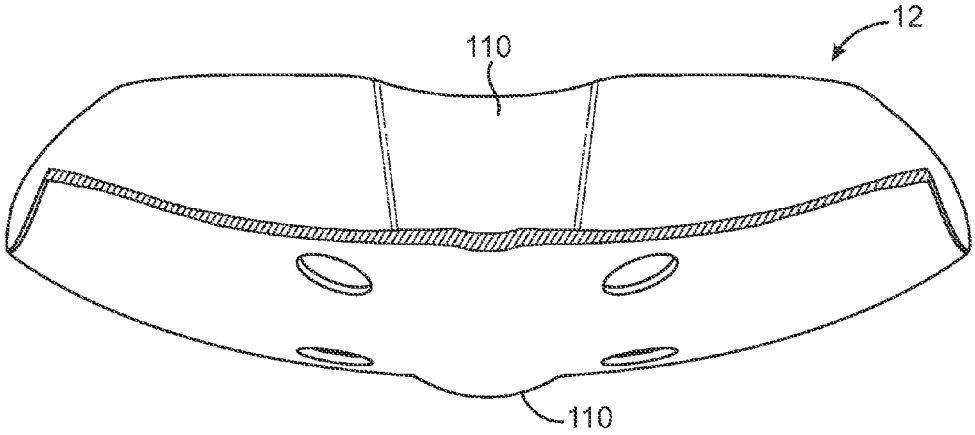
Figure 18F:
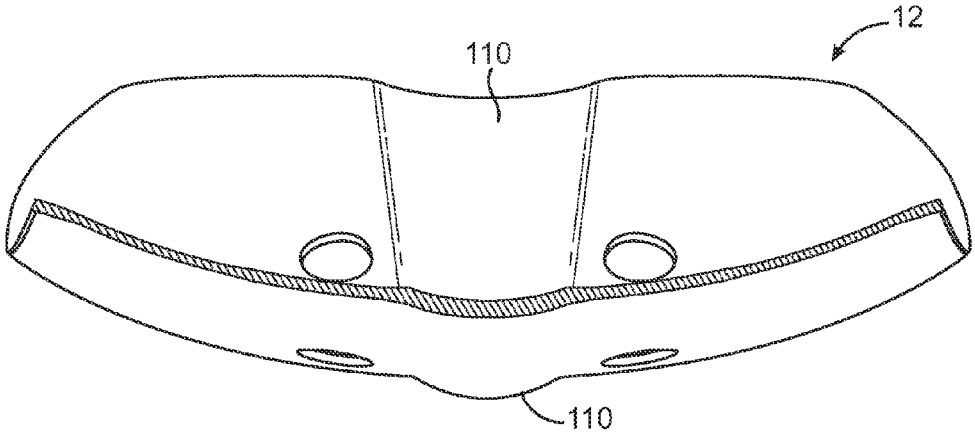
Figure 18G:
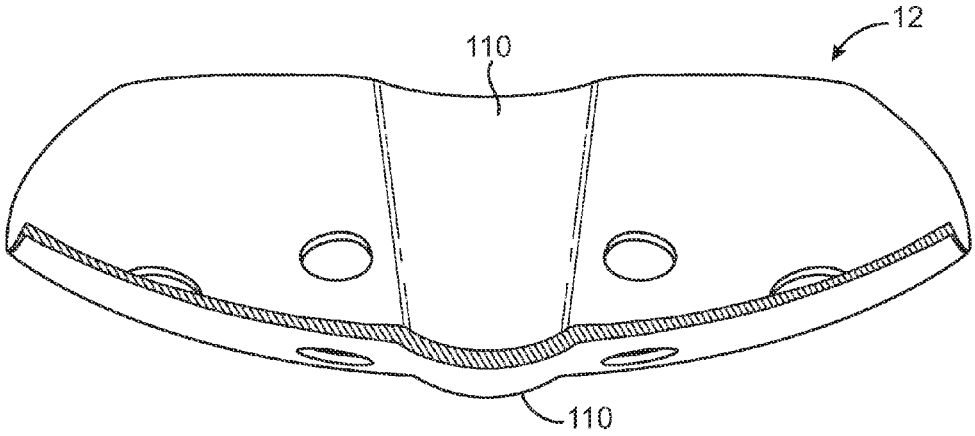
Figure 18H:
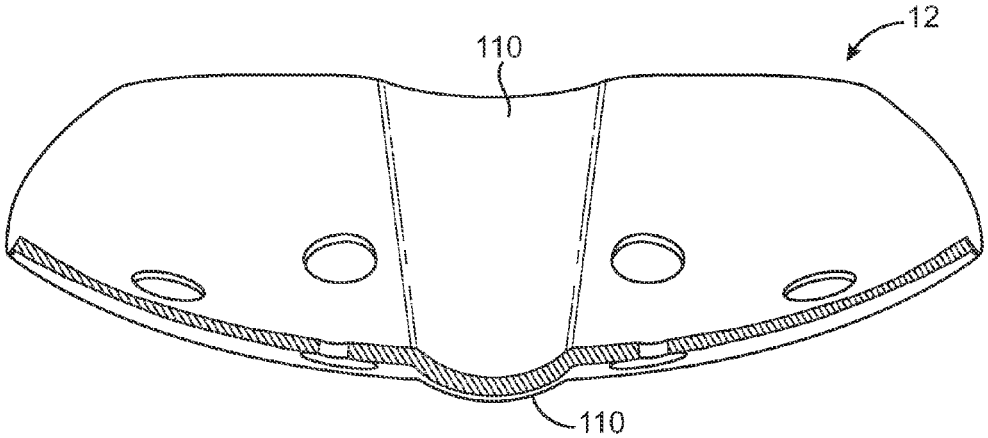
Figure 18I:
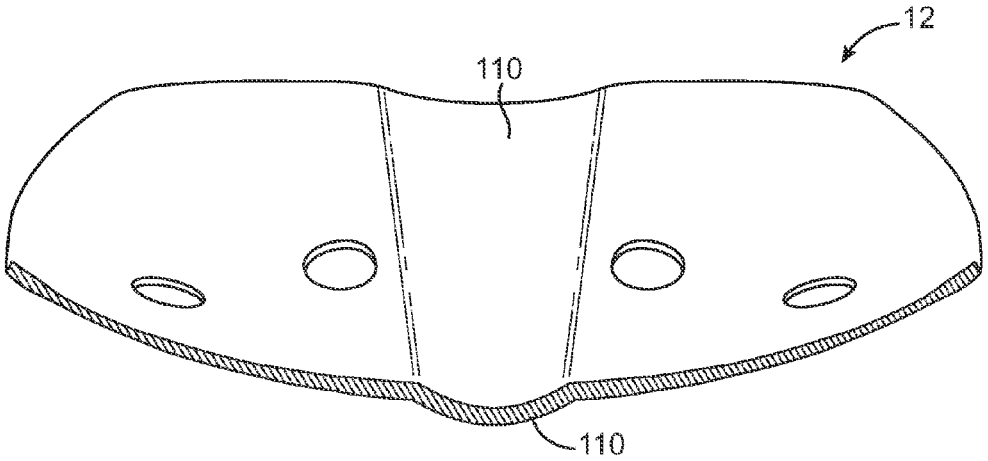
Figure 18J:
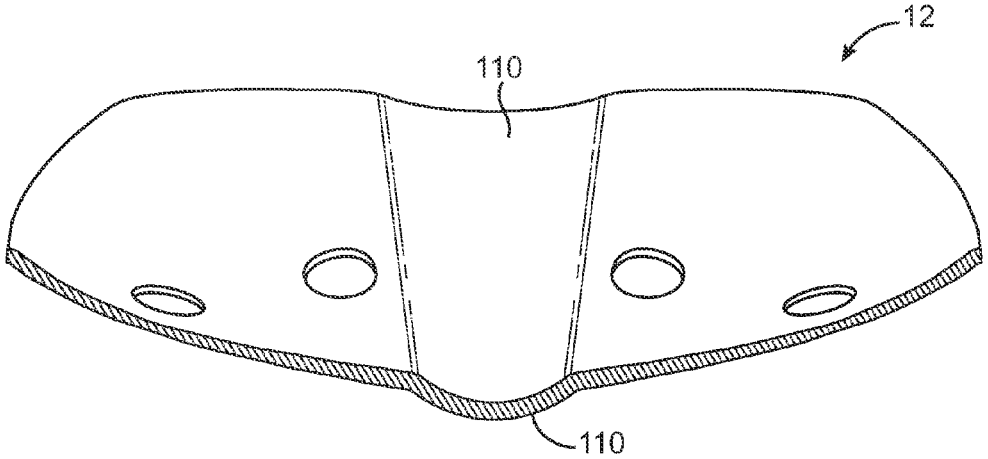
Figure 18K:
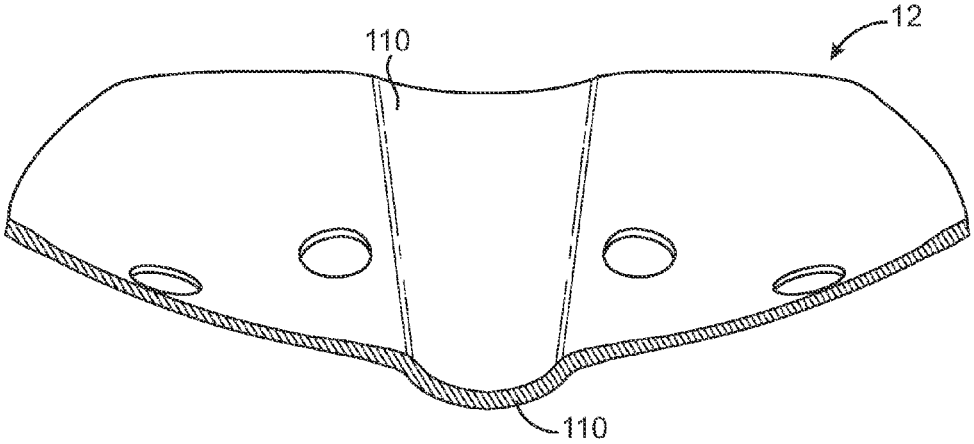
Figure 18L:
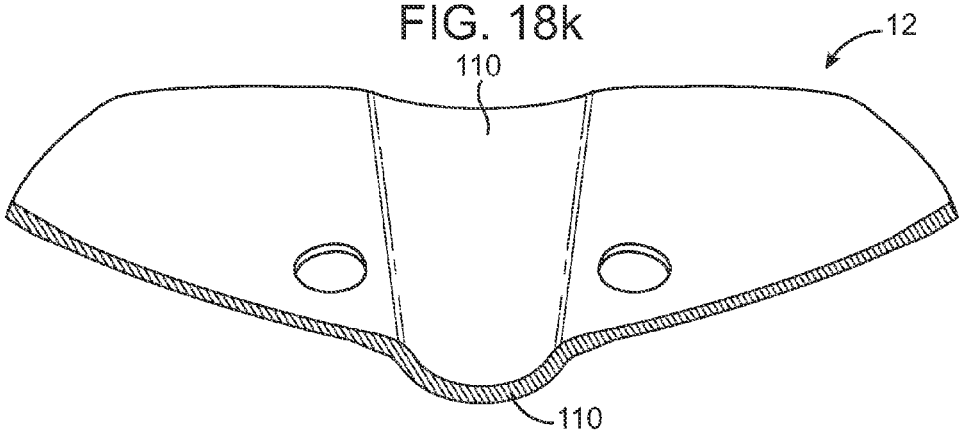
Figure 18M:
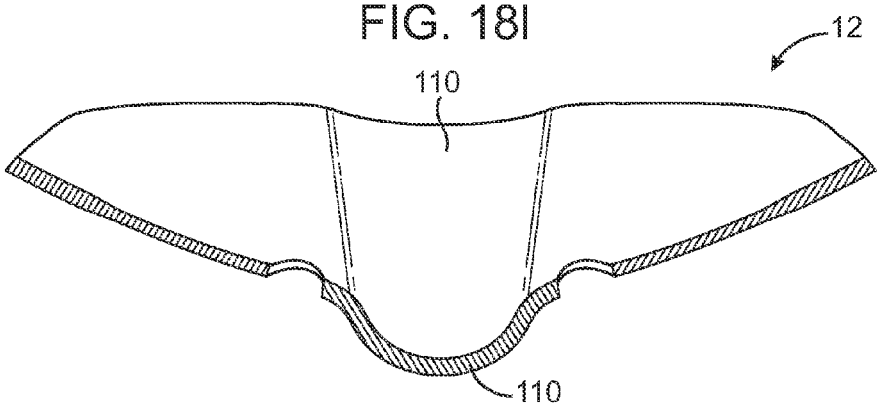
Figure 18N:
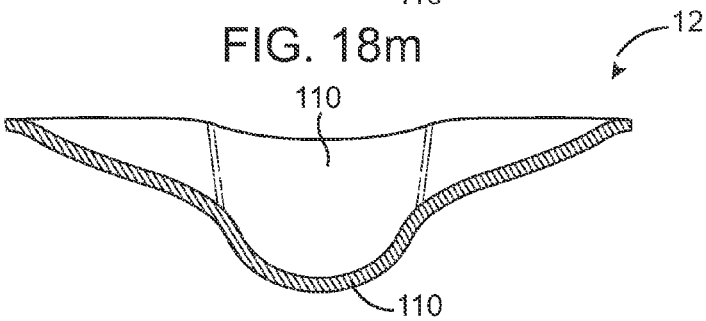

As shown in FIGS. 3A and 3B, the depth of the concave channel 110 gradually decreases as the concave channel 110 extends from upper edges of sections 104 and 105 through the sections 102, 103, to the section 101. FIG. 18*a* shows a top aerial view of the foundation member 12 of FIGS. 3A-3B, and FIG. 18*b* through FIG. 18*n* show cross-sections along cutting planes B-B, C-C, D-D, E-E, F-F, O-O, H-H, I-I, K-K, L-L, M-M, N-N, respectively, as indicated in FIG. 18*a*. FIG. 18*b* through FIG. 18*n* show general cross-section thicknesses of the foundation member 12, and further indicate said gradual change in the depth and thickness of the concave channel 110. The concave channel 110 protrudes from the underside of the foundation member 12 (FIG. 18*b*).

The bowl portion of the foundation member 12 has an underside, at least a portion of which is arcuate and configured to rotate on a supporting surface said first position (non-weight bearing position) when the user's lower pelvic area is not disposed in the bowl portion, and a second position (weight bearing position), rotationally forward of the first position, when the user's lower pelvic area is disposed in the bowl portion. The bowl portion has an underside, at least a portion of which is arcuate along an underside of the concave recessed channel 110 and configured to rotate on a seating surface between the first position and the second position.

The concave channel 110 essentially functions as a downwardly extending wheel-like structure, protruding from a portion of the underside of the foundation member 12 (FIG. 18*b*), promoting the forward rotation of the foundation member from the non-weight bearing to the weight bearing position of the device 100 under user's body. In example, the concave channel 110 is about 10 mm deep at its widest 55 mm, tapering to 40 mm (millimeters). The channel 110 causes rotation of the device 100 on all types of seating surfaces including seat pans (FIGS. 2*a*-2*h*). The channel 110 intersects a generally circular pelvic landing zone 3 in central sections 102, 103 (FIG. 1*a*), wherein the circular pelvic landing zone 3 comprises portions of regions 2F, 3F, 2E, 3E (FIG. 4*a*). The relatively thicker regions 2F and 3F, along with adjacent regions 2E and 3E, provide said landing zone 3 which support the user's pelvic floor on the concave channel 110.

Sections 104 and 105 have an upward incline as shown in FIG. 1*a*. Region 4F of the section 104 forms an arcuate rear and lateral area of the bowl portion with an upper edge. Region 5F of the section 105 forms another arcuate rear and lateral area of the bowl portion with an upper edge. Regions 4F, 5F along with regions 4E, 5E, 4D-2, 5D-2, 1D-1 and 1D-2, form tension regions (tension members) of lower flexibility than other regions of the bowl portion. The tension regions couple to the front section 101 from around and sides of sections 102 and 103 (FIG. 4*a*), such that application of a downward force on the front section 101 from a user's upper legs, causes an upward and inward movement of the upper edges of the rear and lateral area (including 4F, 5F, 4E, 3E) of the bowl portion after the user's lower pelvic area is placed in the bowl portion. Other regions of the foundation member 12 that generally have higher flexibility than said tension regions (and generally have higher flexibility than the regions of the concave channel 110), allow upward and inward movement of said tension regions in response to application of said downward force on the section 101. Essentially at the same time, the concave channel 110 protruding from the underside of the foundation member 12, promotes the forward rotation of the foundation member 12 from the non-weight bearing to the weight bearing position of the device 100 under user's body.

As shown in FIGS. 3*a* and 3*b*, the front portion of the foundation member 12 comprises the front section 101 which is generally lip-like. The sections 104 and 105 are upwardly inclined, and sections 102 and 103 are generally upwardly inclined proximate the sections 104 and 105. The upwardly curved side sections 104 and 105 start at the center line A-A forming said concave channel 110 (FIGS. 3*a*, 3*b*). The sections 104, 105 curve around the sections 102, 103, until they reach section 101. The upwardly curved side sections 104 and 105 extend upwardly somewhat higher than the central sections 102 and 103, wherein the side sections 104 and 105 are essentially equidistant from longitudinal centerline axis A-A extending through the central part of the foundation member 12 between the front section 101 and the rear/side sections 104 and 105.

As shown in FIG. 4*a*, the side sections 104 and 105 are band type, each having five regions. The sections 104 and 105 collectively include around their upper edges the regions 1C-1, 1D-1, 4D-2, 4E, 4F, 5F, 5E, 5D, 1D-1, 1C-1. Further, the sections 104 and 105 collectively include around their lower edges the regions 4D-1, 4C, 5D1, 5C, which are adjacent sections 102 and 103 at regions 2B, 2C, 2D, 3D, 3C, 3B. Essentially all five regions of section 104, and all five regions of section 105, are placed under tension when the user's lower pelvic area is placed in the central bowl portion 20.

The pelvic floor landing zone 3 (FIG. 3*a*) indicated by regions 2E and 3E in FIG. 4*a*) provide an area that is proportionally sized to the average pelvic outlet (base for the ischial tuberosities, that are to be located at its center). The sections 102 and 103 (including regions 2B, 2C, 2D, 2E, 2F, 3F, 3F, 3E, 3D, 3C, 3B), form a portion of the central bowl portion 20 (FIG. 10*b*).

The central sections 102 and 103 form a portion of the bowl area around the lower pelvic area and the muscles that join to the lower pelvis and coccyx. Because the soft tissues of the buttocks typically flow over from sections 102, 103, to the side sections 104 and 105 and front section 101 of the foundation member 12, as generally indicated in FIG. 9, it must be understood that the entire foundation member 12 bears the weight of the seated user.

The sections 104 and 105, which extend along the top of side portions 102 and 103 respectively, form a tension zone extending between the section 101 and the top/rear portion 16 (FIGS. 5, 8*d*) of the sections 104 and 105.

The regions of the side sections 104 and 105 (i.e., band regions 1C-1, 1D-1, 4D-2, 4E, 4F, 5F, 5E, 5D, 1D-2, 1C-2) serve to pull the rear portion 16 forward (i.e., along arrows 104*a* and 105*a* in FIG. 8*d*) at the time a user sits on the central sections 102, 103. Further, the underside of the distal thighs of the legs of the user rest on the front portion section 101. The forward motion of the rear portion 16 serves to assist the outer edges of sections 104 and 105 to move inwardly (i.e., along arrows 104*b* and 105*b* in FIG. 8*d*), resulting in a highly desirable compression of the gluteal and piriformis muscles. Accordingly, the sections 104 and 105 cup around the ischial tuberosities of the user so as to form a dome of cupped muscle tissue m (FIG. 9). The gluteal muscles tend to remain in a desirably slack condition.

Figure 10A:
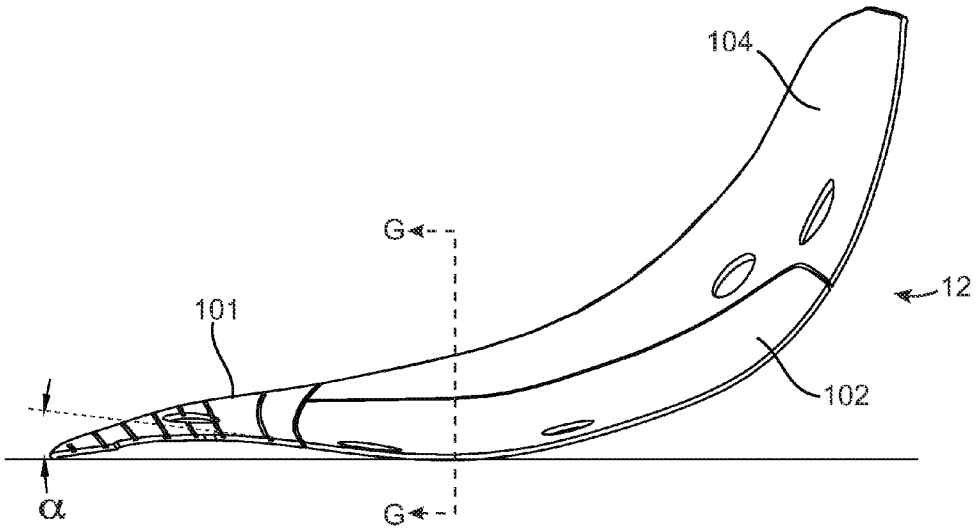
FIG. 10*a* shows a side view of the seating apparatus of FIG. 8*c*, showing a weight bearing position of the seating apparatus, according to an embodiment of the invention.
Figure 10B:
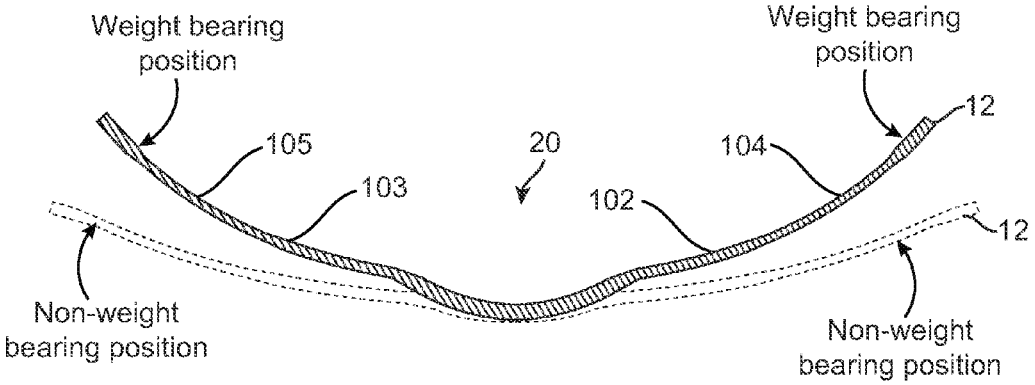
FIG. 10*b* shows a cross-section view G-G of the weight bearing position of the seating apparatus of FIG. 10*a*, with a non-weight bearing position in dashed lines superimposed thereon, indicating the cupping effect of the weight bearing position of the seating apparatus, according to an embodiment of the invention.

FIG. 10*a* shows a side view of the foundation member 12 in weight bearing position, with a cutting plane G-G about which a cross sectional view is taken as shown in FIG. 10*b*. FIG. 10*b* shows in dashed lines the non-weight bearing shape of the foundation member 12, and shows in solid lines the weight bearing shape of the foundation member 12 when a user's pelvic region is disposed in the bowl portion 20, indicating the cupping effect of the weight bearing position of the foundation member 12.

Figure 10C:
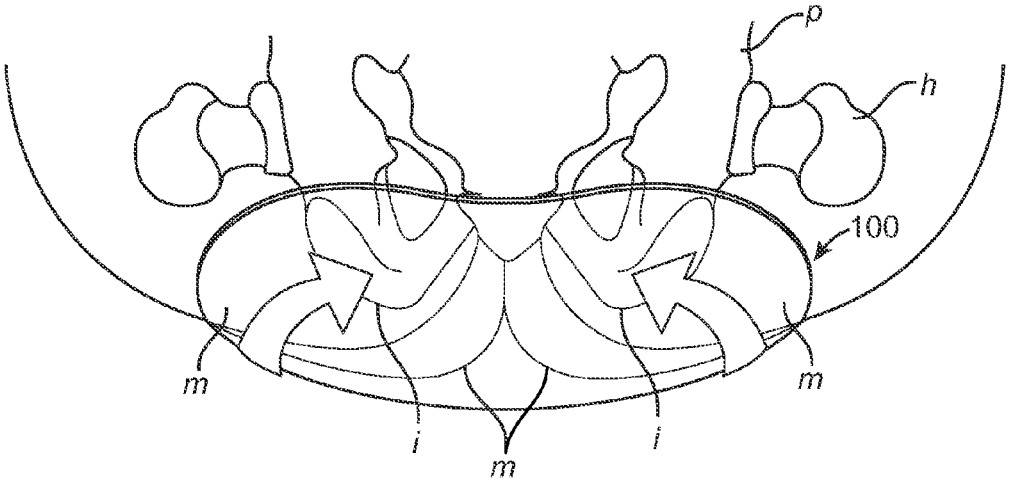
FIG. 10*c* shows a rear view of a weight bearing position of the seating apparatus of FIG. 1*a*, with an anatomical illustration, with arrows indicating the cupping and cradling of the gluteus muscles that place inward pressure on the lower wings of the pelvis Ischial Tuberosites, according to an embodiment of the invention.
Figure 10D:
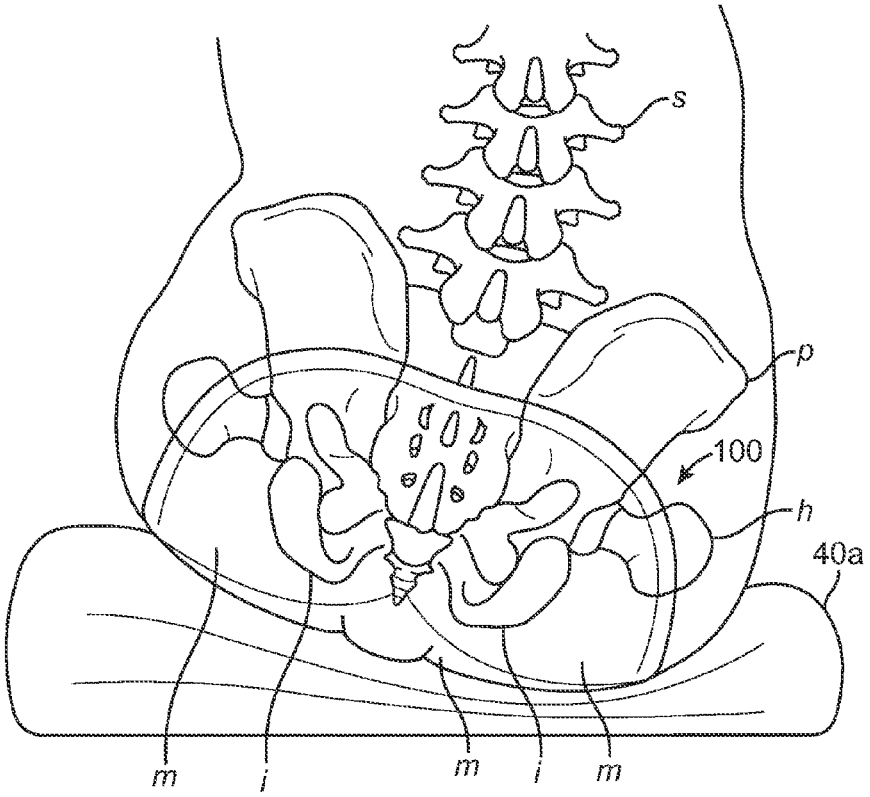
FIG. 10*d* shows a rear view of the weight bearing position of the seating apparatus of FIG. 10*c*, on a soft supporting surface, indicating how the seating apparatus maintains the cupping and cradling of the gluteus muscles when the user leans sideways, according to an embodiment of the invention.
Figure 10E:
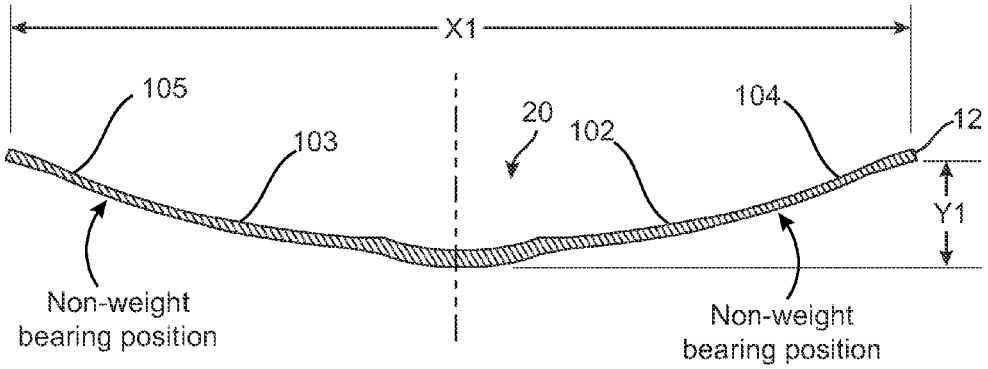
FIG. 10*e* shows a cross-section view G-G of a non-weight bearing position of the seating apparatus of FIG. 10*a*, according to an embodiment of the invention.
Figure 10F:
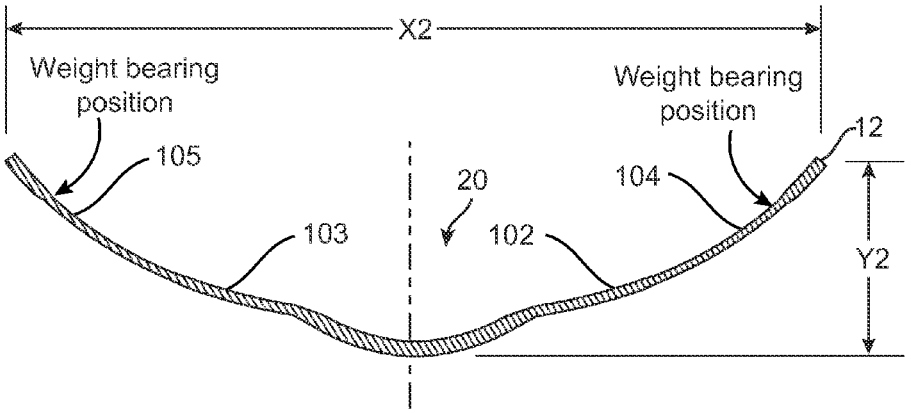
FIG. 10*f* shows a cross-section view G-G of the weight bearing position of the seating apparatus of FIG. 10*a*, according to an embodiment of the invention.

FIGS. 10*e*, 10*f* represent cross-sectional views of the foundation member 12 in two different modes or circumstances, with these views being taken at the location of the above-mentioned cutting plane G-G. FIG. 10*e* shows the configuration of the foundation member 12 (first shape) when it is not bearing the weight of a seated user. In this instance, a characteristic depth of the device is indicated by Y1, and the characteristic width is indicated by X1. FIG. 10*f* shows the configuration of the foundation member 12 (secondary shape) when bearing the weight of a seated user. FIG. 10*f* shows the central portion sections 102 and section 103, and side/rear sections 104 section 105 of the device 100 assume a more deeply curved configuration when bearing the weight of a user, wherein the new depth of the device, as indicated by Y2, exceeds the depth of Y1 of the device. This results in a volumetric increase of the central portion 20 of the foundation member 12 when it is bearing the user's weight.

By way of example, the depth dimension Y1 of 10*e* may be about 1.5 inches whereas the depth dimension Y2 may be up to about 3.00 inches. As another example, the width dimension X1 may be about 12.75 inches, and the width dimension X2 in may be as narrow as 10.50 inches.

FIG. 10*b* represents a superimposition of FIGS. 10*e* and 10*f*, emphasizing the inward cupping effect of the upwardly curving side sections 104, 105, which extend along the top of the sections 102 and 103 respectively, forming a type of tension mechanism extending between the front lip-like section 101 and the rear portion 16 of the foundation member 12. The varying thicknesses of spring leaf like band regions of the side sections 104 and 105 (i.e., regions 1C-1, 1D-1, 4D-2, 4E, 4F, 5F, 5E, 5D, 1D-2, 1C-2), serve to pull the rear portion 16 forward at the time a user sits on the sections 102, 103, when under tension by the weight of the seated user. The weight bearing position of the foundation member (FIG. 10*f*) clearly indicates that the side sections 104, 105, push inwardly and somewhat upwardly under the weight of the seated user. Whereas, the non-weight bearing position in FIG. 10*e* shows the side sections 104, 105 are actually lower than their position under a seat user weight in FIG. 10*f*. As such, the downward pressure of body weight does not serve to bend the side sections 104, 105 downward.

Figure 1E:
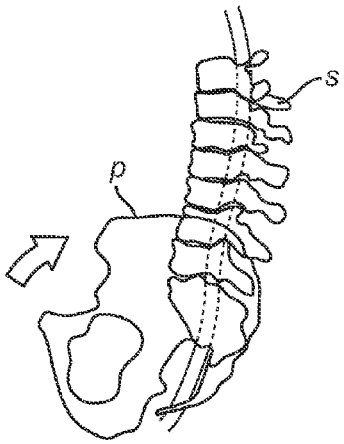
FIG. 1*e* shows a side view rendering of anatomical Kyphotic lumbar spine and pelvis.
Figure 1G:
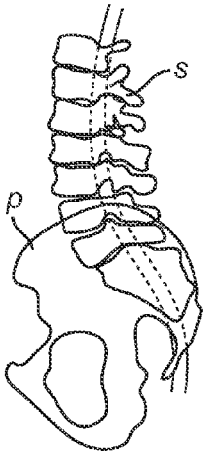
FIG. 1*g* shows a side view rendering of anatomical lordotic lumbar spine and pelvis.
Figure 1F:
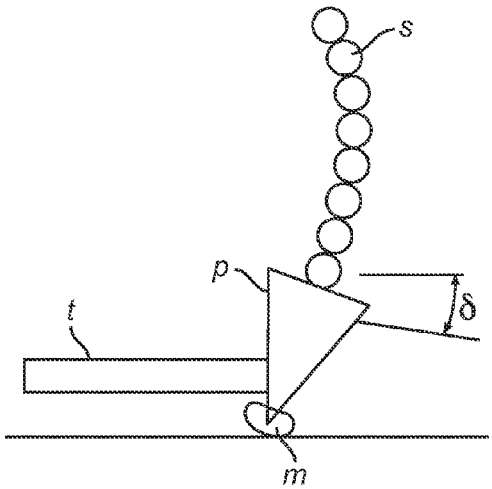
FIG. 1*f* shows a side view of a mechanical robot anatomical skeleton representation corresponding to the anatomical Kyphotic lumbar spine and pelvis of FIG. 1*e*.
Figure 1H:
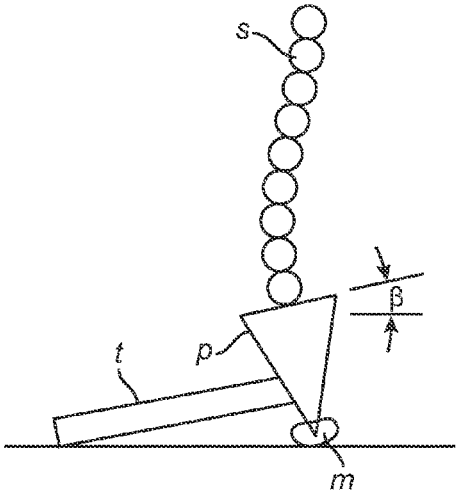
FIG. 1*h* shows a side view of a mechanical robot anatomical skeleton representation corresponding to the anatomical Lordotic lumbar spine and pelvis of FIG. 1*g*.
Figure 8A:
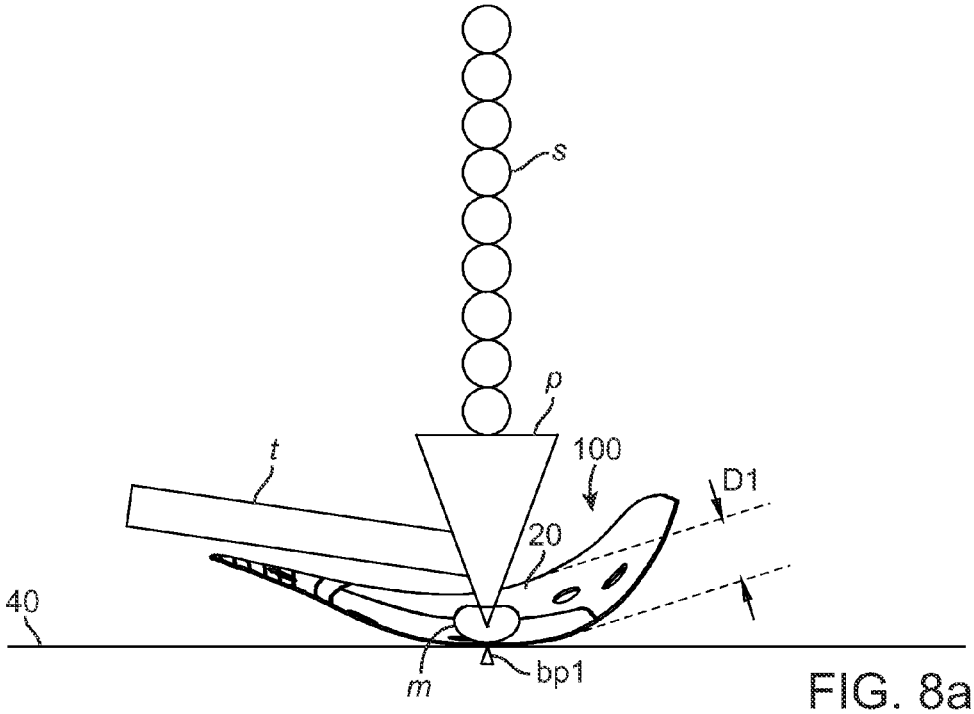
FIG. 8*a* shows a side view of the seating apparatus and mechanical robot anatomical skeleton, corresponding to FIG. 1*c*, according to an embodiment of the invention.

FIG. 8*a* shows a side detailed view of the device 100 and mechanical robot anatomical skeleton representation of a user anatomy. The mechanical robot anatomical skeleton representations in FIG. 8*a* (and other figures) are equivalent to human anatomies shown in other figures, and are used for simplicity and clarity of the figures in showing the device 100 and how it operates. For comparison, FIGS. 1*e*-1*h* show general relationship between the mechanical robot anatomical skeleton representation and the user anatomy. Specifically, FIG. 1*e* shows a side view rendering of a user anatomical Kyphotic lumbar spine and pelvis. FIG. 1*f* shows a side view of an equivalent mechanical robot anatomical skeleton representation corresponding to the anatomical Kyphotic lumbar spine and pelvis of FIG. 1*e*. Approximate angle $\delta=20°$ indicates the posterior tilt of the pelvis. FIG. 1*g* shows a side view rendering of a user anatomical lordotic lumbar spine and pelvis. FIG. 1*h* shows a side view of the mechanical robot anatomical skeleton representation corresponding to the anatomical Lordotic lumbar spine and pelvis of FIG. 1G. Approximate angle $\beta=20°$ indicates anterior tilt of the pelvis.

Figure 8B:
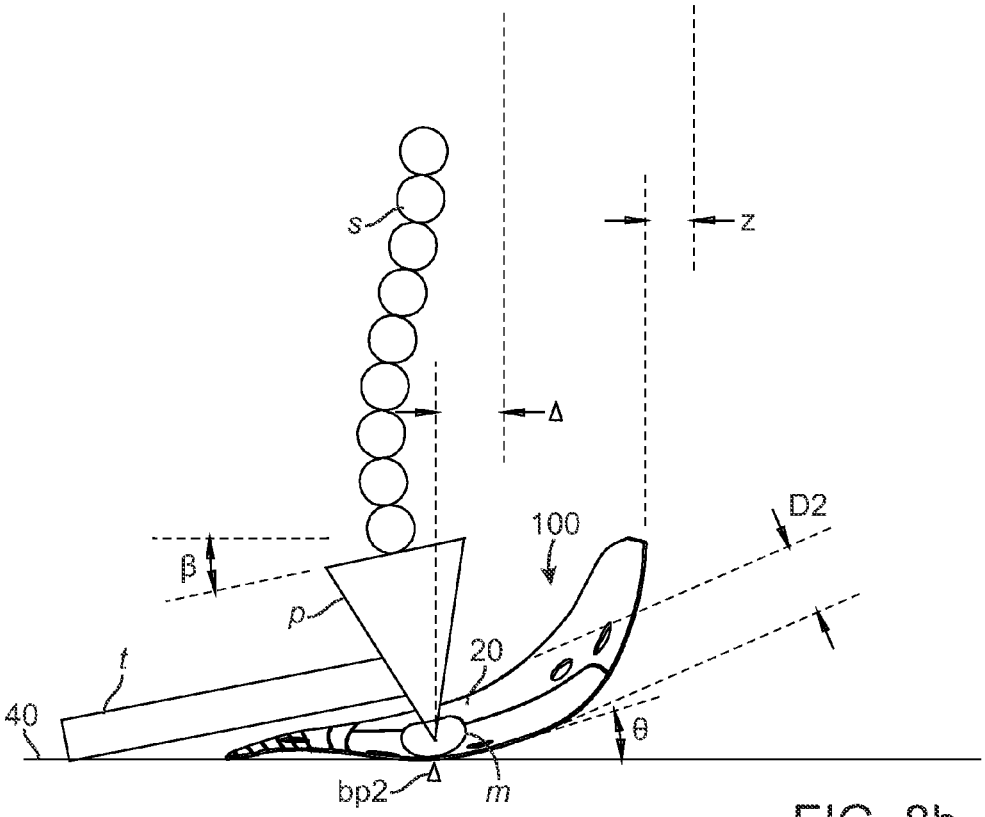
FIG. 8*b* shows a side view of the seating apparatus and mechanical robot anatomical skeleton corresponding to FIG. 1*d*, with the seating apparatus in a tilted forward weight bearing position, according to an embodiment of the invention.

The illustration in FIG. 8*a* is equivalent to that in FIG. 1*c*, and showing in more detail the transitional state with the user touching the device 100, continuing the act of sitting and continuing transfer of body weight to the device 100. The example bowl depth D1 is about 1.5 inches. The illustration in FIG. 8*b* is equivalent to that in FIG. 1*d*, and showing in more detail that the device 100 has rotated to its tilted forward, weight bearing position (second position). The approximate angle $\beta=12°$ indicates forward anterior tilt of the pelvis. The example bowl depth D2 is up to 3 inches.

Referring to FIG. 8*b*, the section 101 bends downward under the pressure of the distal thighs of a user, wherein the section 101 creates a stop at a low where pelvis ischial tuberosities pivots on. As such, the device 100 provides forward lordotic curve stabilization of the pelvis that maintains its interior tilt. The device 100 rotates forward from a non-weight bearing gravity equilibrium point bp1 (FIG. 8*a*) into a weight bearing gravity equilibrium point bp2 (FIG. 8*b*), on the supporting surface 40. The illustrations in FIG. 12*c* more clearly shows the position of the device 100 on bp1, and weight bearing position of the device 100 on bp2. The position of the device 100 on bp1 corresponds to the illustrations in FIGS. 1*b* and 1*c*, wherein the device 100 does not yet bear the full weight of the user. In the description herein, the term non-weight bearing indicates the status of the device 100 as in FIGS. 1*b*, 1*c*, 8*a*, in its first position on point bp1, and the term weight-bearing indicates the status of the device 100 as in FIGS. 1*d* and 8*b* with the device 100 bearing the full weight of the user in the bowl portion and tilted forward to its second position on point bp2. The section 101 and the rear portion of the sections 104, 105, move forward a distance Z. By way of example, the distance Z can range between about 0.50 inches and about 3.50 inches, with about 2.5 inches being typical. The shift between the location of balance point bp1 and the location of balance point bp2 as a result of this tilting is represented by the distance Δ and may be, for example, about 2.0 inches to about 2.3 inches average, and up to about 2.50 inches.

In FIG. 8*b*, the device 100 has assumed an incline angle θ to the supporting surface 40 (usually a horizontally disposed surface) as a result of the device 100 bearing the weight of the user. An angle θ of approximately 17° is typical. The forward tilt/rotation of the device 100 on the surface 40 by the incline angle θ creates an essentially optimal pelvic stabilization that maintains an interior tilt.

By the action of the sections 104, 105, and the downward curving of the front section 101, the rear portion 16 of the sections 104, 105, is move forward the distance Z. The shift between the location of balance point bp1 and the location of balance point bp2 as a result of this tilting is represented by the distance Δ.

Figure 12A:
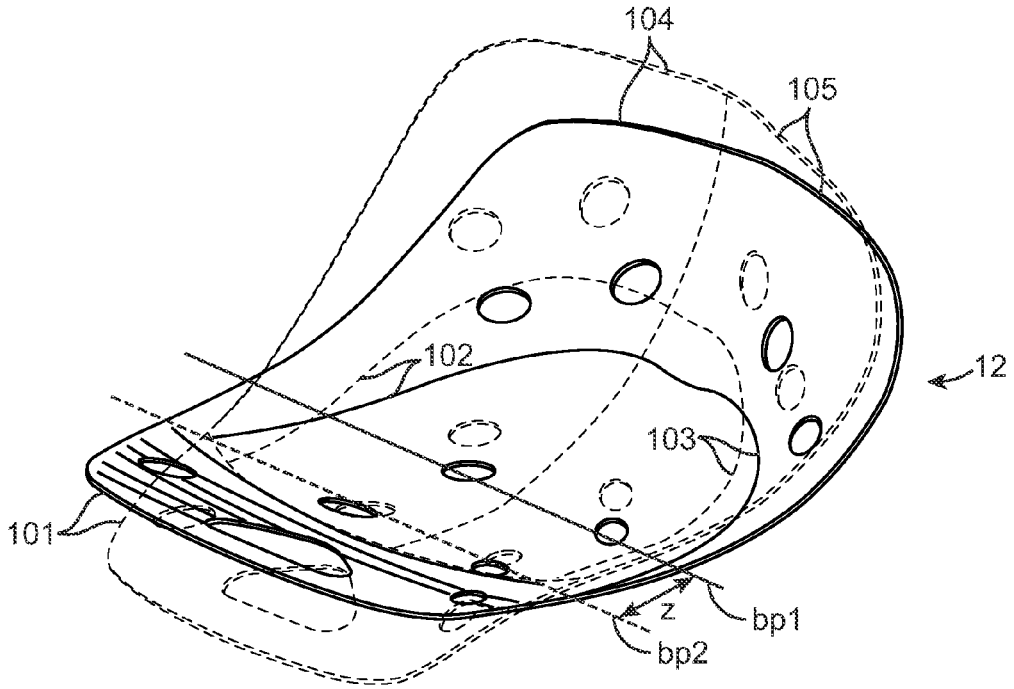
FIG. 12*a* shows a top perspective view superimposition of non-weight bearing position of the seating apparatus of FIG. 1*a* in dashed lines, and weight bearing position of the seating apparatus in solid lines, indicating forward shifting in center of gravity equilibrium from the non-weight bearing position to weight bearing position of the seating apparatus, according to an embodiment of the invention.
Figure 12B:
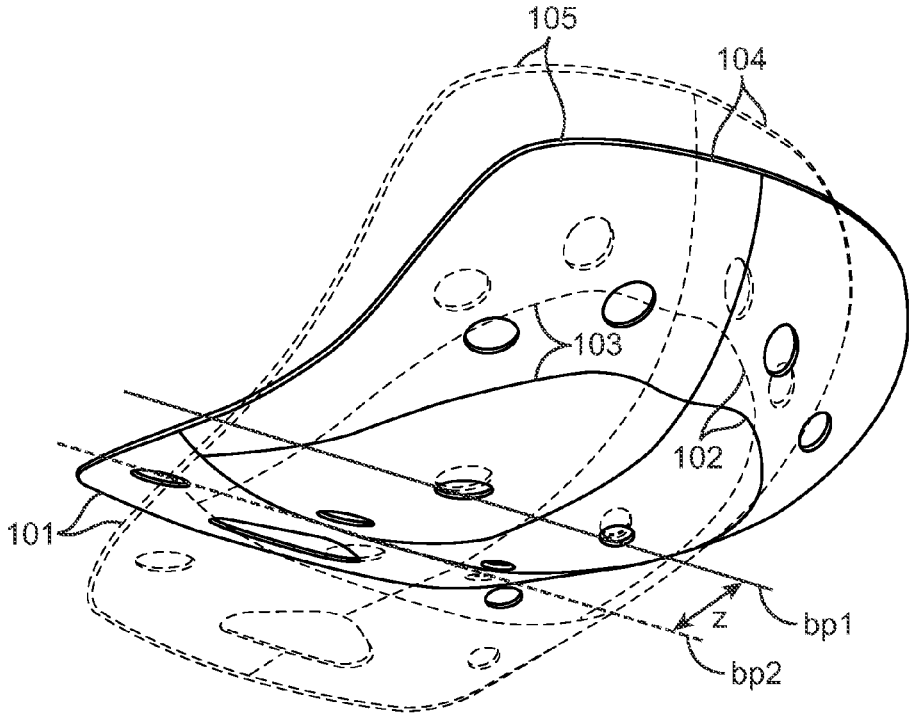
FIG. 12*b* shows a bottom perspective view of the illustration in FIG. 12*a*, according to an embodiment of the invention.

FIG. 12*a* shows a top perspective view superimposition of non-weight bearing position of the foundation member of the device 100 (in dashed lines), and weight bearing position of the foundation member 12 (in solid lines). As in FIGS. 8*b* and 12*c*, the illustration in FIG. 12*a* indicates forward shift Z in the center of gravity equilibrium bp1 from the non-weight bearing position to the center of gravity equilibrium bp1 in the weight bearing position, of the foundation member 12. FIG. 12*b* shows a bottom perspective view of the illustration in FIG. 12*a*.

Figure 7A:
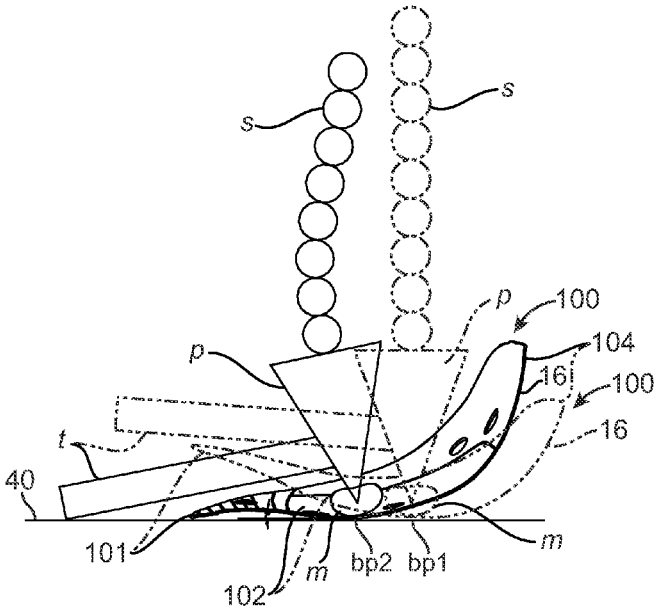
FIG. 7*a* shows a right side view of the apparatus of FIG. 1*a*, on a supporting surface, superimposing the illustration on FIG. 1*c* on the illustration of FIG. 1*d*, according to an embodiment of the invention.
Figure 7B:
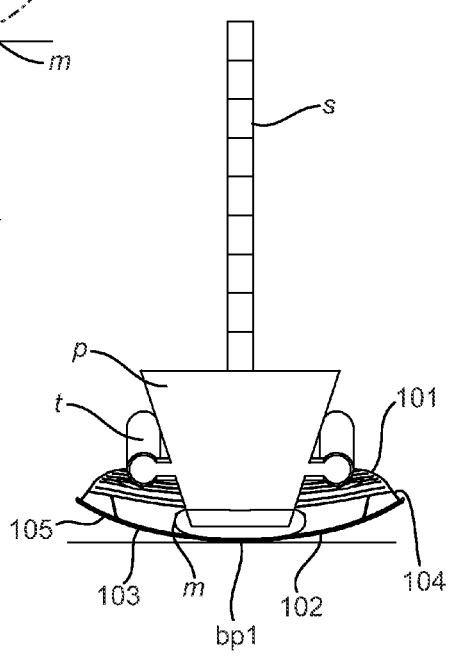
FIG. 7*b* shows a cross-section view E-E of the seating apparatus of FIG. 7*a*, looking from the rear, showing the ischial tuberosities pelvis prior to the user distal thighs pushing down on the front section of the seating apparatus, according to an embodiment of the invention.
Figure 7C:
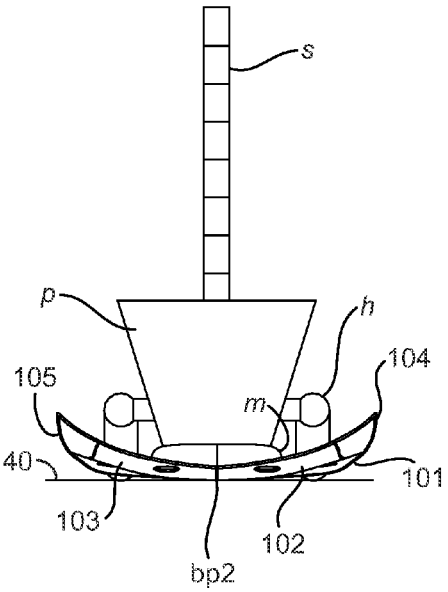
FIG. 7*c* shows a cross-section view E-E of the seating apparatus of FIG. 7*a*, looking from the rear, showing tuberosities and pelvis fully engage and filling central sections of the weight bearing seating apparatus with muscle tissue, according to an embodiment of the invention.

FIG. 7*a* shows a side view superimposition of the non-weight bearing position of the device 100 on the point bp1, and the weight bearing position (rotated forward) to the point bp2. FIG. 7*b* shows a cross-section view of the device 100 of FIG. 7*a* at cutting plane through bp1 (FIG. 12*a*), looking from the rear, showing the ischial tuberosities pelvis prior to the user distal thighs pushing down on the front section of the device 100. FIG. 7*c* shows a cross-section view of the device 100 of FIG. 7*c* at cutting plane through bp2 (FIG. 12*a*), looking from the rear, showing the ischial tuberosities pelvis prior to the user distal thighs pushing down on the front section of the device 100.

Figure 12C:
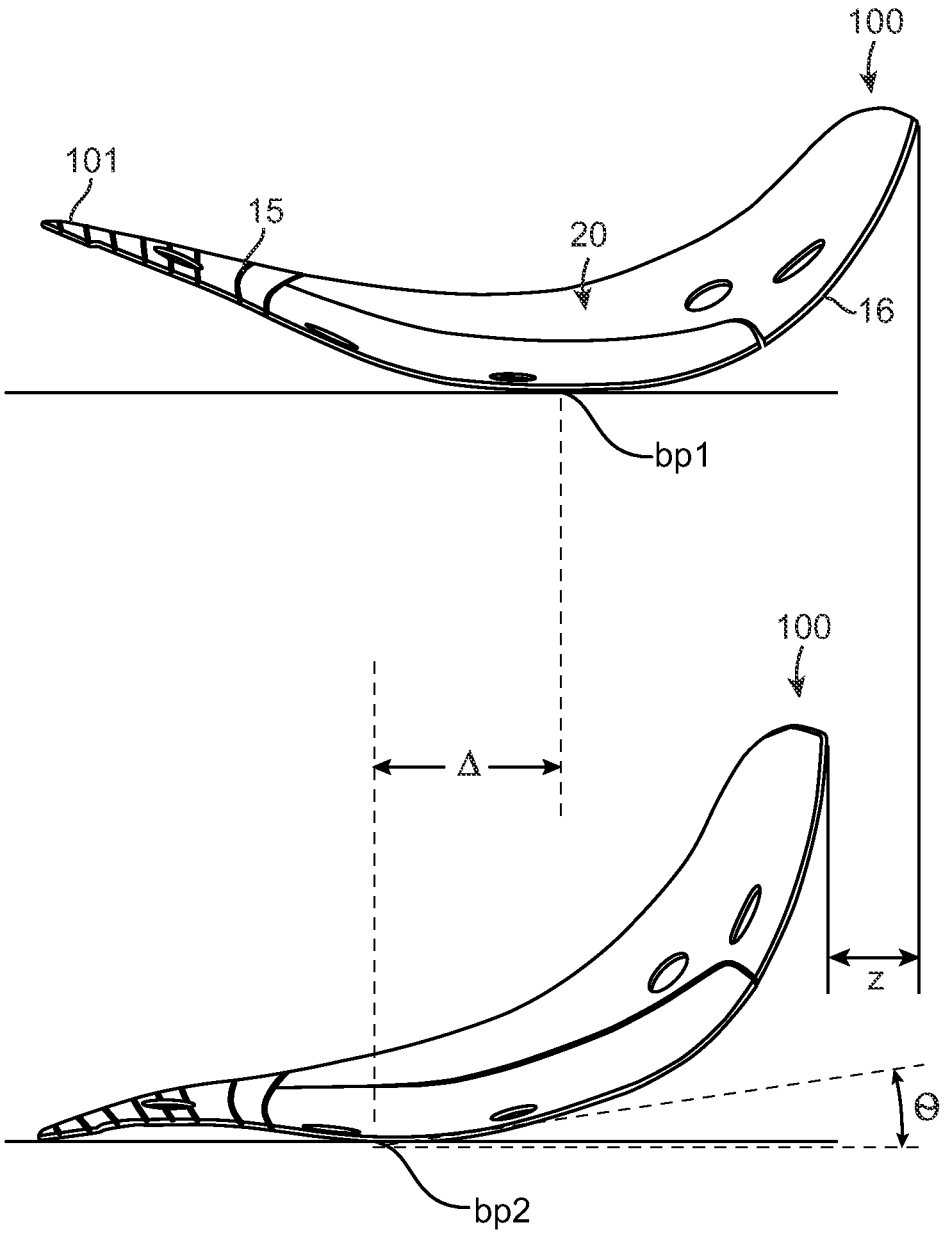
FIG. 12*c* shows cross-section views of the illustration in FIG. 12*a*, according to an embodiment of the invention.

FIG. 12*c* shows a cross sectional view of the device 100 taken at a location parallel to the centerline A-A of the device 100 (FIG. 1*a*), with this view indicating the relationship of the front portion 101 to the rear portion 16 of sections 104, 105. FIG. 12*c* shows cross-section views of the illustration in FIG. 12*a* indicating two positions or states of the device 100. The top illustration in FIG. 12*c* (corresponding to FIG. 8*a*) indicates the first position of the device 100 wherein weight of a user is not being borne by the device 100, illustrating how that the bowl portion 20 resides on the parent surface 40 in approximately a horizontal attitude. The bottom illustration in FIG. 12*c* (corresponding to FIG. 8*b*) indicates the second position of the device 100 as having been caused to undertake a considerable amount of downward rotation/tilt, indicated by the angle θ. This downward rotation is partly as a result of the weight of the lower pelvis of the user on the sections 102, 103 of the bowl portion 20, and presence of the legs of the user, with the hamstring portions of the distal flies, that is, the underside of the upper thigh portions of the user's legs, resting on the front, lip-like section 101, causing a substantial amount of downward curvature.

FIG. 12*c* shows the dramatic difference when the device 100 goes from its original non-weight bearing state into its secondary state (secondary shape). This overlay/superimposition exhibits the shift of central balance point from location bp1 forward to location bp2. Also depicted is the back portion 16 shifting forward by distance Z, the bowl portion 20 being shifted forward and the front section 101 bending down and coming in contact with the parent surface 40.

FIG. 9, taken at approximately at the cutting plane G-G of FIG. 10*a*, shows the addition of the anatomical details of a typical pelvic area in order to indicate a proportional relationship of the pelvic area to the size of the device 100. This view, looking from the back of the device 100, involves the device 100 resting on a hard supporting surface 40. The positioning of the ischial tuberosities i with respect to the central bowl portion 20 sections 102 and 103 is shown. Also indicated are the positions of the side sections 104, 105, which are almost directly below the hip sockets h.

For example, FIGS. 9, 2*a-h*, 10*c*, 10*d*, 11*b*, show the cupping effect upon the lower part of the pelvic area, with this cupping effect not extending to the soft tissues that overhang the periphery of the device 100. Soft tissues representing the outlines of buttocks of various sizes are denoted by W1, W2 and W3 in FIG. 9.

FIGS. 2*a*, 2*b* and 9 illustrate anatomical representation of a typical pelvic area and spine, along with the distal thigh bone, clearly indicating the proportional size of the average pelvis to the device 100. The anatomical illustration in FIG. 2*a*, FIG. 9, and FIG. 7*a* (in solid lines) indicate the forward tilt that is undertaken by the pelvis when the device 100 has moved into its secondary shape. Also illustrated is the effect of the weight of the upper body when the ischial tuberosities are residing in the center of the bowl portion 20. This weight does not distort the secondary shape beyond a front lip-like section 101 being bent downward, placing the side sections 104, 105 under tension and pulling the upwardly inclined rear portion 16 forward.

Also indicated in FIGS. 8*b*, 10*b* and 10*f*, is the increase in depth of the bowl portion 20 of the device 100 (sections 102, 103 along with sections 104, 105) helping to cup and cradle the gluteus muscles directly around the bottom outlet of the pelvis. A constant compression of the gluteal and piriformis muscles such that they cup around the ischial tuberosities is thus advantageously brought about by the device 100.

Figure 3C:
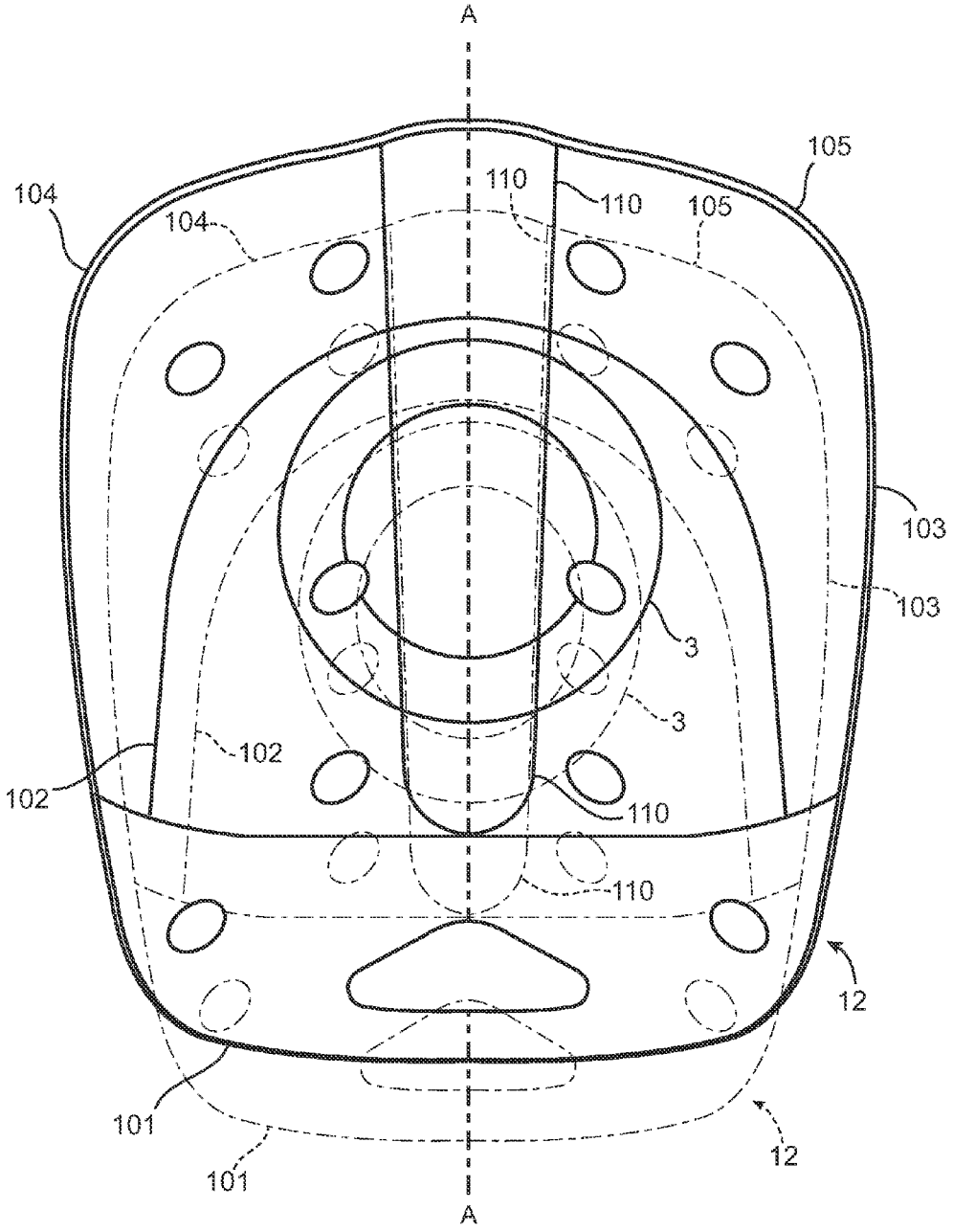
FIG. 3*c* is a view similar to FIG. 3*a* but to a larger scale and showing by the use of dashed lines, the shift that has taken place when the seating apparatus has assumed its secondary configuration while bearing the weight of a seated user.

FIG. 3*c* shows by use of dashed lines, the shifting that takes place at the time weight has been placed upon the foundation member 12, and downward tilting of the front, lip-like portion section 101. The shifting of the zone 3 are specifically depicted by a circle made up of dashed lines. The long dashed lines extending along the sides indicate that as a result of the placement of weight of the seated user upon the central portion of the device 100, the periphery/side edges of sections 104 and section 105 are caused to move inwardly and somewhat upwardly. The side sections 104, 105 have moved inwardly rather than outwardly during the application of the user's weight to the device 100, this being due to the fact that the under surfaces of the user's thighs push downwardly on the forward section 101, which brings about a tensioning of the side sections 104, 105. This tensioning of the side sections 104, 105 cause the inward movement of the side sections 104, 105. The varying thicknesses of the sections 102-105, function as a type of a leaf spring, enhancing the inwardly and upwardly cupping action of the sections 104, 105.

Preferably, the front lip-like section 101 of the foundation member is constructed to have a specific bend point at the front of the central bowl portion 20. One implementation involves provide at least one flexible arc or groove 15 thereon (FIG. 12*c*). The groove 15 extends across the front section 101, substantially perpendicular to the longitudinal centerline A-A. The groove 15 not only serves to increase the flexibility of the front section 101, but also serves to cause the device 100 to bend so as to assume the desired secondary shape at the time the undersurface of the user's distal thighs come into contact with the front, lip-like section 101. As previously mentioned, the downward bending of the front section 101 acts through the sections 104 and 105 so as to pull the rear portion 16 to move forward. The sections 104 and 105, which extend along the top of side portions 102 and 103 respectively, form a type of tension member extending between the front section 101 and the rear portion 16 of the device 100. The side sections 104 and 105 with their spring leaf like band regions (i.e., regions 1C-1, 1D-1, 4D-2, 4E, 4F, 5F, 5E, 5D, 1D-2, 1C-2) serve to pull the rear portion 16 forward at the time a user sits on the central bowl section 102 section 103, with the underside of the distal thighs of the user's legs resting on the front section 101. Such forward motion of the rear portion 16 serve to assist the side sections 104 and 105 moving inwardly so as to bring about a highly desirable compression of the gluteal and piriformis muscles such that they cup around the ischial tuberosities so as to form a dome of cupped muscle tissue.

The flexible arcs/groove 15 is positioned on the device 100 proximate the point where the section 101 and the sections 102, 103 meet. The groove 15 causes bending of the device 100 proximate the groove 15, in addition to providing flexibility. The groove 15 helps bring about the secondary shape of the device 100 identically each time the device 100 is placed under pressure from the seated user. The arc 15 may be duplicated other places in section 101 (FIG. 3*c*).

The device 100 may be utilized in a variety of environments, such as on the seat of an automobile; on any item of furniture such as a couch or easy chair; upon a chair with a relatively hard bottom; or even on a hard seat such as to be found in a stadium or the like (e.g., FIGS. 2*a*-2*h*). In any of these events, the bowl portion 20 of the foundation member 12 will undertake a degree of downward rotation/tilt with respect to the horizontal in the general manner described above.

Although certain illustrations employed in such drawings as FIGS. 2*a-d*, 8*a*, 8*b*, have been utilized while the foundation member 12 is residing on a hard surface, it is to be understood that the secondary shape of the device 100 is also obtained while the device 100 is residing upon a resilient or soft surface. This secondary shape in soft surfaces floats down into the foams and fabric of ergonomic chairs and takes on the same secondary shape as if it was on a hard surface. Certain illustrations have been shown on a hard surface because the overhanging soft tissues and the angle of the forward tilt of the foundation member is visually more dramatic. It is most important to keep in mind, however, that the same highly advantageous tilt and cupping action brought about by the device 100 occurs essentially independently of the hardness or softness of the supporting surface.

The varying thickness regions of the foundation member 12 (FIG. 4*a*), function as leaf spring band like regions with their specific thickness flows allowing transitioning of the additional soft tissues over the edge of the device 100 comfortably without the need for additional padding. Specifically, the five sections 101-15 and their varying thickness regions function as a spring leaf structure, wherein with each thickness change is analogous to a separate layer of thickness of the material the device 100 is made of, much like a spring leaf assembly. When the device 100 is placed under weight of a user in the central bowl portion 20, the downward pressures push down on the leaf spring like assembly of the device 100. The sections 101-105 with their varying thickness regions provide the function of the novel device 100, compared to devices with constant thickness which depend only upon memory retentive plastics they are made of.

The "wings" on the concave channel 110 in sections 102, 103 (regions 2E and 3E), in the bowl-like pelvic zone 3, holds the ischial tuberosities pelvic floor that land just outside the concave channel 110. The serpentine bands like sections 104, 105, which extend along the top of side portions 102 and 1033 respectively, form a type of tension member extending between the front, lip-like portion section 101 and the rear portion 16 of the foundation member 12. The side sections 104 and 105 along with their spring leaf like band regions (1C-1, 1D-1, 4D-2, 4E, 4F, 5F, 5E, region 1D-2, 1C-2) serve to pull the rear portion 16 forward at the time a user sits on the central sections 102, 103 with the underside of the distal thighs of the user's legs resting on the front portion section 101. Such forward motion of the rear portion 16 serve to assist the side sections 104 and 105 moving inwardly so as to bring about a highly desirable compression of the gluteal and piriformis muscles such that they cup around the ischial tuberosities so as to form a dome of cupped muscle tissue.

Figure 3D:
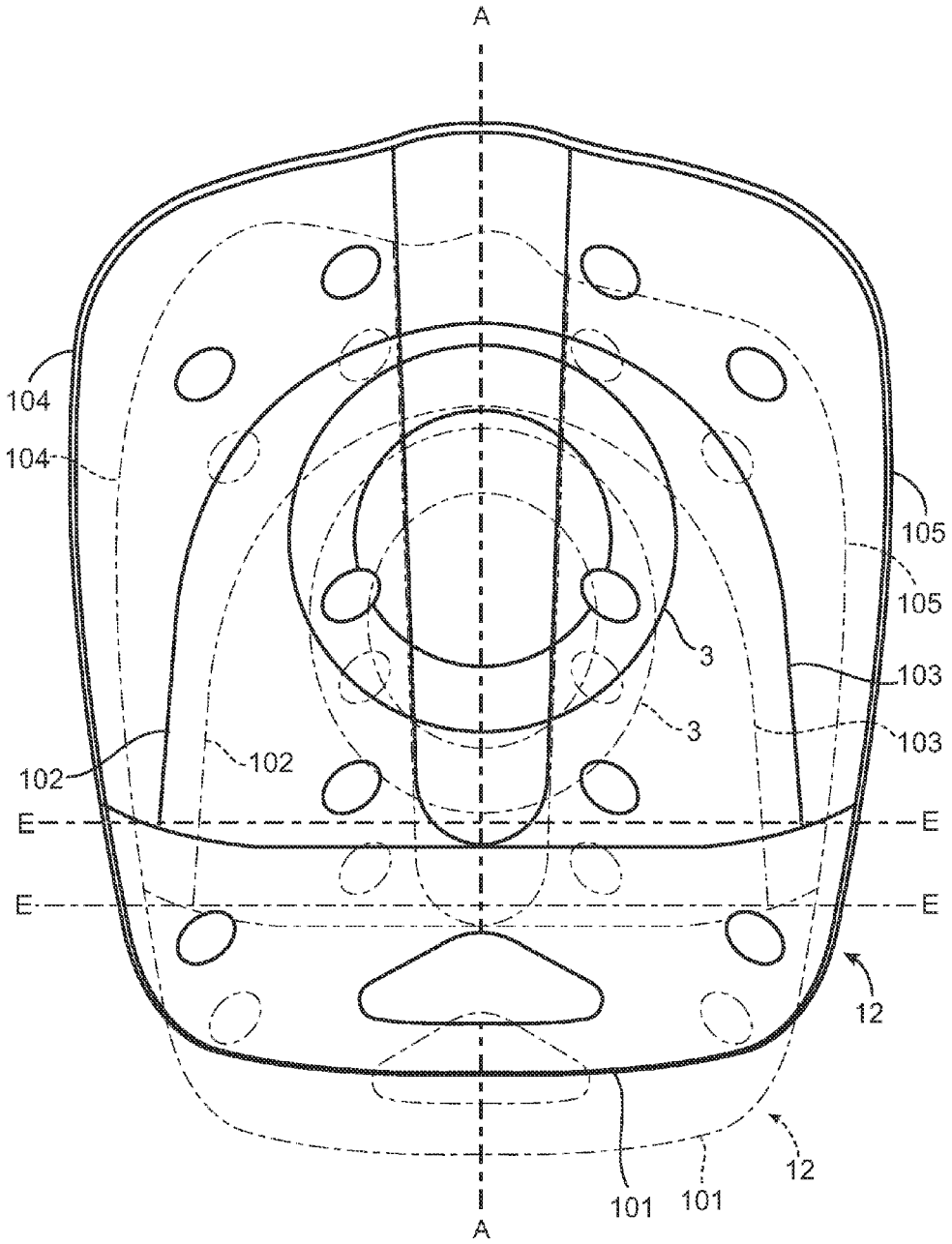
FIG. 3*d* is a view similar to FIG. 3*c*, but showing by use of dashed lines, the shifting that takes place at the time weight has been placed upon the foundation member, further torsion of the foundation member when a seated user twists to the right.
Figure 3E:
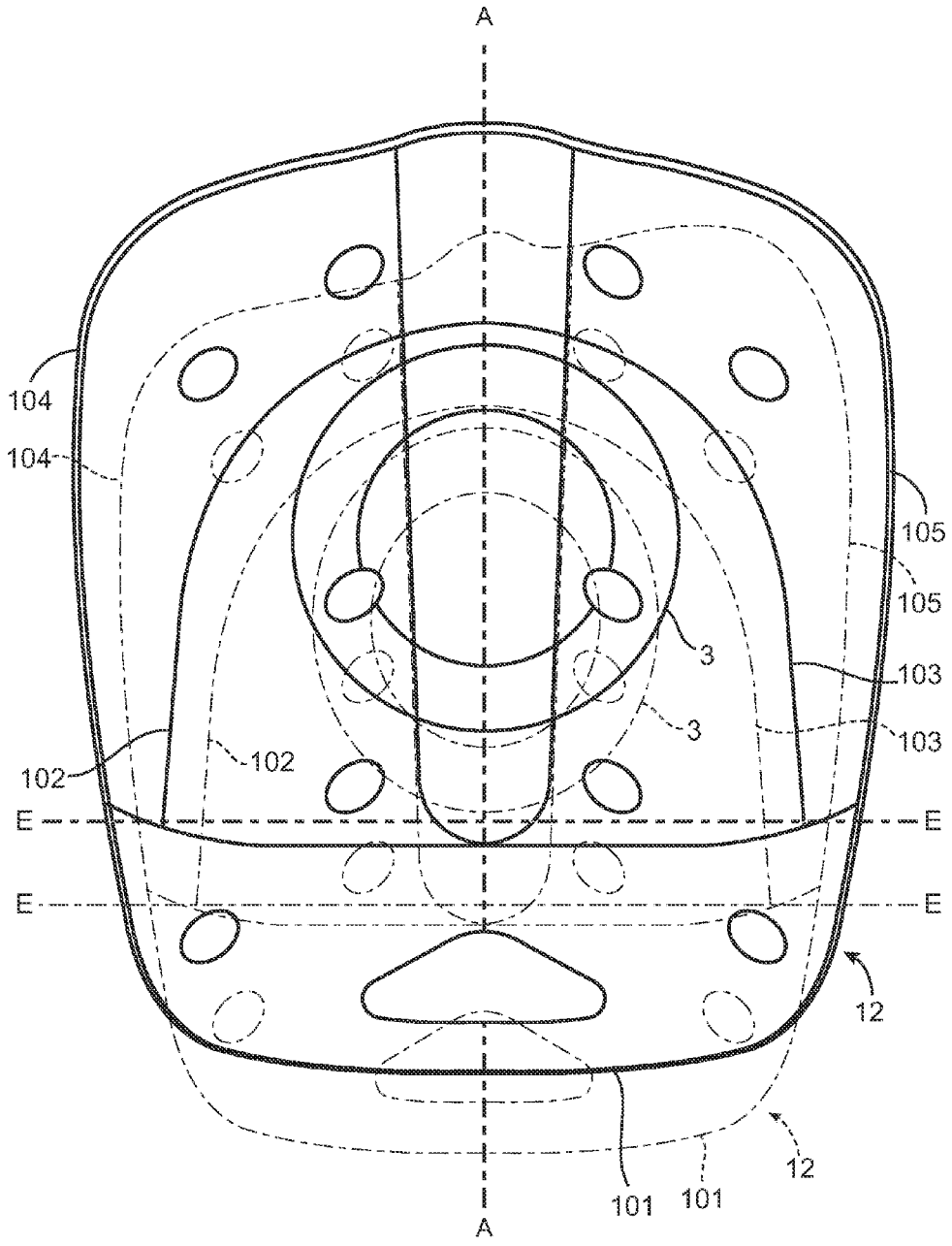
FIG. 3*e* is a view similar to FIG. 3*c*, but showing by use of dashed lines, the shifting that takes place at the time weight has been placed upon the foundation member, further torsion of the foundation member when a seated user twists to the left.

The relatively thinner regions of the foundation member 12 assist in concert with the rotation, cupping, cradling and torsioning on its longitudinal axis A-A along with the thicker regions in one plane and torsioning on its lateral axis E-E intersecting the longitudinal axis A-A (FIGS. 3*d*, 3*e*). The lateral axis E-E is proximate the area where the front section 101 meets the bowl portion sections 102-105. The thinner region in section 101 proximate lateral axis E-E allow torsioning in that area. The axis A-A and axis E-E are collectively referred to as axes of the foundation member 12 (and device 100), herein. The thicker regions in the concave channel 110 and central pelvic landing zone 3 keep the concave channel 110 and central pelvic landing zone 3 from distorting under the pressure from user's lower pelvic region, wherein said rotation, cupping, cradling and torsioning on the axes of the foundation member is not impeded.

The regions surrounding the central pelvic landing zone 3 and the concave channel 110 in sections 102 and 103, are relatively thinner, moving toward the outside edges. Then the foundation member is thicker again sections 104, 105, providing the tension members/regions that provide improved forward rotation and the upward cupping by the device 100.

FIG. 10*c* shows a rear view of a weight bearing position of the device 100, with an anatomical illustration, wherein arrows indicate the cupping and cradling of the gluteus muscles that place inward pressure on the lower wings of the pelvis ischial tuberosities, by the bowl portion 20. FIG. 10D shows a rear view of the weight bearing position of the device 100, on a soft supporting surface 40*a*, wherein the bowl portion 20 of the device 100 maintains the cupping and cradling of the gluteus muscles even when the user leans sideways.

Figure 11A:
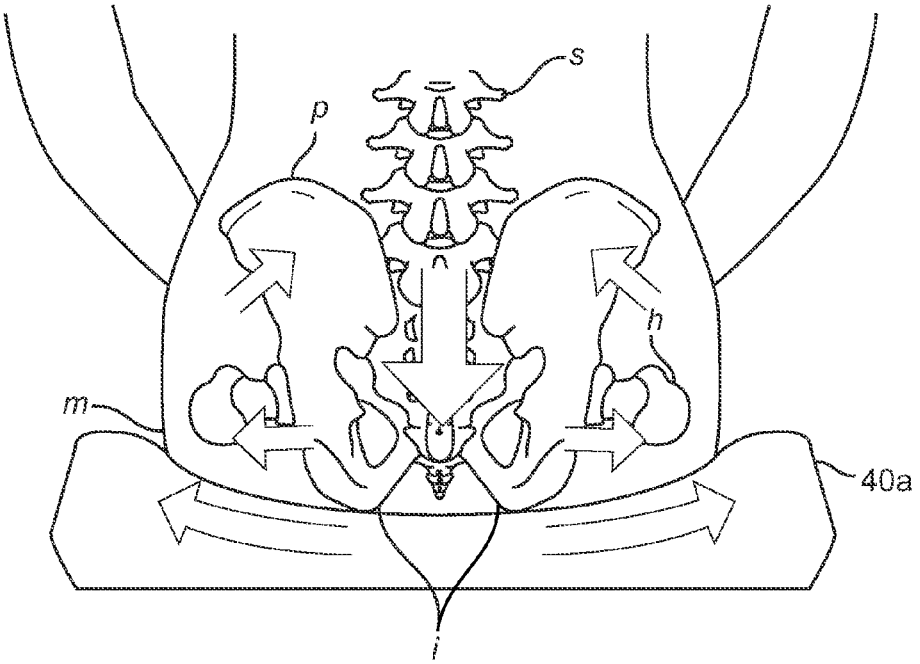
FIG. 11*a* shows a user seated on a seating surface without the seat apparatus of the invention, with the arrows indicating improper distribution of pressure and the outward movement of the lower pelvis in a sitting position of the wing like pelvis, according to an embodiment of the invention.
Figure 11B:
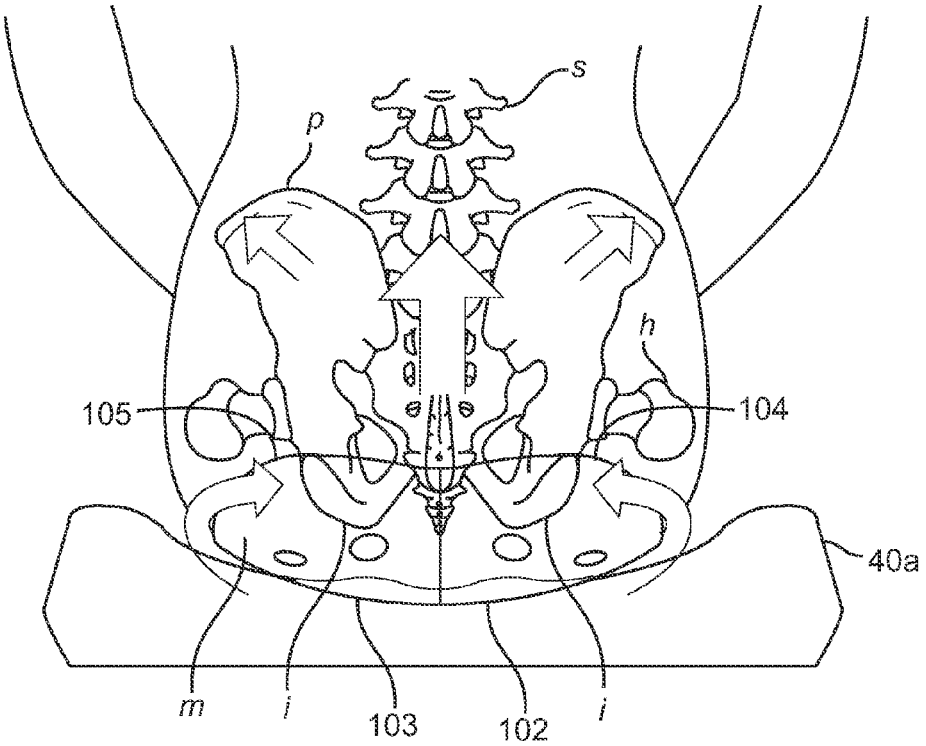
FIG. 11*b* shows another of the weight bearing seating apparatus of FIG. 10*c* with a user seated thereon, arrows indicating proper distribution of pressure cupping and cradling of the rear and side sections of the weight bearing seating apparatus and the inward movement of the lower pelvis in a sitting position of the wing like pelvis, according to an embodiment of the invention.

FIG. 11*a* shows a user seated on a seating surface without the seat apparatus of the invention, with the arrows indicating improper distribution of pressure. FIG. 11*b* shows a review of the device 100 in weight bearing position, with a user seated thereon, with arrows indicating proper distribution of pressure cupping and cradling of sections 1020-105 of the device 100.

Further, the device 100 torsions on its axes under twisting of the user weight in the bowl portion 20. The forward rotation of the device 100 tilts the user's pelvis into a forward lordosis, cupping, cradling effect regardless of how the user's upper or lower body twists or moves while the user remains seated on the device 100 (described further below).

Figure 19:
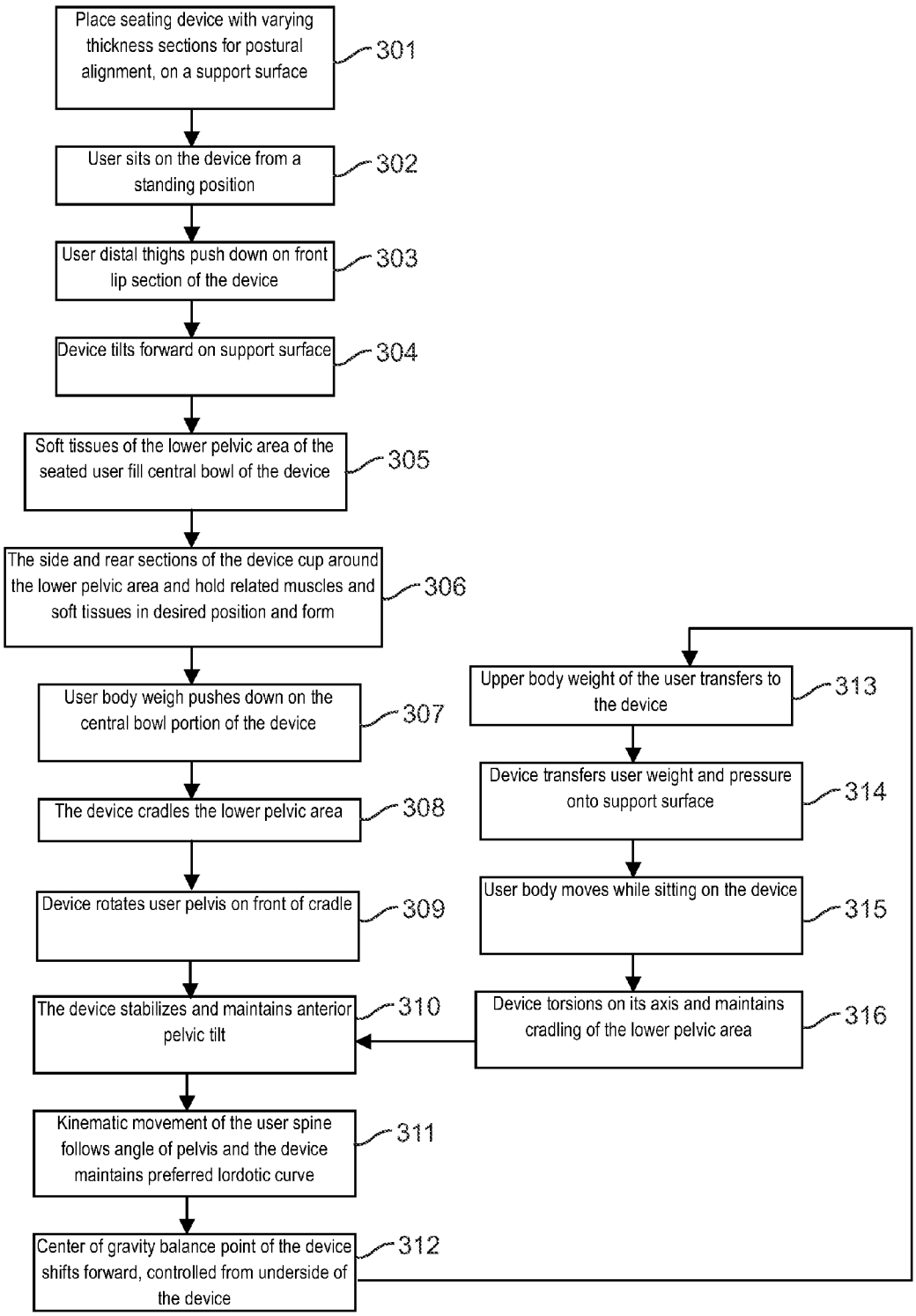
FIG. 19 shows a flowchart of a process for posture alignment, according to an embodiment of the invention.

The sections 101-105 of the device 100 with their varying thickness regions provide the cupping and cradling of a seated user into a wide range of the human the population. The device 100 in conjunction with a user sitting in the bowl portion 20, tilts, cups, cradles and torsions on its axes for continually applying dynamic support to stabilize the pelvis of a user, holding the pelvis in a correct Lordotic curve through a wide range of motion of a sitting human, and holding the user in a constant, perpetuating system. This is described further in relation to the flowchart in FIG. 19 showing a flowchart of a process 300 for correcting posture and restricting gluteal spreading for a human user, according to an embodiment of the invention. In this embodiment the process utilizes said device 100.

Generally, the device 100 is useful for a human user (e.g., male, female) capable of standing and walking, and having typical gluteus muscles of the buttocks. The device 100 is placed on a support surface (i.e., sitting surface) may be of any desired choice capable of supporting the device 100 for sitting thereon (e.g., office chair, vehicle seat, fixed bench, reclining easy seat, reclining office chair, reclining aircraft seat).

Step 301: Place seating device 100 with varying thickness sections for correcting posture and restricting gluteal spreading, on a support surface. In one implementation, the device 100 is portable for carrying from seat to seat, for use in any sitting situation from home, car, plane and office. The portable device comprises said at least five sections 101-105. In another embodiment, an optional section 106 attachment forms a backrest, but is not integral. FIG. 4*b* shows an aerial top view of the foundation member 12 (similar to FIG. 4*a*) with an optional back section 106 including a thickness region 6D.

Step 302: User sits on the device 100 from a standing position, involving user changing their posture from a standing position to a seated position by sitting on the device 100.

Step 303: Distal thighs of the user first come in contact with the front lip like section 101 of the device 100, push down on the front section 101 of the device 100. The Distal thighs hold the section 101 down against the support surface below it. One or both thighs can hold down section 101, wherein the device 100 will stay pressed down by the distal thighs. As portions 102, 103, 104 and 1055 are filled with the buttocks of the user, the device 100 becomes filled to overflowing with gluteus muscles and soft tissues until finally the sitting bones of the pelvis are above the center of sections 102 and 103 (FIGS. 8*b*, 9).

Step 304: The device 100 tilts forward (FIG. 8*b*), providing a lift tilting effect. Lift tilting is the effect of achieving an upright posture by stabilizing the sacral pelvic area of the back to sustain a forward pelvic tilt. Conventionally, achieving an upright posture is achieved by the action of the backrest of a chair using a lumbar support that pushes against the sacrum and the iliac crest of the pelvis. Further, the user must sit up against the back rest or lumbar support for achieving an upright posture. However, such conventional backrest and lumbar support does not provide a lift tilting effect according to the invention.

According to an embodiment of the invention, the device 100 provides a lift tilting effect as the device 100 rotates forward creating a typical incline angle θ of as high as about 17° (FIG. 8*b*). This incline lifts the entire pelvis upward and forward at the same time. Because the pelvis is being cupped in the central bowl portion 20 of the device 100, the incline is more than just an angle the pelvis is being rotated forward from its Ischia and sacrum. The lifting tilt of the device 100 causes the ischial tuberosities to slide forward until they are stopped by an incline 111 (FIG. 8*c*) on the front edge of the bowl portion 20, stopping atop the center of gravity balance equilibrium point bp2 (FIG. 8*b*). The incline 111 of the bowl portion 20 impedes forward motion of ischial tuberosities in the pelvic area and causing user's lower pelvic area to pivot forward into a forward lordotic position in the second position of the bowl portion 20 on a center of gravity balance equilibrium point on the supporting surface, thereby maintaining ischial tuberosities atop said center of gravity balance equilibrium point in response to user motion while the lower pelvic area is in the bowl portion.

Figure 8C:
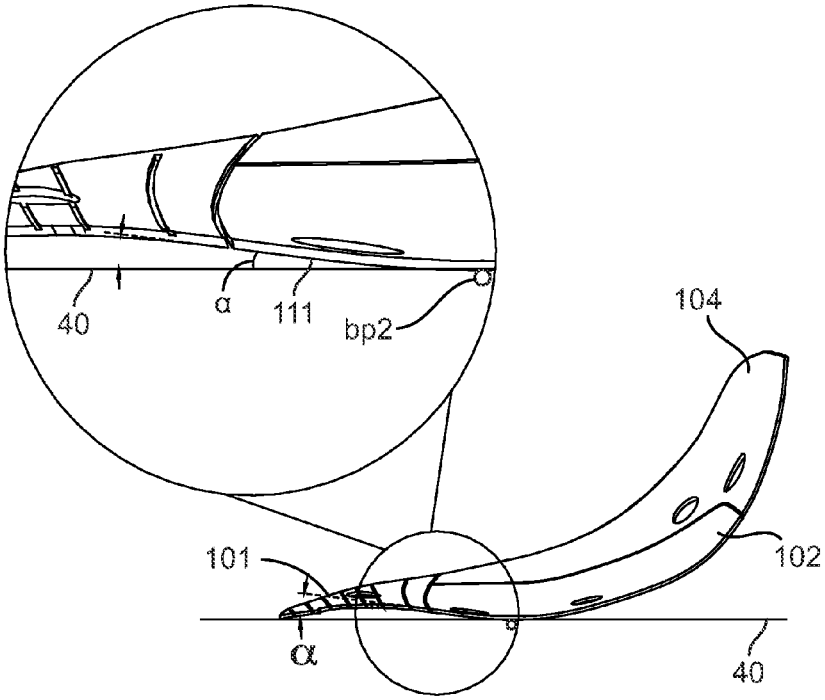
FIG. 8*c* shows a side view of the seating apparatus of FIG. 8*b* without mechanical robot anatomical skeleton, showing shifted center of gravity equilibrium point due to tilt/rotation of the seating apparatus in a weight bearing position, and a central section incline, according to an embodiment of the invention.
Figure 8D:
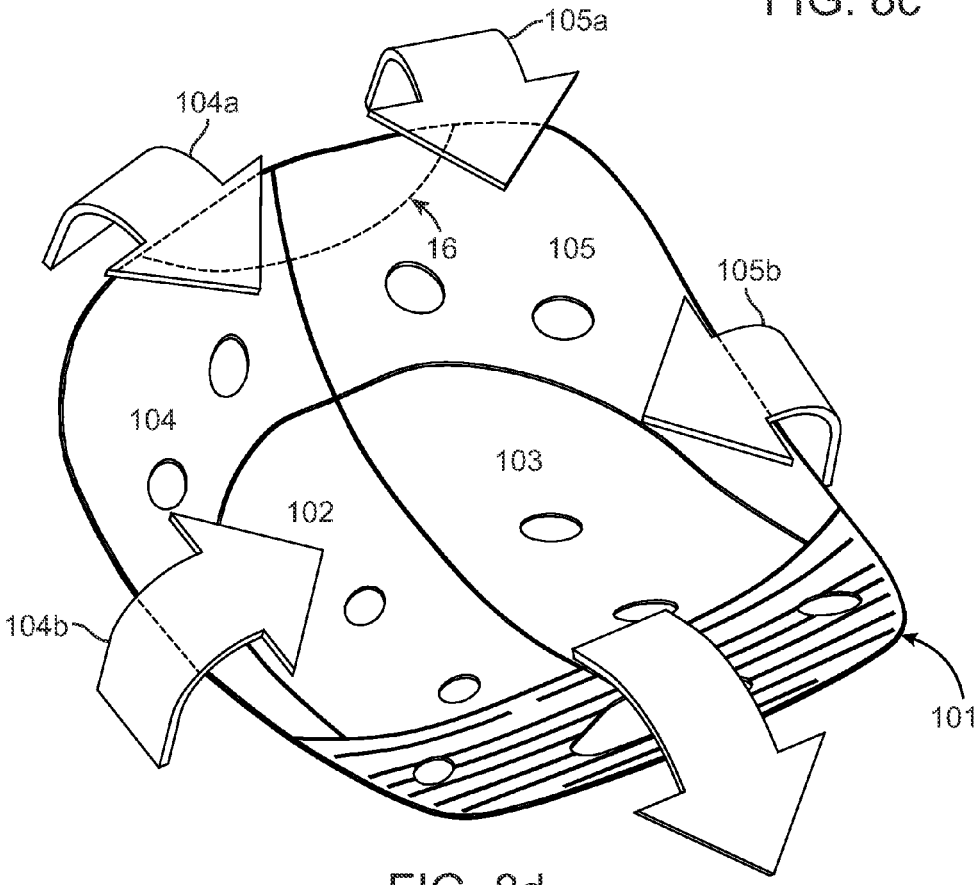
FIG. 8*d* shows a front perspective view of the seating apparatus of FIG. 1*a*, with arrows illustrating movement of the sections when the seating apparatus transitions from a non-weight bearing shape to a weight bearing shape, according to an embodiment of the invention.

FIG. 8*c* shows a side view of the foundation member 12 of FIG. 8*b* without mechanical robot anatomical skeleton, showing shifted center of gravity equilibrium point due to tilt/rotation of the foundation member 12 in a weight bearing position, and a central section incline. FIG. 8*c* also shows bending down of the front portion 101. Lift tilting by the device 100 does not require leaning up and against a backrest or against a lumbar support. Lift tilting by the device 100 occurs when the user sits thereon, wherein the device continues to actively adapt to the individual no matter how the body moves or twists or if the legs are uneven to the floor. The user's legs could be crossed and still the lifting tilt is provided by the device 100. The upper body can be leaning in any direction and lifting tilt is provided by the device 100. The device 100 provides lift tilting in a perpetuating process involving the user and the device 100, without requiring the user to sit in a specific way in a typical chair to be effective.

Step 305: As the user continues the sitting process into the central bowl portion 20, the device 100 is filled in with the lower pelvic region of the seated user (FIG. 9). This includes the ischial tuberosities of the lower pelvis and their connected gluteus and piriformis muscles, skin and in any clothing of the buttocks region. When the apparatus is filled any additional muscle and soft tissue will flow over the edges on to the seating surface.

Step 306: The side/rear sections 104 and 105 move inward and upward so as to cup around the lower pelvic region of the seated user and hold the muscles and soft tissues of the user in the desired position and form, wherein the gluteus muscles replace the usually used foam, flexible mesh, feathers or other cushion type padding on conventional sitting surfaces. The device 100 causes slacking of the gluteus muscles which become an active participant with the device 100 when the gluteus muscles and soft tissues are cupped from their perimeter by sections 104 and 105. The muscle tissues as manipulated by the device 100 only provide a pressure point reducing source.

The cupping effect of sections 104 and 105, and tilting of the pelvis into the tipped and upright position by the action of the concave channel 101 when the device 100 rotates forward (FIG. 8*b*), holds the gluteus muscles in slack form. The slack gluteus muscles dramatically reduce the tightening required in other muscles and ligaments used to hold the back erect when sitting.

Gluteus muscles and soft tissues are formed and held constant under and around the ischial tuberosities by the cupping of sections 104, 105. Where the Ischial tuberosities would normally press downward into a sitting surface, the weight bearing device 100 causes the ischial tuberosities to be held by the slack gluteus muscles on the bowl portion 20.

Step 307: As the user sits on the device 100, the user's body weight moves with gravity toward the support surface under the device 100 as the user's center of gravity changes from the standing position to the seated position (i.e., from over user feet and entire body, to being over the pelvis and distal thighs).

Step 308: Under user weight, the device 100 cradles the pelvic area. As the body weight pushes downward on the device 100, said cupping of sections 104, 105 around the base of the pelvis stabilizes and restricts the spreading of the lower pelvis, keeping it from spreading apart such that the six component bones of the pelvis can work fluidly as one unit. As such, building of pressure on the lumbar-sacral joint is restricted, thus minimizing wear and tear on the sacral joints. While being supported in the cradled position (FIG. 8*b*), the pelvis can articulate and move with the user movement while the user remains seated and move and twists.

Step 309: Pelvis rotates pivoting on front of Cradle. The cradle comprises the entire sections 102-105, once the bowl portion is in the second position and all the body weight and pelvic alignment has occurred (i.e., cupping effect). The cradling is maintained by sections 102-105, in a continual manner no matter how the sitter moves. In one embodiment, the front of the cradle comprises about a 3° to 7° incline area 111 in regions of the sections 102, 103, along with regions of the sections 104, 105, proximate the width of section 101. Action of gravity continues to pull the user body weight downward into central bowl portion 20 of the device 100, wherein the bottom of the pelvis is tipped on a pivot and rotated forward by the front edge of the cradle. The rotation is stopped by said upward incline 111 (FIG. 8*b*) of sections 102 and 103 where the meet section 101. In another embodiment, said incline 111 of sections 102 and 103 has an angle $\alpha$ of about 5° to 9°, preferably 7°, from a horizontal support surface in one example, which is sufficient to stop the forward movement of the ischia. When the ischia can no longer slide forward, the top of the pelvis pivots forward bringing about a chain like spine. The spine being a closed kinematic chain must follow the pelvic tilt. Although floating in a layer of cupped muscle tissue, the pelvic pivoting is maintained by the device 100 in response to the weight of the upper body. By using the energy created by gravity of the body weight, the device 100 provides a continual perpetuating process for correcting posture and restricting gluteal spreading that turns the upper body weight from a negative effect into a positive effect on the posture and gluteal spreading.

Step 310: The device 100 stabilizes pelvis and maintains anterior pelvic tilt. Rotation of the pelvis on the front of said cradle stops at a point of equilibrium balance point bp2. (FIGS. 8*b*, 12*a*, 12*b*). The tilting lift causes the ischial tuberosities to slide forward until they are stopped by the upward curve/incline 111 of the central bowl area sections 102 and 103. Said incline 111 of sections 102 and 103, stops the ischial tuberosities from their forward movement forcing the top of the pelvis to pitch forward. This pelvic forward rotation is maintained by the weight of the upper body. The center of gravity balance equilibrium point bp2 and the kinematic chain effect of the spine (properly aligned and balanced) are all maintained by the torsion of the device 100 on its axes.

When the spine is properly aligned and balanced, the thoracic region has a Kyphotic curve. The cervical and lumbar spine region has a Lordotic curve. Together these curves provide an "S" shaped preferred posture (FIGS. 1*d*, 16*a*, 16*b*, 16*c*) which the device 100 provides according to the invention. The present invention provides postural alignment using the natural equilibrium of the body without the seated user having to lean back against a backrest.

The device 100 interacts with the user's distal thighs to initiate a postural alignment process. Once the device is in its weight bearing (dynamic) position, the user's distal thighs remain horizontal or above horizontal, enabling the feet to remain flat on the ground throughout the postural range. Further, because the distal thighs push down the front lip section 101, the sections 104 and 105 cup and forward rotation of the device 100 by the angle θ (FIG. 8*b*), which lifts the pelvis, providing a preferred angle relationship. The preferred angle relation involves the knees being lower than the hip joint. This in turn transfers (distributes) a portion of the upper body weight away from initial tuberosities onto the distal thighs, sharing body weight pressure over a larger area.

Step 311: The spine is Lordotic and is controlled by the position of the pelvis. When the pelvis is rotated forward, the lumbar spine automatically creates a forward Lordotic curve. The inventor has found the unexpected result that use of the spine as a closed kinetic chain helps contribute to better posture and more comfort while sitting.

In the weight bearing position, the cupping and rotating effect of the device 100 move the pelvis into a forward position that influences the spine (FIG. 2*a*), wherein the spine follows the pelvis until it cannot fall any more forward wherein the front of the user anatomy (ribs, diaphragm, etc.) stops the spine from continuing to fall or fold. At that point, the spine is in a balanced position of "Neutral Posture" that requires the least amount of strain to hold it erect. The device 100 causes a cradled pelvis to induce the preferred "S" shape posture in a balanced postural equilibrium bp2, natural alignment throughout the full range of postures.

Step 312: In the weight bearing position, the center of gravity balance point of the device 100 shifts forward from bp1 to bp2 (FIGS. 8*b*, 12*a*, 12*b*). The balance (pivot) point is located just underneath the center of gravity point bp2 on the bottom side of the apparatus. In this position of the device 100, the pelvis is held in an upright neutral posture and balanced position. Upper body weight is shifted into a ring-like pelvis. Because a unique Lordotic curve has been achieved, the center of gravity shifts forward away from the sacrum and onto the tips of the ischial tuberosities. Once the center of gravity balance point is achieved the natural equilibrium of the user's spine and pelvis can be achieved and maintained. The inventor has determined that this natural equilibrium for each user is unique and is initiated by the device 100 by controlling the pelvis which in turn controls the chain-like lumbar spine thoracic spine and cervical spine.

Figures 13A, 13B:
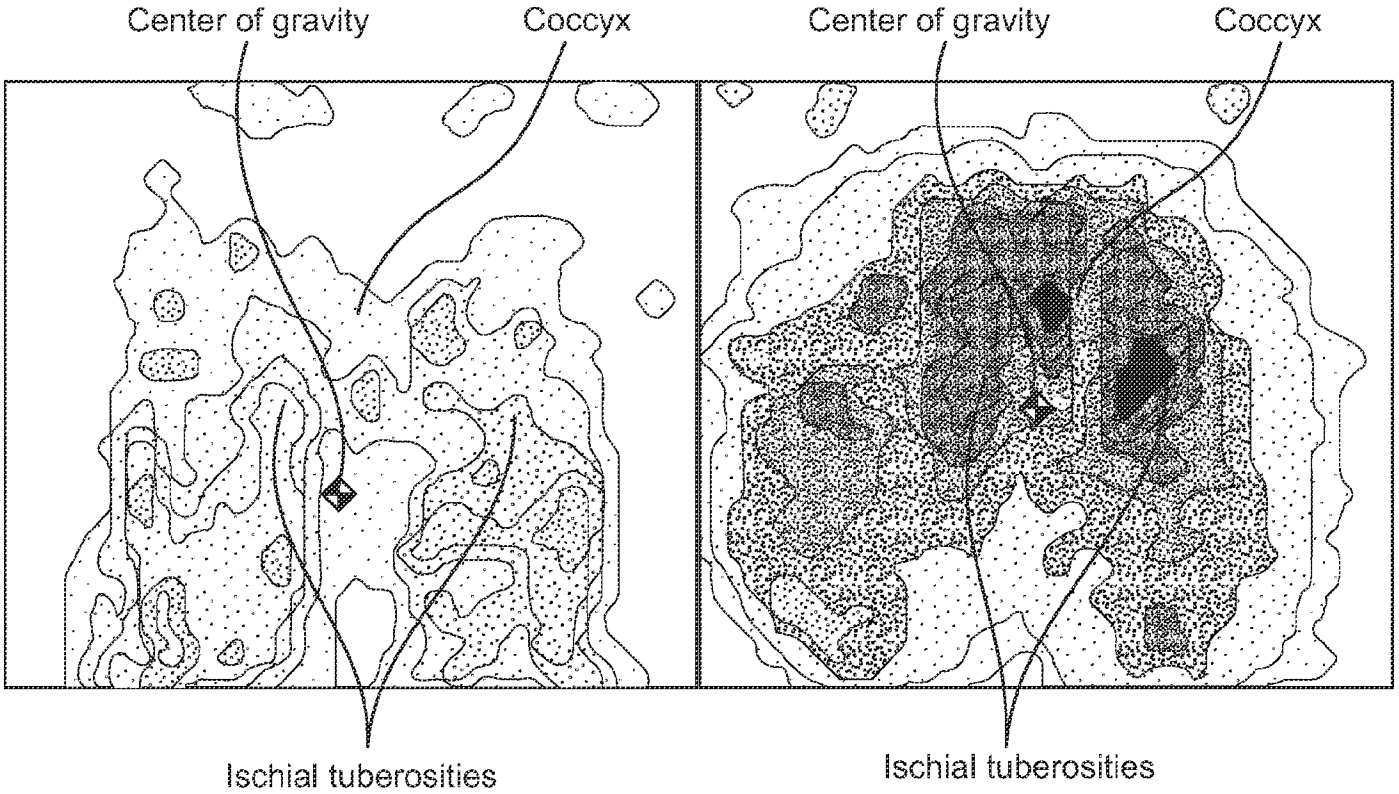
FIG. 13*a* illustrates a bottom view of an actual pressure map on a user seated on an embodiment the seating apparatus according to the invention, showing a center of gravity indicator.
FIG. 13*b* illustrates a bottom view of actual pressure map on a user seated on a conventional ergonomic seat, showing a center of gravity indicator.
Figure 14A:
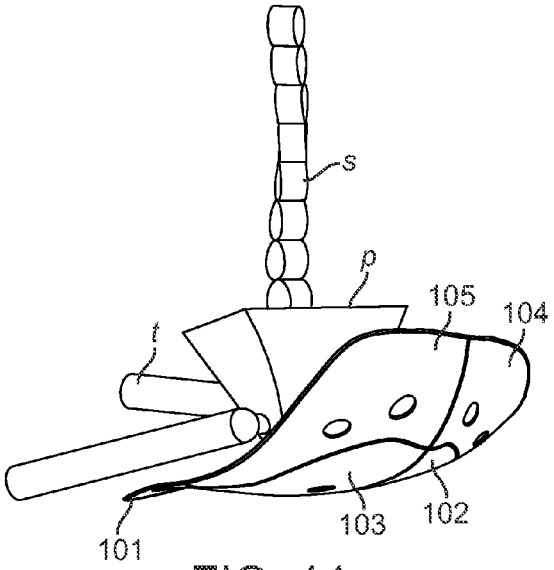
FIGS. 14*a* through 14*i* show different perspective views of the apparatus of FIG. 1*a* in weight bearing positions under weight of a seated user, indicated by a mechanical robot anatomical skeleton representation, illustrating the effect of a twisting of spine and various load positions due to movement of the seated user in the course of natural sitting over a period of time, according to an embodiment of the invention.
Figure 14B:
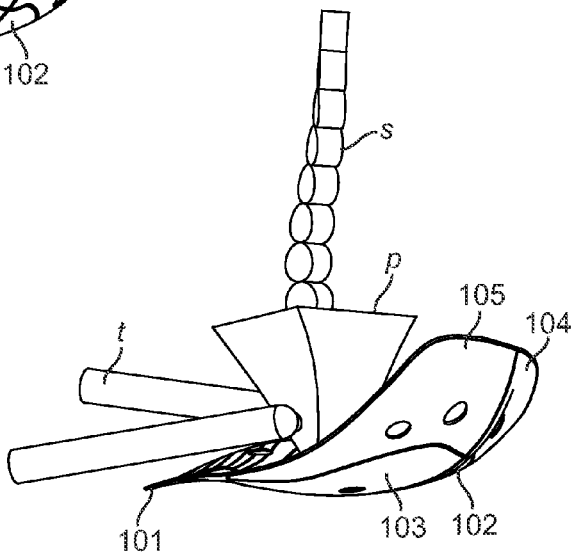
Figure 14C:
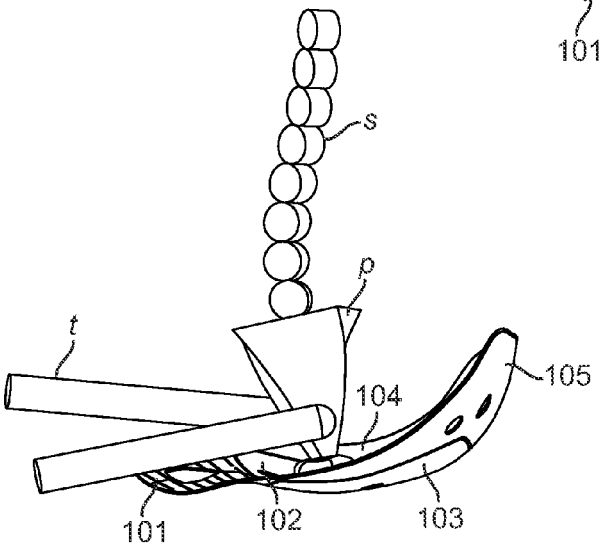
Figure 14D:
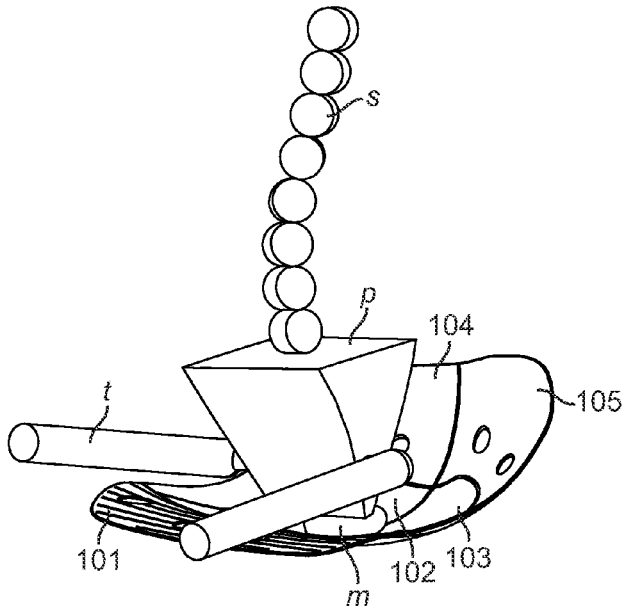
Figure 14E:
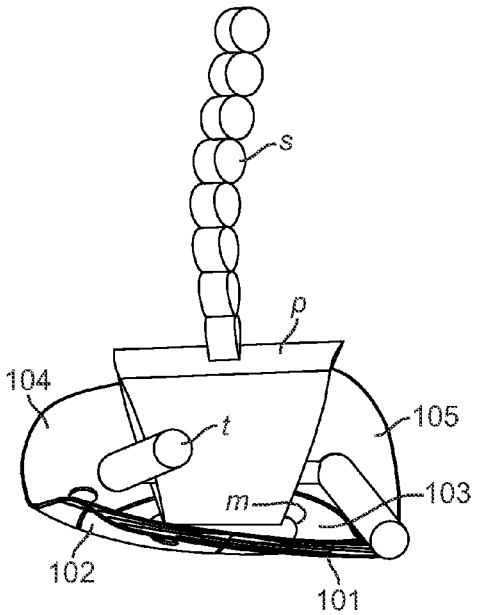
Figure 14F:
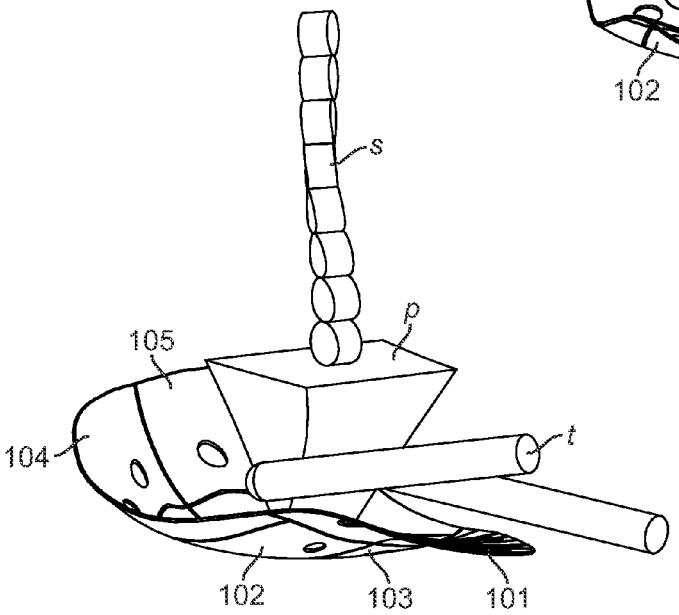
Figure 14G:
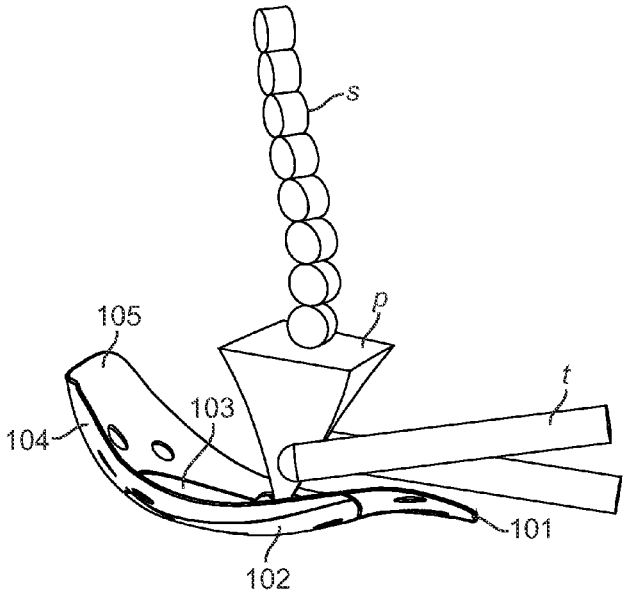
Figure 14H:
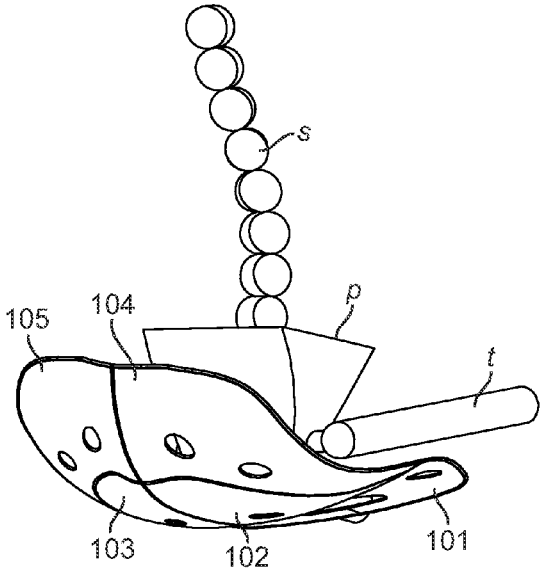
Figure 14I:
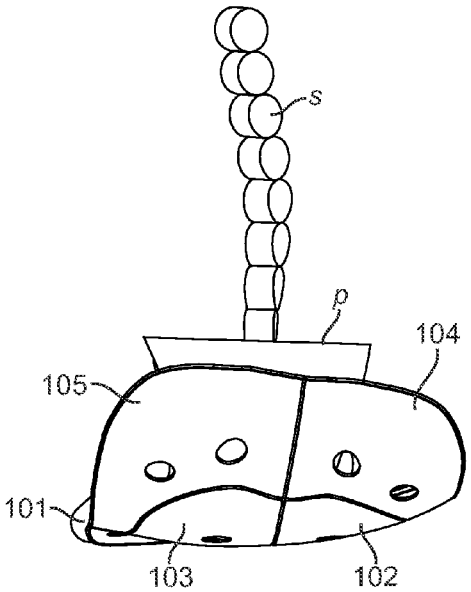

FIG. 13*b* illustrates a bottom view of actual pressure map of a user seated on a conventional seat such as a chair, indicating multiple high-pressure marks from the ischial tuberosities while in an upright position. Darker regions indicate higher-pressure marks. FIG. 13*a* illustrates a bottom view of an actual pressure map on a user seated on an embodiment of the device 100, wherein FIG. 13*a* indicating far fewer high-pressure marks from the ischial tuberosities than in FIG. 13*a*, while in an upright position when the weight bearing device 100 tilts/rotates forward, and cups and cradles the pelvis area, while floating the pelvis in muscle tissue. Further, FIG. 13*a* shows the center of gravity of the user, indicated by a checkered diamond shape, shifting forward (toward the bottom of the drawing sheet) using the device 100 compared to a conventional seat.

Step 313: The upper body weight transfers to the device 100 to become an exoskeleton shell. Specifically, with the pelvis cradled and held in the center of gravity balance equilibrium point posture (FIG. 2*a*, 8*b*) by the weight bearing device 100, the upper body weight moves down through the pelvis, then through the soft tissues of the gluteus and distributes essentially evenly into the sections 101-105 of the device 100. Because the soft tissues and muscles of the gluteus fill the central bowl portion 20 of the device 100 (FIG. 9) and sections 104, 105 cup upward (FIGS. 8*b*, 8*c*), the device 100 becomes an exoskeleton shell for said muscles and soft tissues around the ischial tuberosities.

Step 314: The device 100 transfers weight and pressure into the supporting surface under the device 100. Specifically, functioning as an active orthotic area of the supporting surface (e.g., seat pan), the device 100 distributes the weight and pressure from the user weight onto the supporting surface. The supporting surface now carries the greatest pressures, not the surface of the seated user skin. The function of transferring upper body weight and pressure into supporting surface by the weight bearing device 100 provides the exoskeleton attributes. Once the gluteus soft tissues have been cupped by sections 104 and 105, the pelvis is cradled by the sections 104 and 105, and rotated forward for stabilization on the center of gravity point bp2 (FIG. 8*a*-1) as described. Upon such stabilization, essentially all body weight of the sitting user is transferred from the bones through the soft tissues and into the weight bearing device 100. The central bowl portion of the device 100 distributes that weight evenly onto the supporting surface 40. When the seated user body moves, the device 100 maintains user weight distribution through said exoskeleton shell effect.

Step 315: As the seated user body moves (e.g., such as twisting while working on a desk top), the device 100 adapts to changed body position of the user.

Step 316: As the seated user moves, the device 100 torsions on its axes (FIGS. 2*c*, 2*d*, 12*e*, 12*g*) to maintain its cradling position. The device 100 continually applies support by torsion on its axes, maintaining constant dynamic pelvic support. The device 100 essentially constantly adjusts and maintains several simultaneous mechanical functions of tilting/rotating forward, cupping and cradling the pelvis area, while floating the pelvis in muscle tissue.

Figure 12D:
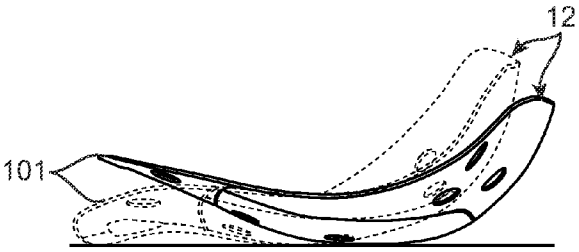
FIGS. 12*d* and 12*e* show corresponding side and back views, respectively, of the seating apparatus of FIG. 1*a*, with superimposition of weight bearing position of the seating apparatus in solid lines, and weight bearing position of the seating apparatus in dashed lines with torsion on its longitudinal axis and a lateral axis due to rotation of the upper body of a seated user to the right, according to an embodiment of the invention.
Figure 12E:
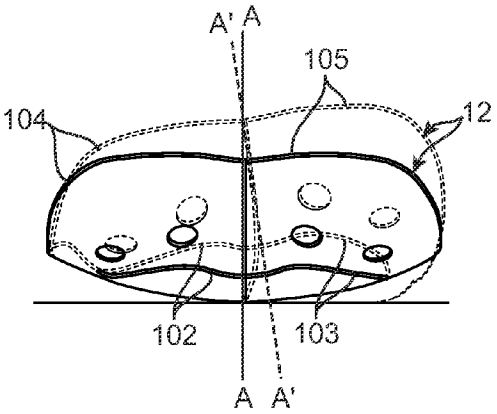
Figure 12F:
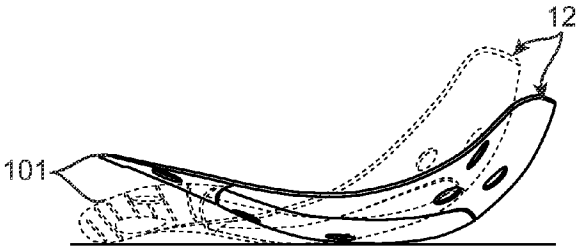
FIGS. 12*f* and 12*g* show corresponding side and back views, respectively, of the seating apparatus of FIG. 1*a*, with superimposition of weight bearing position of the seating apparatus in solid lines, and weight bearing position of the seating apparatus in dashed lines with torsion on its longitudinal axis and a lateral axis due to rotation of the upper body of a seated user to the right, according to an embodiment of the invention.
Figure 12G:
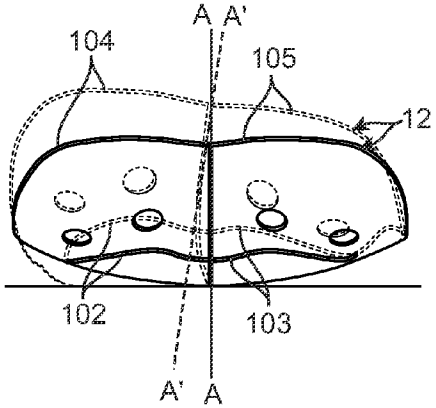
Figure 16A:
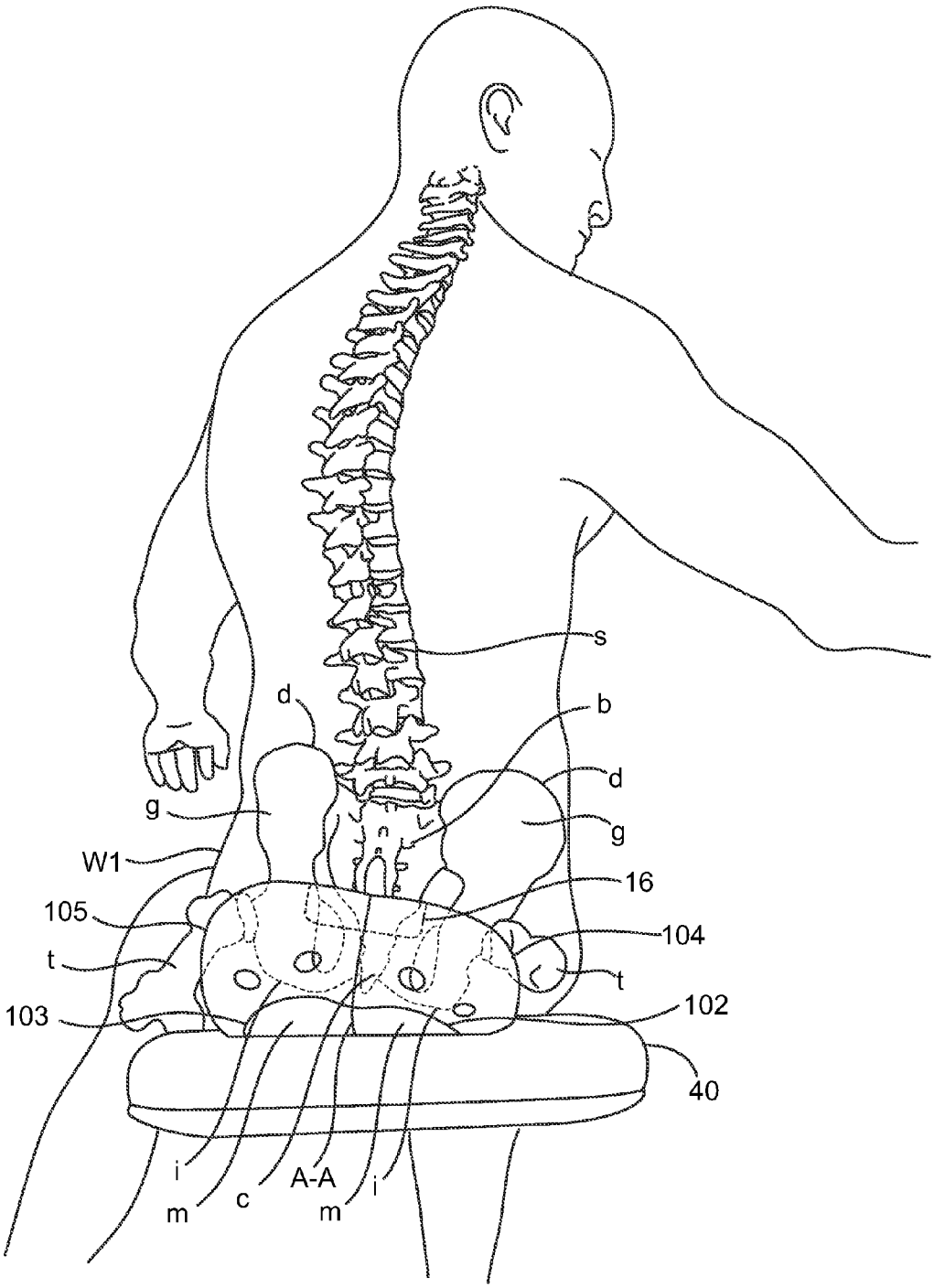
FIGS. 16*a*-16*c* show a user seated on a seating apparatus in FIG. 1*a* from different perspectives, with the upper body of the user twisted to one side, illustrating how the seating apparatus torsions and aligns the pelvis into a lordotic posture while the body moves and twists, according to an embodiment of the invention.
Figure 16B:
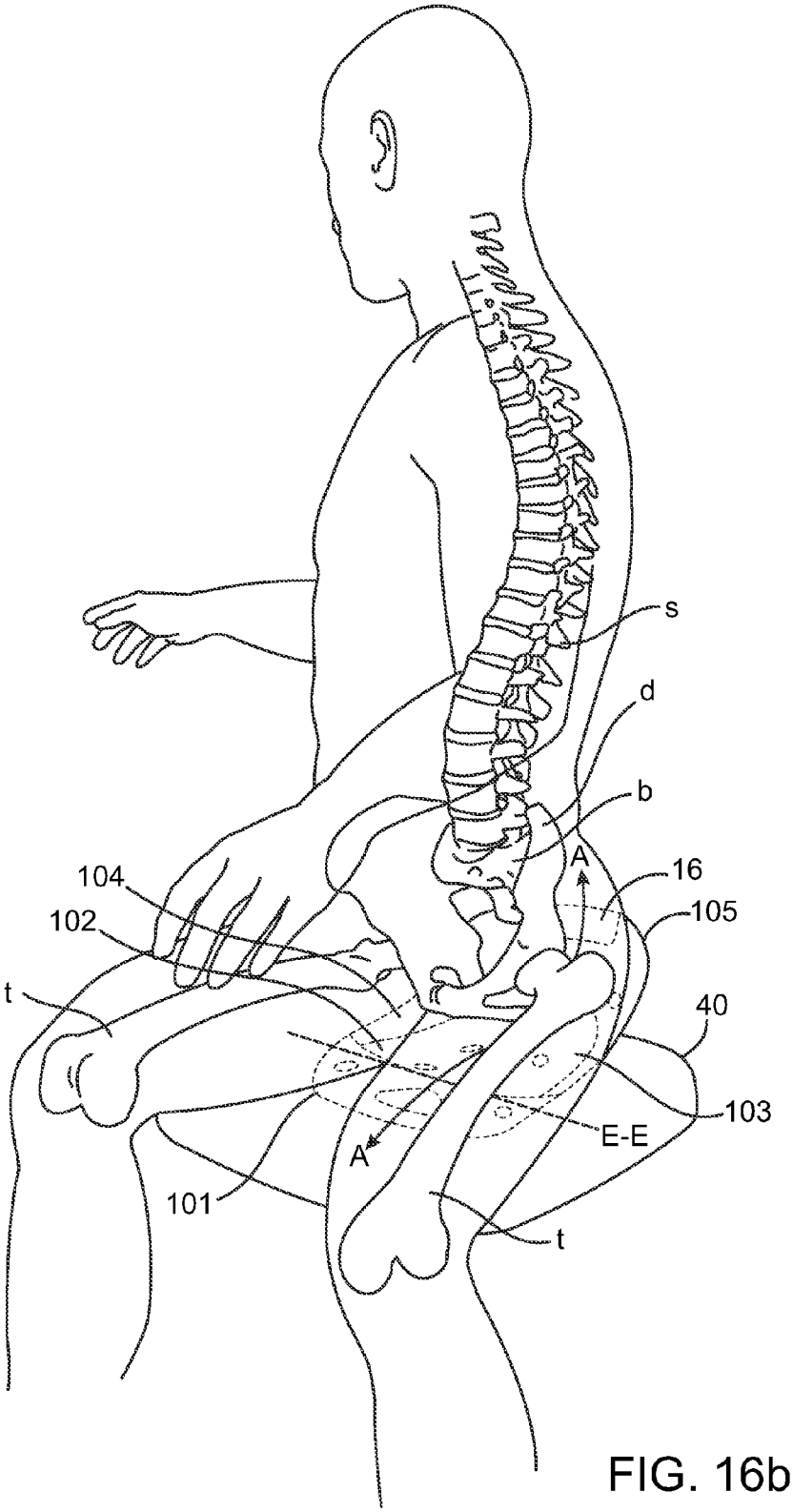
Figure 16C:
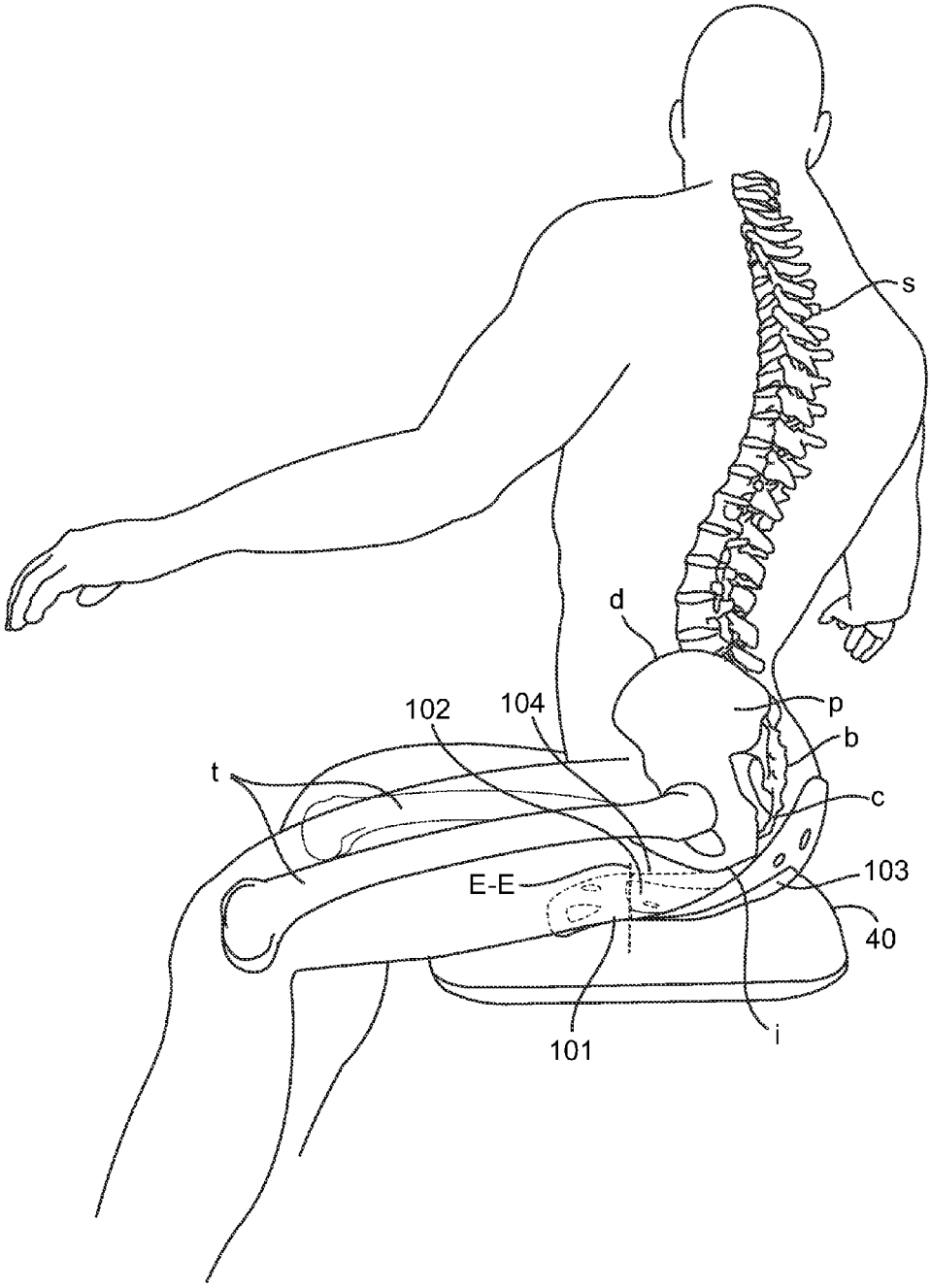

FIG. 3*d* is similar to FIG. 3*c*, and shows by use of dashed lines, the shifting that takes place at the time weight has been placed upon the foundation member 12, and downward tilting of the front, lip-like portion section 101, and further torsion of the foundation member on its axes when a seated user twists to the right (e.g., FIGS. 16*a*-16*c*). The sections 104, 105 dynamically move forward following the pelvis sacrum to maintain pressure therein. FIGS. 12*f* and 12*g* show corresponding side and back views, respectively, of the seating apparatus of FIG. 3*d* torsioning along its axes, with superimposition of the weight bearing position of the device 100 in solid lines, and torsioning of the weight bearing position of the device 100 in dashed lines due to rotation of the upper body of a seated user to the right.

FIG. 3*e* is also similar to FIG. 3*c*, and shows by use of dashed lines, the shifting that takes place at the time weight has been placed upon the foundation member 12, and downward tilting of the front, lip-like portion section 101, and further torsion of the foundation member on its axes when a seated user twists to the left. FIGS. 12*d* and 12*e* show corresponding side and back views, respectively, of the seating apparatus of FIG. 3*e*, with superimposition of the weight bearing position of the device 100 in solid lines, and torsioning of the weight bearing position of the device 100 in dashed lines due to rotation of the upper body of a seated user to the left.

The device 100 continually applies support by torsion on its axes along the length of the concave channel 110. Regardless of the type of the upper body twisting and motion of the user, the device 100 responds to the user body position by torsion on its axes to apply dynamic support in stabilizing and holding the pelvis in proper lordotic curve. Regardless of the lean of the pelvis as the seated user moves/twists, the device 100 torsions in response to adjust on its axes to maintain the dynamic support in stabilizing the pelvis. FIGS. 2*c*, 2*d*, show how the lower body twists and the upper body spine twists and how the torsion along its axes reacts to the twisting movement of the user.

FIG. 14*a* through FIG. 14*i* show different perspective views of the device 100 in weight bearing positions under weight of a seated user, indicated by a mechanical robot anatomical skeleton representation, illustrating the effect of a twisting of spine and various load positions due to movement of the seated user in the course of natural sitting over a period of time.

With the user's lower pelvic area disposed in the bowl portion, twisting movement of the user while sitting causes torsion of the foundation member 12 along its axes which causes torsioning of the rear segment 16 of the bowl portion 20 such that said upward and inward motion of the upper edges of the segments 104, 105 of the bowl portion 20 follows twisting of the user's lower pelvic area. As shown in FIGS. 16*a*-16*c*, the segments 104 and 105 continue applying an upwardly and inwardly compressive force to cause a forward rotational tilting of the user's lower pelvic area into a lordotic position, while maintaining the bowl portion in said second position.

The process steps 310-316 are repeated as long as the user remains seated on the device 100 and moves/twists, providing a perpetuating system. When the user body moves or shifts, the cradling effect is adjusted as the device 100 torsions on its axes in response to the user motion. Essentially, the cradling effect of the device 100 "resets" as the seated user naturally moves, maintaining the seated user in a constant, perpetuating correct posture and restricting gluteal spreading. Because a proper Lordotic curve specific to the seated user is achieved by the device 100, the user center of gravity shifts forward away from the sacrum and onto the tips of the ischial tuberosities. Once the center of gravity balance point is achieved, the user's natural equilibrium is achieved and maintained. Achieving this natural equilibrium for each user utilizing the device 100 is unique, and results in the device 100 controlling the pelvis which in turn controls the chain-like lumbar spine, thoracic spine, and cervical spine. Action of said sections 101-105 according to the process 300 may be implemented by other materials or structures that will respond and adapt to the user shape.

The device 100 functions as an exoskeleton shell in the weight-bearing position by providing said cupping, cradling, and orthotic floating. Because muscle tissue is 70% water and fat tissue is 35% water, the skin acts much like a latex balloon filled with water. The bowl portion 20 allows the muscles of the user's lower pelvic area to distribute pressure from the user's weight evenly into the bowl portion 20. When disposed in the bowl portion 20, the muscles of the user's lower pelvic area fill the bowl portion and the ischial tuberosities push the muscle and soft tissues of the user's lower pelvic area into bowl portion 20. As the muscle and soft tissues of the user's lower pelvic area fill the bowl portion 20 of the device 100 and the ischial tuberosities are suspended in the muscle tissue, the user's upper body weight is transferred through muscle tissues and into the skin. The skin transfers the pressure into the device 100. Thus the device 100 becomes an exoskeleton shell. The exoskeleton shell is disposed on the supporting surface (40 or 40*a*), wherein the inner surface of the device 100 receives all the pressure of the upper body of the user, and transfers the pressures against the supporting surface. At the same time, suspended in the muscle tissue by the bowl portion of the device 100, the pelvis floats stabilized and cradled. The pelvis is able to articulate while being held in a forward lordosis by the device 100. Unlike conventional reclined tilting seats, the device 100 provides an upright posture without the negative side effects of increased pressure points under the ischial tuberosities.

In a preferred embodiment of the invention, the foundation member 12 is a one piece member molded from memory retentive material such a nylon plastic with varying thickness regions as shown by example in FIG. 4*a*. The depiction in FIG. 4*a* also shows the relative scale of the various regions in relation to one another, where the retentive material essentially gradually changes in thickness from one region to another. Each of the sections 101 through 105 shows a grouping of the regions of which it is made of as shown in FIG. 4*a*, wherein there is no physical separation between the sections 101-105.

Figure 6A:
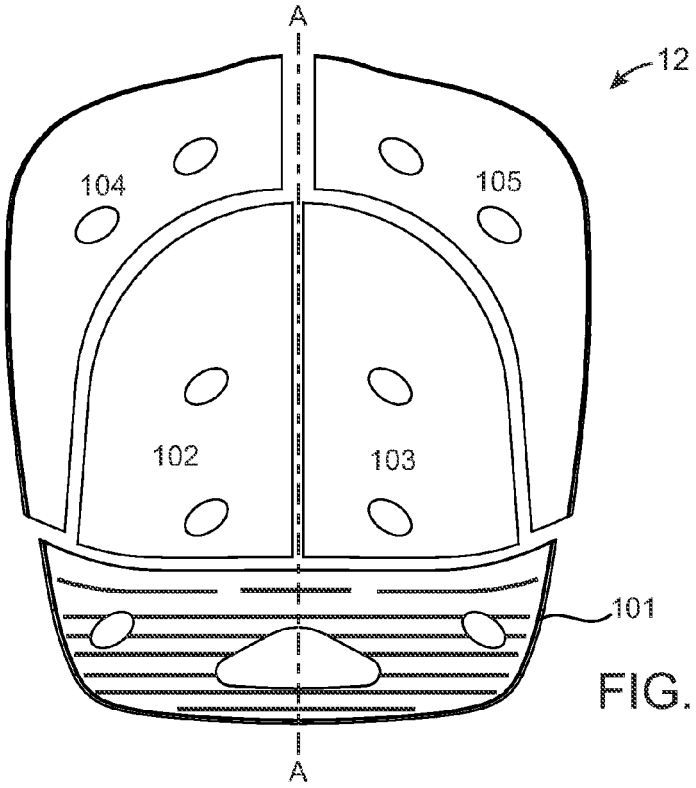
FIG. 6*a* shows an aerial top view of the seating apparatus, with multiple individual sections, according to an embodiment of the invention.
Figure 6B:
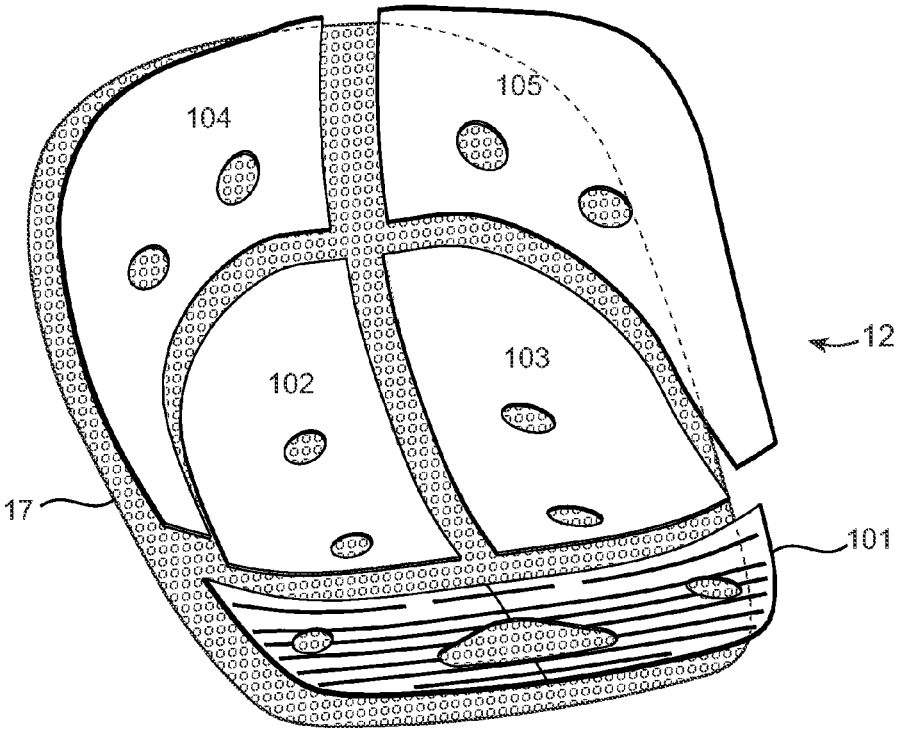
FIG. 6*b* shows a perspective view of the seating apparatus of FIG. 6*a*, with multiple sections shown exploded to illustrate a connection mechanism for the multiple sections, according to an embodiment of the invention.

In another embodiment of the invention (FIGS. 6*a*-6*p*), the sections 101-105 are individual sections and are connected together by a connecting mechanism such as membranes, cabling, hinges, linkages, etc. FIG. 6*a* shows an aerial top view of the sections 101-105 of the foundation member 12, and FIG. 6*b* illustrates a perspective view of the sections 101-105, revealing an example connection mechanism comprised of a membrane 17 to which the sections 101-105 are attached. The connection membrane 17 can be in the shape of a continuous membrane as shown, or multiple membrane sections corresponding to sections 101-106 for connecting the peripheries of the sections 101-105 together.

In another embodiment, the present invention provides an integrated system comprising said sections 101-105 (and optionally 106) of the device 100 in a seat (e.g., car seat, plane seat, office sect). Such an integrated system comprises a foundation that can be made from a wide variety of materials, including foams, plastics, air bladders, and other materials. The physical makeup of the component materials (e.g., with varying thickness ranges) according to the invention, allows the sections 101-106 (FIGS. 6*a*-6*p*) to induce physical change to a seated user gluteus form as described according to the process 300 herein. The sections 101-106 of the foundation member 12 work together according to the process 300. In addition to nylon, other materials such as biomechanical devices that react to computerized data and have behavioral ability according to the process 300 may be used for the sections 101-106. In the integrated system, the individual sections 101-106 can move apart, move in different angles, and/or partially slide over one another to decrease the size of the overall apparatus as shown by examples in FIGS. 6*c*-6*i*, and 6*j*-6*p*, further below. Action of said individual sections 101-105 according to the process 300 may be implemented by other materials which may have embedded intelligence and or information inherent in the materials themselves, that will respond and adapt to each user's unique requirements. The embedded intelligence and or information materials do not require computerization to adapt to the user according to the process 300. However, computerization using sensors, actuators, and controllers may be implemented (e.g., FIG. 6*m*).

Figure 6C:
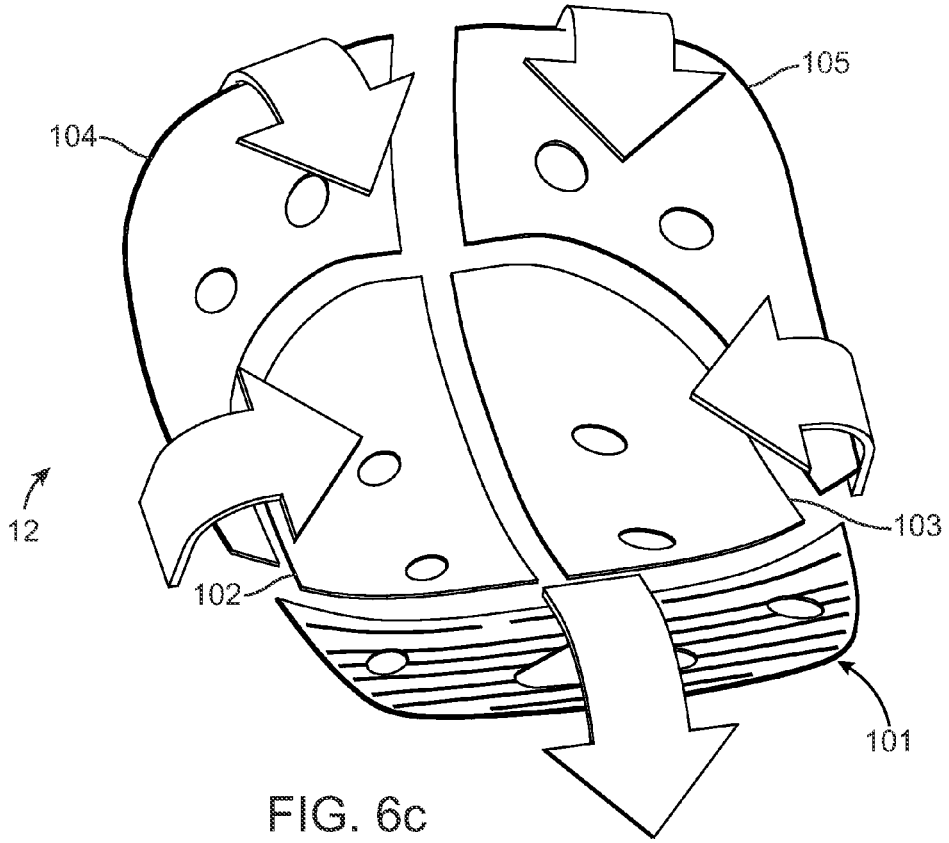
FIG. 6*c* shows a perspective view of an integrated seat pan configuration of a seating apparatus according to an embodiment of the invention, with arrows illustrating movement of the sections when the seating apparatus transitions from a non-weight bearing shape to a weight bearing shape.
Figure 6D:
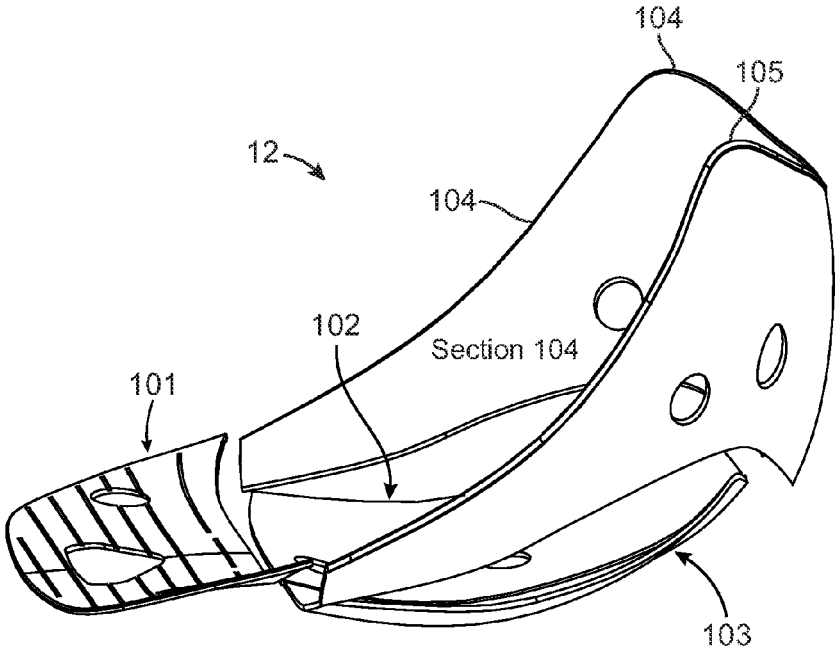
FIG. 6*d* shows a perspective view of the seating apparatus of FIG. 6*c*, when the seating apparatus transitions from a non-weight bearing shape to a weight bearing shape, according to an embodiment of the invention.

FIGS. 6*c*-6*i* represent example integrated seat pan configurations of individual sections 101-105 that can be used to optimize the movement of the sections 101-105 while built into a secondary seat pan, such an office seat, car seat, etc. The sections 101-105 are held in place by a backing (not shown) which may be braided together or have backing similar to the membrane 17 in FIG. 6*b*. FIG. 6*c* shows a perspective view of the sections 101-105 in integrated seat pan configuration, with arrows illustrating movement of the sections 101-105 in transition from a non-weight bearing shape to a weight bearing shape, described above. This articulation is for a larger configuration. FIG. 6*d* shows a slightly turned perspective view of the sections 101-105 in a secondary, weight bearing shape. This articulation is for an increased upward and inward configuration. The gaps between the sections are the result of the backing in the secondary seat pan stretching under user weight. In one example, a molded screen-like member backing for sections 101-105 allows greater flexibility between the sections 101-105.

Figure 6E:
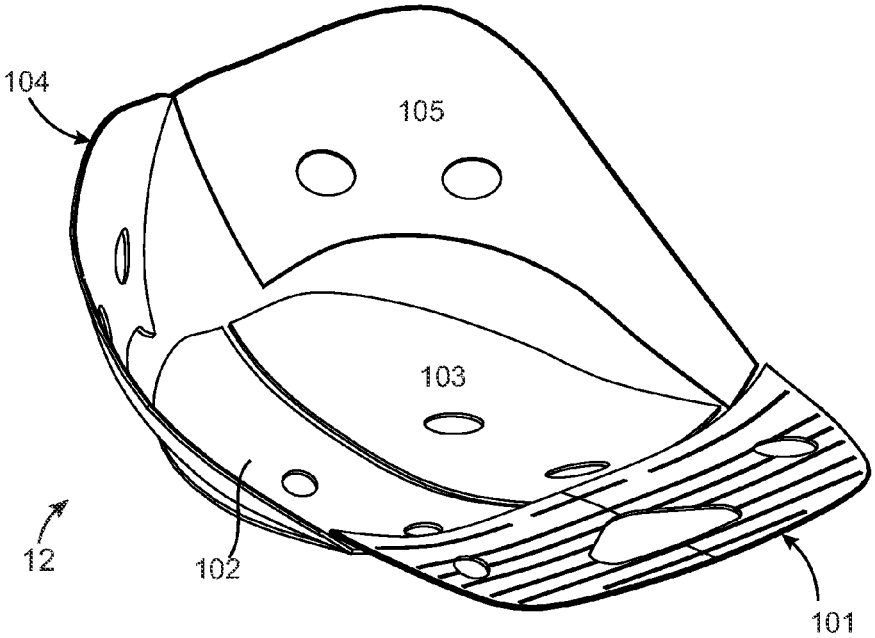
FIG. 6*e* shows a perspective view of the seating apparatus of FIG. 6*c*, with the seating apparatus having transitioned to a weight bearing shape, according to an embodiment of the invention.
Figure 6F:
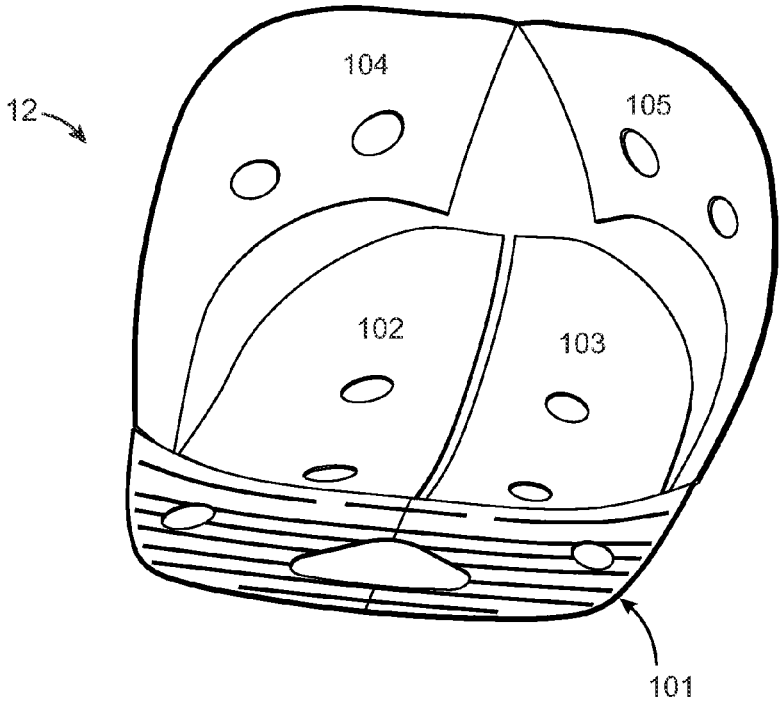
FIG. 6*f* shows a front perspective view of the seating apparatus of FIG. 6*e*, with the seating apparatus having transitioned to a weight bearing shape, according to an embodiment of the invention.
Figure 6G:
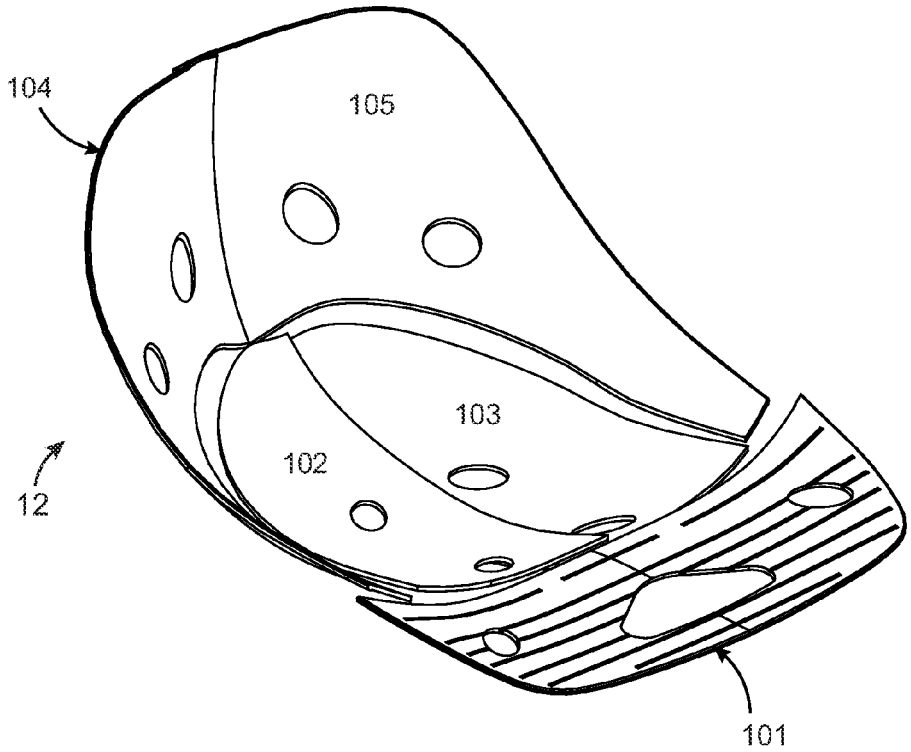
FIG. 6*g* shows a perspective view of the seating apparatus of FIG. 6*c*, with the seating apparatus in a non-weight bearing shape, indicating overlapping of side sections and overlapping of central sections, according to an embodiment of the invention.
Figure 6H:
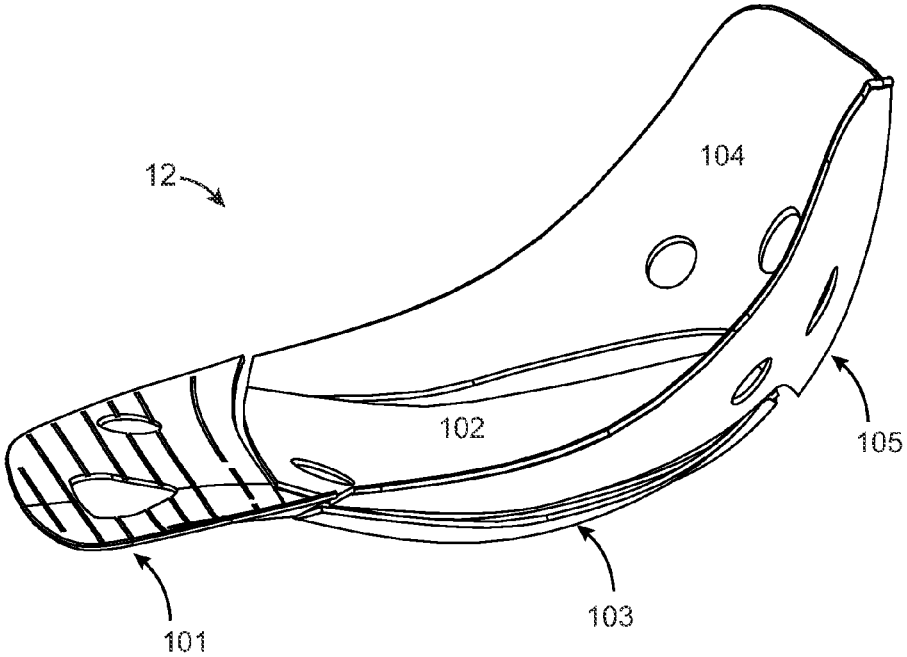
FIG. 6*h* shows a side perspective view of the seating apparatus of FIG. 6*g*, according to an embodiment of the invention.
Figure 6I:
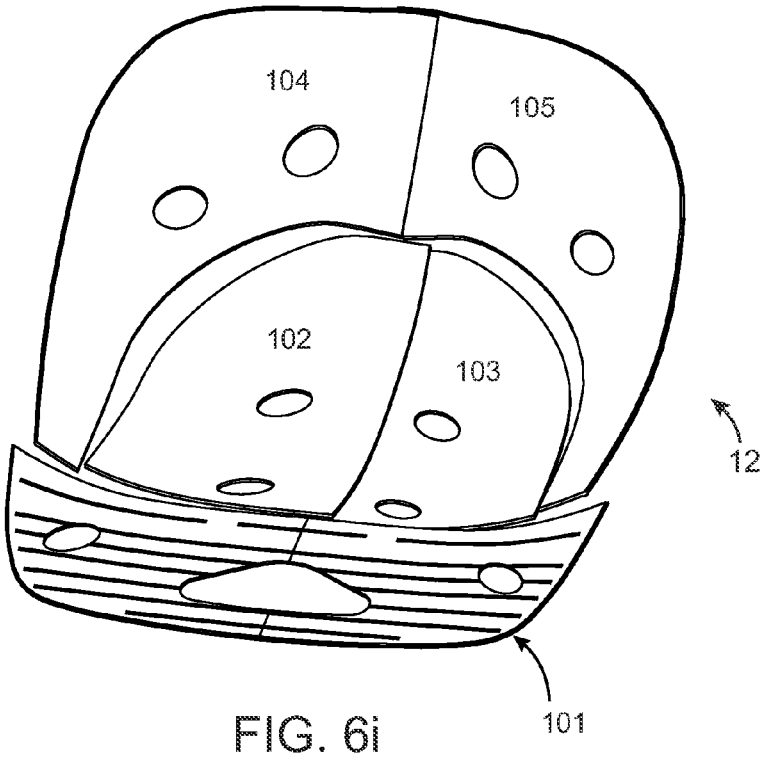
FIG. 6*i* shows a front perspective view of the seating apparatus of FIGS. 6*g* and 6*h*, according to an embodiment of the invention.

FIG. 6*e* shows another perspective view of the sections 101-105 in a weight bearing secondary shape. FIG. 6*f* shows a perspective view of the sections 101-105 having transitioned to a weight bearing (secondary) shape. FIG. 6*g* shows a perspective view of the sections 101-105 in a non-weight bearing shape, indicating overlapping of sections 104, 105 and overlapping of central sections 102, 103. This articulation adjustment is for a smaller configuration. FIG. 6*h* shows a slightly turned perspective view of the sections 101-105 in a non-weight bearing state. FIG. 6*i* shows a front perspective view of the sections 101-105, showing partially overlapping sections 101-105 in a non-weight bearing position. In the weight bearing position, the secondary shape is achieved by sections 101-105, and a fully forward lordosis of the pelvis and spine is achieved, according to an embodiment of the invention.

FIGS. 6*j*-6*p* show another example of the integrated seat pan configuration involving the individual sections 101-106, along with attachment points (indicated by cone shapes 19), wherein the attachment points illustrate where the sections 101-106 may be attached to a support environment for manipulating the sections of the seating apparatus, according to an embodiment of the invention.

Figure 6J:
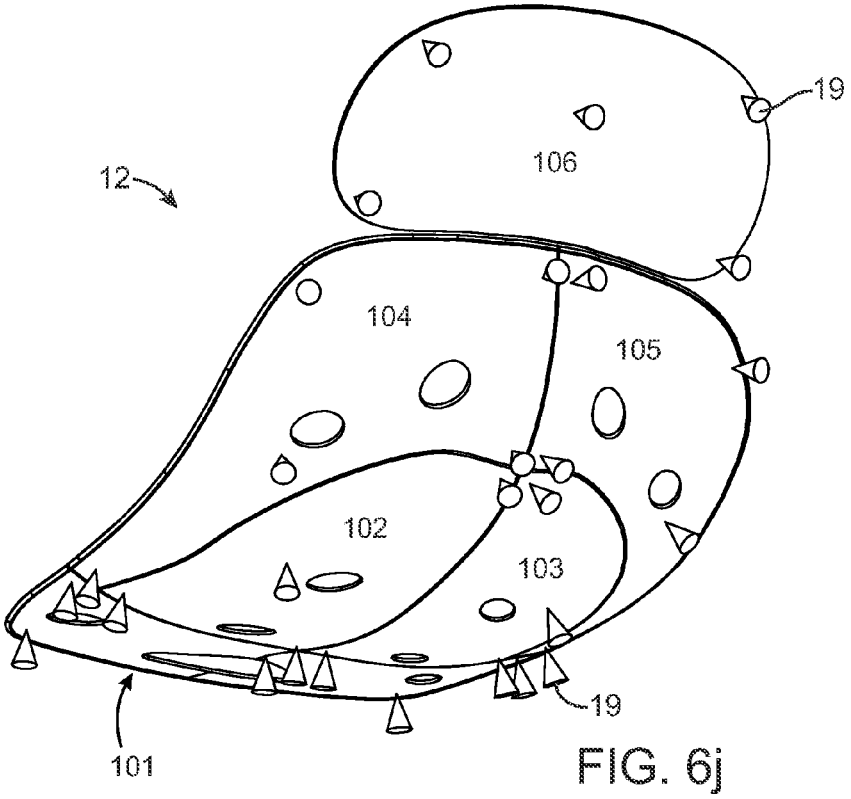
FIG. 6*j* shows a bottom perspective view of another integrated seat pan configuration of a seating apparatus according to an embodiment of the invention, with the seating apparatus in a non-weight bearing shape, with cone shapes point where the sections of the seating apparatus may be attached to a support environment for manipulating the sections of the seating apparatus, according to an embodiment of the invention.
Figure 6K:
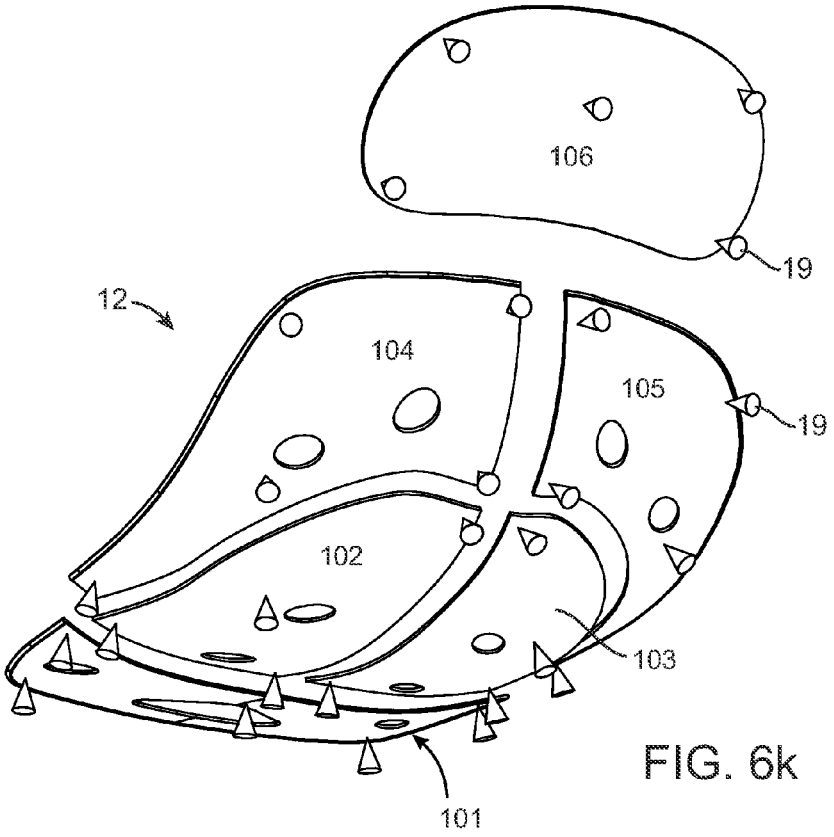
FIG. 6*k* shows a bottom perspective view of the seating apparatus of FIG. 6*j* in a weight bearing shape, according to an embodiment of the invention.
Figure 6L:
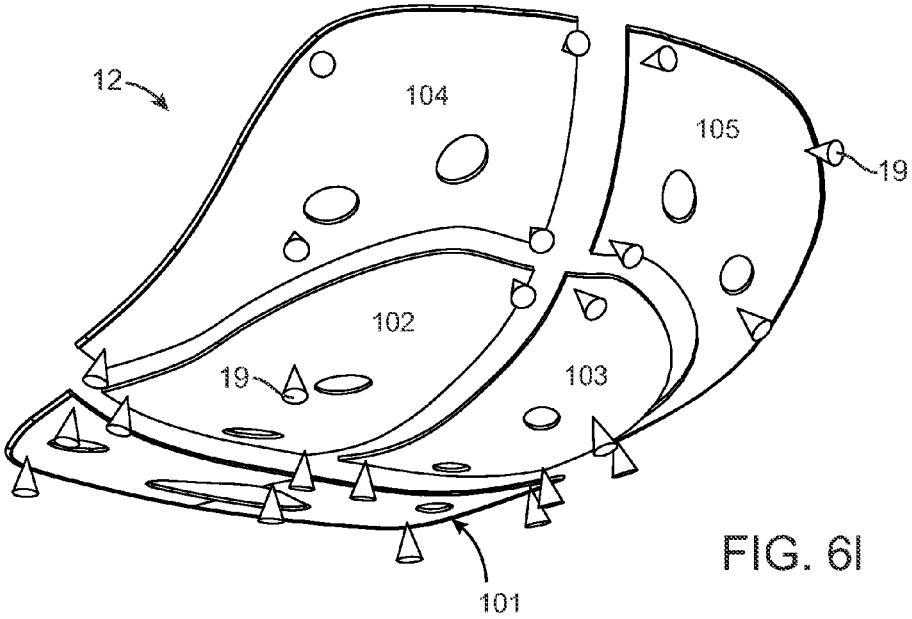
FIG. 6*l* shows a bottom perspective view of the seating apparatus of FIG. 6*j* without a back section in a weight bearing shape, according to an embodiment of the invention.
Figure 6M:
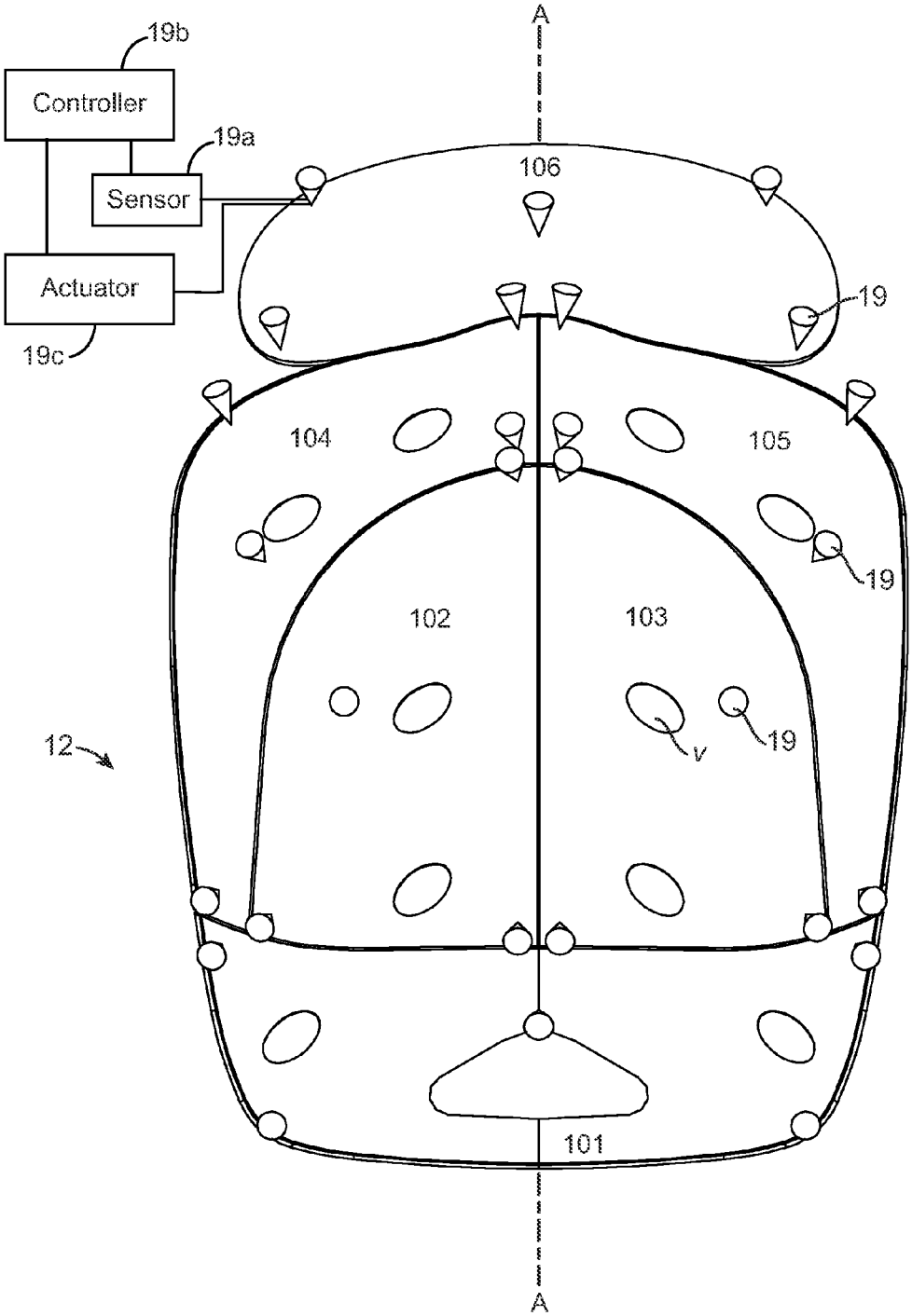
FIG. 6*m* shows a bottom aerial view of the seating apparatus of FIG. 6*j* with the seating apparatus in a non-weight bearing shape, according to an embodiment of the invention.

FIG. 6*j* shows a bottom perspective view of the sections 101-106 in a non-weight bearing shape, with attachment points 19 where the sections 101-106 may be attached to a support environment for manipulating the sections 101-106. FIG. 6*k* shows a bottom perspective view of the sections 101-106 of FIG. 6*j* in a weight bearing shape. FIG. 6*l* shows a bottom perspective view of the sections 101-105, in a weight bearing shape. FIG. 6*m* shows a bottom aerial view of the sections 101-106 in a non-weight bearing shape. Said manipulation may be active such as using a pressure sensor 19*a* which senses pressure on a plurality of the attachment points 19, an electronic controller 19*b* that processes the sensed pressure information and sends control signals to an actuator 19*c* (e.g., placed proximate points 19) to move the sections 101-106 until the secondary shape is achieved and a fully forward lordosis of the pelvis and spine is achieved, according to an embodiment of the invention.

Figure 6N:
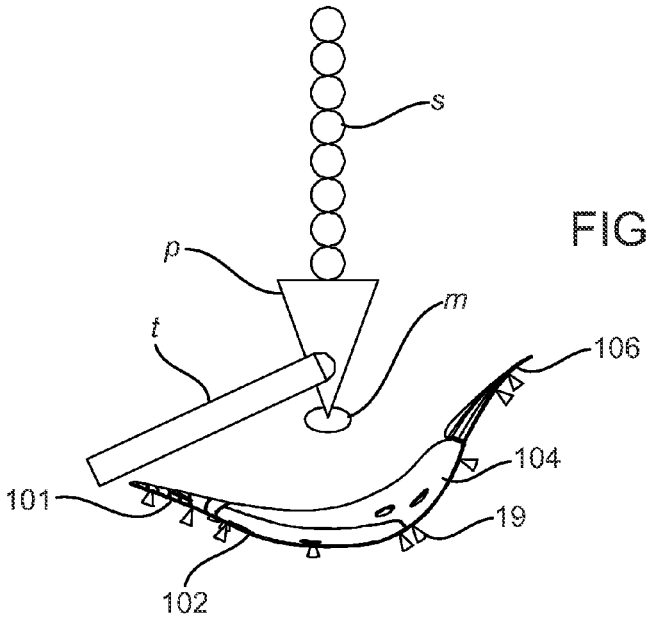
FIG. 6*n* shows a right side view of the seating apparatus of FIG. 6*j*, with a mechanical robot anatomical skeleton representation of a user in the act of sitting, approaching the seating apparatus, according to an embodiment of the invention.
Figure 6O:
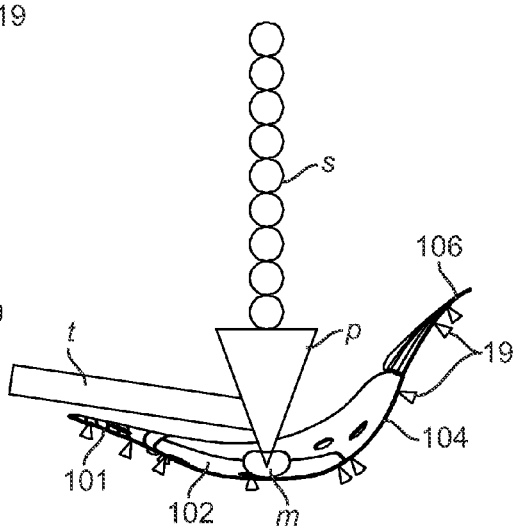
FIG. 6*o* shows a right side view of the seating apparatus of FIG. 6*n*, with the mechanical robot anatomical skeleton touching the seating apparatus, according to an embodiment of the invention.
Figure 6P:
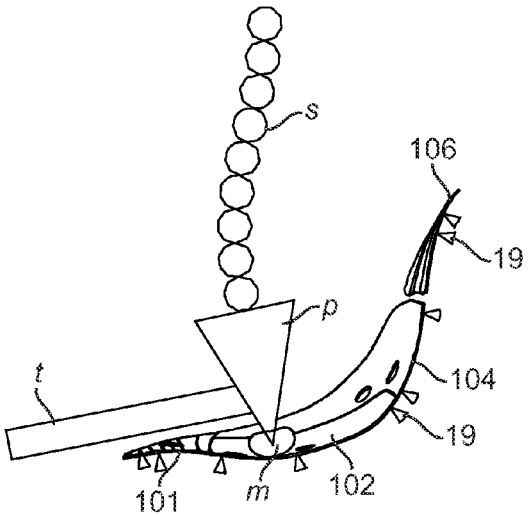
FIG. 6*p* shows a right side view of the seating apparatus of FIG. 6*o* with the mechanical robot anatomical skeleton filling the seating apparatus until total secondary shape is achieved and a full forward lordosis of the pelvis and spine is achieved, according to an embodiment of the invention.

FIG. 6*n* shows a right side view of the sections 101-106 of FIG. 6*j*, with a mechanical robot anatomical skeleton representation of a user in the act of sitting, approaching the sections 101-106. FIG. 6*o* shows a right side view of the sections 101-106 of FIG. 6*n*, with the mechanical robot anatomical skeleton touching at least the bowl portion. FIG. 6*p* shows a right side view of the sections 101-106 of FIG. 6*o* with the mechanical robot anatomical skeleton filling the bowl portion, with the underside of the upper legs pressing down on section 101, until the secondary shape is achieved and a full forward lordosis of the pelvis and spine is achieved, according to an embodiment of the invention.

In another embodiment, the device 100 may be component of a dual seat pan, to induce skeletal alignment and muscle form while the supporting surface (sub seat pan) is to hold the soft tissue structures of the buttocks and distal thighs. Information about average pelvic floor sizes of men and women is utilized. The diameters of the outlet of the pelvis include anteroposterior and transverse. The anteroposterior extends from the tip of the coccyx to the lower part of the symphysis pubis, with an average measurement of about 3.25 inches in males and about 5 inches in females. The anteroposterior diameter varies with the length of the coccyx, and is capable of increase diminution, on account of the mobility of that bone. The transverse extends from the posterior part of the ischial tuberosities to the same point on the opposite side, with the average measurement of about 3.25 inches in males and about 4.75 inches in females. These measurements are essentially regardless of height, weight, and race over the population. Given the average pelvic measurements, the device 100 provided by the invention is suitable for at least a 95% range of the adult population. The coccyx cup area 110*a* of the channel 110 (FIG. 3*a*) allows for variable coccyx angles so as to keep the surface of the device 100 from coming in contact with the lower sacral joints and coccyx.

The device 100 is placed on (or may be integrated into) a conventional seating surface 40*a* to create a dual seat pan. With the addition of a secondary seat pan 40*a*, an active (i.e., non-static) seating system is provided, comprising individual sections 101-105 (active seat pan) on a non-active conventional seat pan 40*a*, combined together. The seat pan 40*a* is designed based on the skeletal and muscle structure while the device 100 seat pan provides support for soft tissue structures of the buttocks and thighs. Combining said sections 101-105 (and optionally section 106) of the device 100 together on top of a conventional seat pan 40*a* provides a cooperative system when the user's body weight is placed on the device 100 and the seat pan 40*a*. The process 300 applies to the dual seat pan system.

As noted, in a preferred embodiment of the invention (FIGS. 1*a*-1*d*, 2*a*-2*h*, 3*a*-3*f*, 4*a*-4*c*, 5, 7*a*-7*c*, 8*a*-8*d*, 9, 10*a*-10*f*, 11*b*, 12*a*-12*f*, 14*a*-14*i*, 15, 16*a*-16*c*, 17*a*-17*b*, 18*a*-18*n*), the foundation member 12 is a one piece member molded from memory retentive material such a nylon plastic with the varying thickness regions as shown by example in FIG. 4*a*. The depiction in FIG. 4*a* also shows the relative scale of the various regions of the foundation member 12 in relation to one another, where the memory retentive material essentially gradually changes in thickness from one region to another region. Each of the sections 101 through 105 shows a grouping of the regions of which it is made of (FIGS. 4*a*-4*b*), wherein there is no physical separation between the sections 101-105.

Figure 15:
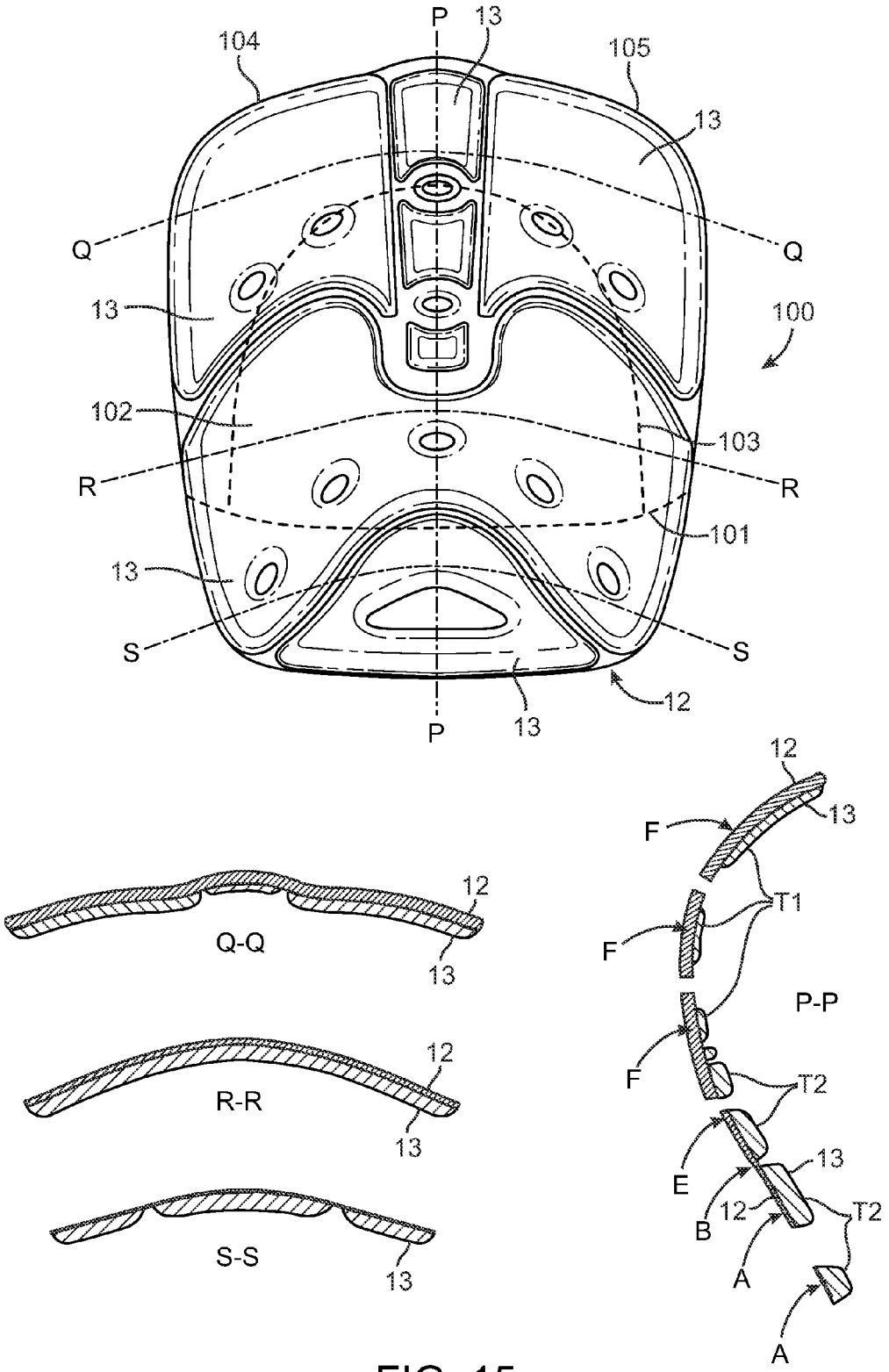
FIG. 15 shows an embodiment of the seating apparatus of FIG. 1*a*, having a foundation member and fabric foam overlay, with thicknesses of the foundation member and foam overlay attachment, according to an embodiment of the invention.

According to said preferred embodiment, the device 100 further includes a padding layer 13 shown in FIG. 15. The padding layer 13 comprises foam attached to the top of the foundation member 12. The foam thickness is contoured as to not negatively affect the function of the foundation member. The top illustration in FIG. 15 shows an aerial view of the top surface of the device 100 showing a foam pattern on the sections 101-105 (shown in dashed lines). FIG. 15 further shows cross-sections of the device 100 along planes P-P, Q-Q, R-R and S-S. The cross-sections show the foundation member 12 (not drawn to scale in terms of thickness). The thickness of the different regions of the foundation member 12 in cross-section P-P are shown by lettering A, B, E, F as applicable corresponding to the thickness legend in FIG. 4*a*. The thickness of the foam 13 in cross-section P-P is indicated as T1 (e.g., about 4 mm thick), T2 (e.g., about 10 mm thick), T3 (e.g., about 12 mm thick). The foam 13 is thicker than the one piece foundation member 12 to enhance the effect of stopping the forward-sliding ischium tip from riding up said incline 111, and to enhance rotation of the pelvis forward by stopping the bottom of the ischium tip on said incline 111, thereby enhancing forward rotation of the pelvis via the bowl portion 20. The foam is thinnest in the rear landing zone 3 so as to not keep the bowl portion 20 in sections 102-105, from filling up with muscles of the user's lower pelvic region.

In the preferred embodiment, the foundation member 12 is preferably molded from memory retentive materials such a nylon plastic (e.g., Nylon 6, 6) that is able to maintain its memory and flexibility over a wide range of temperatures. Even though sections 101-105 are molded in one piece, thickness difference in the regions in FIG. 4*a*, generally change along the peripheries of the regions in FIG. 4*a*, providing a desired response in the reaction to the weight of the user.

The plastic used for the regions of the sections 101-106 is preferably able to withstand the heat necessary to form and mold EVA, PU and MDI Foam. The heat required to mold Polyurethane Foams, Polyester fabric and to weld the fabric is about 218° F. to 285° F. Although the novel foundation member 12 in accordance with the invention is able to assume an advantageous secondary shape or configuration when bearing 90 or more pounds, there is a strong tendency for the foundation member 12 made of this particular plastic to return to its original configuration when weight is removed, which is an important feature of the invention. Other materials exhibiting such characteristics may also be used.

Ventilation holes V (FIG. 3*a*) are not required for the device 100, but assist with breathability and with thermal comfort. The ventilation hole pattern helps the surface to breathe, providing comfort and allowing conduction of heat and dispersion of moisture away from the surface of the user skin. Thermal comfort should not be posture dependent, thus the device 100 includes a preferred pattern of ventilation holes in FIG. 3*a*.

In the preferred embodiment, the foundation member 12 comprises varying thickness regions of nylon in a direction perpendicular to the surface of the foundation member 12 (i.e., perpendicular to drawing sheet of FIG. 4*a*). Because such nylon has a specific flexibility and memory that allows it to go from an original shape to a secondary shape, the varying thickness regions enhance the secondary shape adding to the dynamic reaction of the device 100. The varying thickness regions have specific desired effects on the secondary, weight-bearing, shape of the device 100, acting to return the weight bearing shape back to the non-weight bearing shape, causing a dynamic reaction to maintain tilting/rotating forward, cupping and cradling the pelvis area, while floating the pelvis in muscle tissue. Further, the device 100 with the example dimensions and thickness regions provided herein is suitable for a wide range of the population. The device 100 deals directly with pelvic floor measurements and the sub seat pan 40*a* deals with the anthropomorphic measurements. Based on anatomical databases for humans, the dual seat pan system of the invention is suitable for the majority, not all of the human population.

An example manufacturing process for the preferred embodiment of the device 100 (FIGS. 1*a*-1*d*, 2*a*-2*h*, 3*a*-3*f*, 4*a*-4*c*, 5, 7*a*-7*c*, 8*a*-8*d*, 9, 10*a*-10*f*, 11*b*, 12*a*-12*f*, 14*a*-14*i*, 15, 16*a*-16*c*, 17*a*-17*b*, 18*a*-18*n*) involves two molding processes. The first mold comprises a thermoplastic and thermosetting polymer injection mold for the foundation member 12. The first mold allows injection molding a specific nylon plastic (Nylon 6, 6). During the injection of the nylon plastic, a bidirectional polyester microfiber fabric can be placed inside the mold so as to be molded simultaneously with the nylon foundation. Thus, the nylon foundation and its bottom side fabric are molded together. The nylon foundation member with a bidirectional polyester fabric bottom surface is then placed into a match metal thermoforming mold with a cutting die component. The match metal thermoforming mold performs several simultaneous functions. First, the match metal thermoforming mold forms a Polyurethane Foam 13 and polyester microfiber into a specified, formed, and molded shape. Second, the match metal thermoforming mold "welds" the bidirectional polyester fabric 13 while, cutting the polyurethane foam 13 and polyester fabric in specific areas shown by example in FIG. 15.

The process depends on the flexible moldable plastic foundation being able to withstand the heat necessary to form and mold the EVA, PU and MDI Foam 13 (described further below). The heat required to mold the Polyurethane Foams, Polyester fabric and weld the fabric is 218° F. to 285° F. All thermoplastic and thermosetting polymers have a melting point at similar temperatures at which the EVA, PU and MDI Foams 13 are molded. This creates a specific need for the foundation polymer that does not melt under the heat and pressure required by the EVA, PU and MDI Foam 13 and polyester fabric to be able to be press molded, die cut and welded together. The Nylon 6, 6 can withstand the heat and still be an injectable polymer 12.

Although the nylon can withstand said heat molding process, it cannot do so and be sufficiently flexible to function properly. As such, it must be steam heated to regain a specific flexibility after it has gone through the molding process. The invention discloses the ability to have an injectable Nylon 12 with specific flexibility and memory retentive characteristics without melting at the same temperatures as the foams and fabrics 13 that surround the nylon foundation member 12. This involves a Nylon 6, 6 make-up and steam heating to regain a specific flexibility.

Another aspect of the process involves ventilation holes V cut on the interior areas of the device 100, while still allowing the polyester fabric and EVA, PU and MDI Foam 13 to be welded together. These holes in various shapes and sizes and locations across the device 100 (without flat surfaces to match the metal die), must not only be formed to create the proper shape for molding the foam 13, but also must meet the bottom surface of the mold in such an exact fashion as to not to dull the cutting die blade, such that touch, heat and pressure can weld the two sides of fabric together and cut at a precise point.

In one example, the device 100 has a nylon foundation member 12 comprising synthetic polymers known generically as polyamides. Subsequently, polyamides 6, 10, 11, and 12, are developed based on monomers which are ring compounds (e.g., Caprolactam nylon 6, 6 is a material manufactured by condensation polymerization). EVA foam comprising ethylene vinyl acetate (also known as EVA) is the copolymer of ethylene and vinyl. PU polyurethane foam 13 on the foundation member 12 includes polyurethane formulations that cover a wide range of stiffness, hardness, and densities. A polyurethane substance, IUPAC (PUR or PU), is any polymer comprising a chain of organic units joined by urethane (carbamate) links. Polyurethane polymers are formed through step-growth polymerization by reacting a monomer containing at least two isocyanate functional groups with another monomer containing at least two hydroxyl (alcohol) groups in the presence of a catalyst.

MDI PPG Memory Foam 13 combines polyurethane with additional chemicals increasing its viscosity. It is often referred to as visco-elastic polyurethane foam. In some formulations, it is firmer when cooler. Higher density memory foam reacts to body heat, allowing it to mold to a warm human body in a few minutes. Lower density memory foam is pressure-sensitive and moulds quickly to the shape of the body.

Bidirectional polyester microfiber fabric or any bidirectional polyester fiber microfiber refers to synthetic fibers that measure less than one denier. The most common types of microfibers are made from polyesters, polyamides (nylon), and or a conjugation of polyester and polyamide.

Microfiber is used to make non-woven, woven, and knitted textiles. The shape, size and combinations of synthetic fibers are selected for specific characteristics, including the following: softness, durability, absorption, wicking abilities, water repellency, electrodynamics, and filtering capabilities. Microfiber is commonly used for apparel, upholstery, industrial filters and cleaning products.

Figure 20:
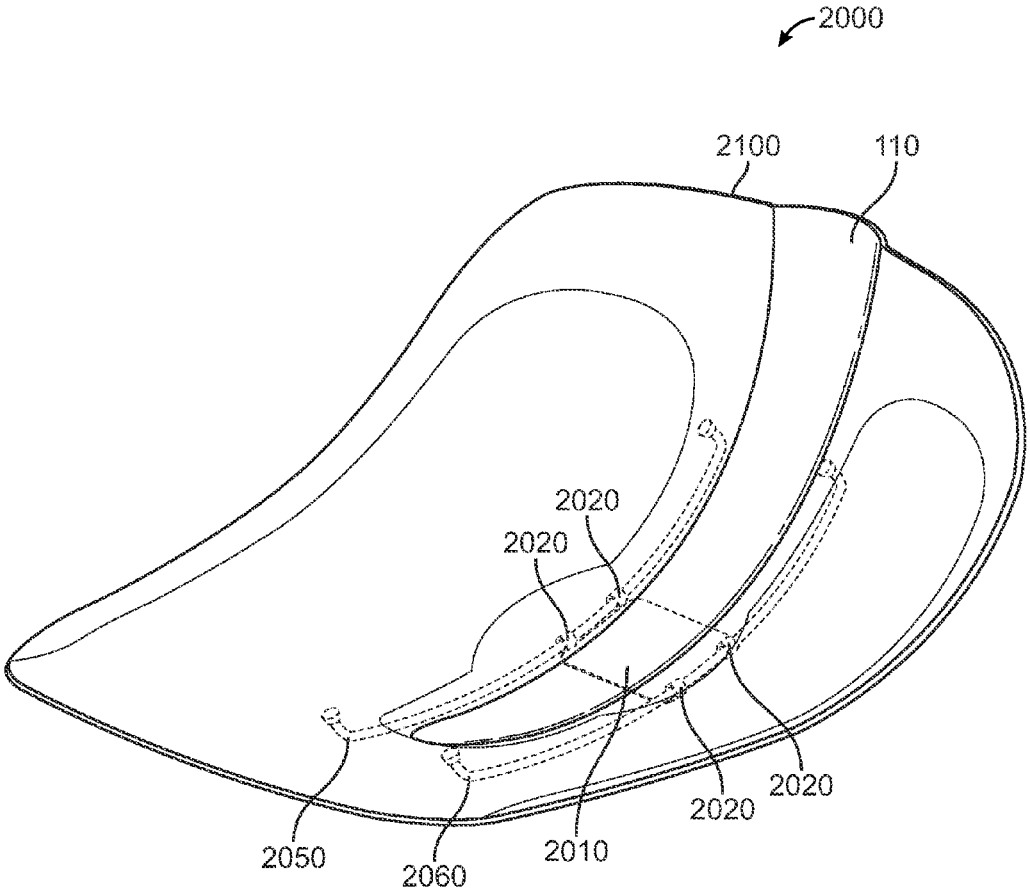
FIG. 20 shows a top view of a seating apparatus including a motion track system according to one embodiment of the invention.
Figure 21:
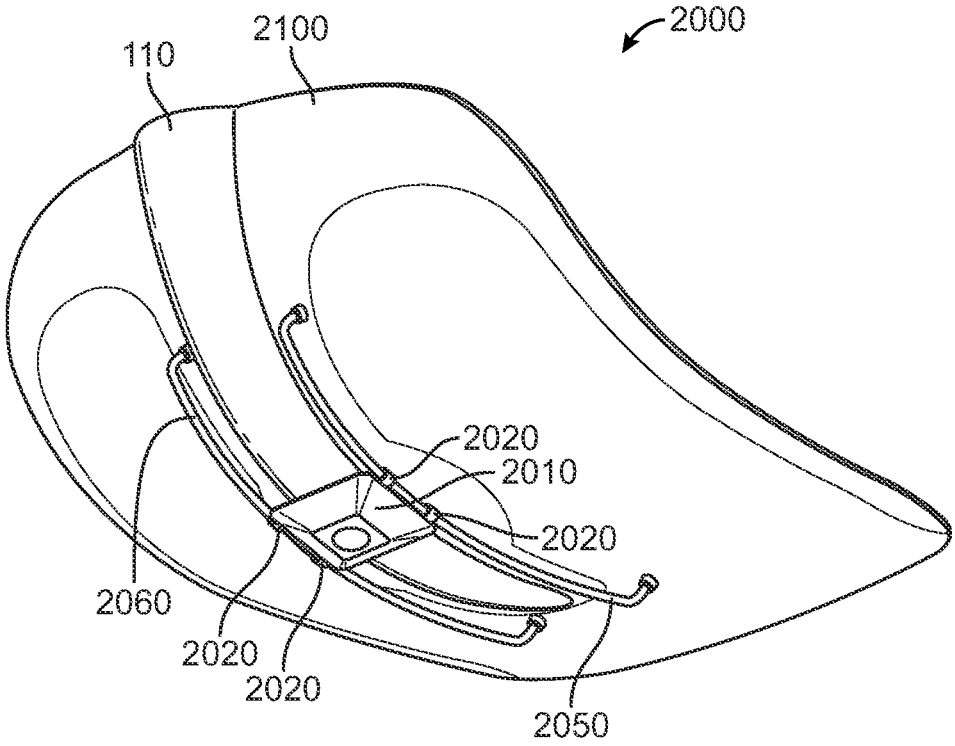
FIG. 21 shows a perspective view of the seating apparatus shown in FIG. 20 according to one embodiment of the invention.

FIG. 20 shows a top view of an orthopedic seating system 2000 according to one embodiment of the invention. FIG. 21 shows a bottom perspective view of the orthopedic system 2000 illustrated in FIG. 20. The seating system 2000 includes foundation member 2100 (similar to foundation member 12 of the device 100 embodiments as described above) including the concave channel 110 recess protruding from the underside of the foundation member 2100, a first track 2050, a second track 2060, a motion cart 2010 and coupling means 2020. In one example, the motion cart 2010 is suspended and connected to the first track 2050 and the second track 2060. In one example, the first track 2050 and the second track 2060 have a length in the range of 4-7 inches and a diameter ranging between ¼-⅛ inch. It should be noted in other embodiments, other lengths and diameters for the first track 2050 and the second track 2060 are employed based on the targeted user (e.g., children, adults, athletes, etc.). In one example, the motion cart 2010 has a length in the range of 2-4 inches, a width ranging from 1-3 inches, and a height ranging from ¼-1.2 inch. It should be noted in other embodiments, other lengths, widths and heights are employed for the motion cart 2010 based on the targeted user (e.g., children, adults, athletes, etc.). In one example, the foundation member 2100 has dimensions ranging from 10-15 inches in width, 11-17 inches in length, and 3-7 inches in height. It should be noted in other embodiments, other lengths, widths and heights are employed for the foundation member 2100 based on the targeted user (e.g., children, adults, athletes, etc.).

As shown in FIGS. 20-21, the foundation member (i.e., dynamic advocacy pan and an orthopedic orthotic) includes the concave channel 110 recess protruding from the underside of the foundation member and downwardly extending wheel like structure. In one example, the M shape from foundation member 12 that represents the regions 105-104-110 (see FIG. 1A) remains the same as with foundation member 2100. With reference to FIG. 1A and FIG. 20, the first track 2050 and the second track 2060 are attached to the underside of foundation member 12 on the central bowl portion 3, circularly extend outward from regions 102-103, attach at the edge of sections 102-103 cross section L-L, and connect at point E-E (see FIG. 18A). With reference to FIG. 3D and FIG. 20, the first track 2050 and the second track 2060 run parallel to longitudinal A-A (see FIG. 3D). In this example, the cart 2010 moves along the first track 2050 and the second track 2060 by coupling means 2020.

In one example, the coupling means comprises a wheel system, and the first track 2050 and the second track 2060 have a round shape (e.g., circular, cylindrical, oval, etc.). In one example, the coupling means may be connected to the first track 2050 and the second track 2060 by different means, such as a multi-wheel system (e.g., 12 wheels, 24 wheels, etc.). In another example, the coupling means 2020 may be connected to the cart 2010 on all four corners. In other embodiments, the coupling means 2020 may be other types of connectors other than wheels, such as rollers, ball type connectors, etc.

In one embodiment of the invention, the first track 2050 and the second track 2060 may be attached to the orthopedic seat 2100 by known means, such as being molded into the orthopedic seat, attached via hardware (e.g., nuts, bolts, etc.), permanent adhesive (e.g., epoxy), etc.

Figures 22A, 22B:
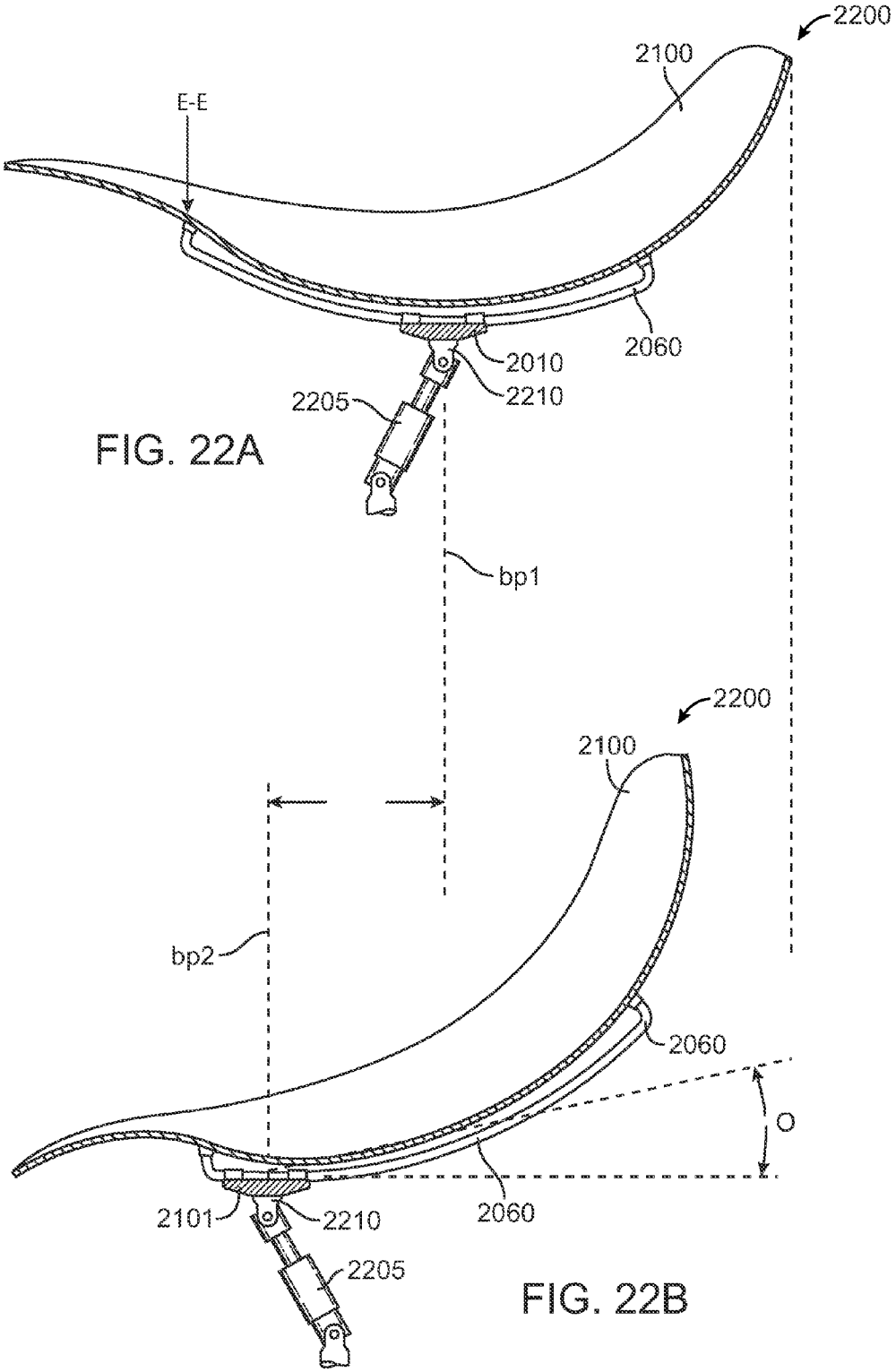
FIG. 22A shows a side view of a seating apparatus including a motion track system coupled with an arm, shown in a first position according to one embodiment of the invention.
FIG. 22B shows a side view of a seating apparatus including a motion track system coupled with an arm, shown in a second position according to one embodiment of the invention.

FIGS. 22A-B shows side views of a system 2200 including the embodiment of the invention shown in FIG. 20 coupled with an arm connector 2210 and arm 2205. FIG. 22A shows the cart 2010 in a first position, and FIG. 22B shows the cart 2010 in a second position. As shown in FIG. 22A, the first position of the orthopedic seat 2100 represents that the weight of a user is not being born by the orthopedic seat 2100. In this example, because the cart 2010 rolls effortlessly along the first track 2050 and the second track 2060 that follow the shape and curve of the concave channel 110 wheel like structure, the orthopedic seat 2100 finds a balance point along the first track 2050 and the second track 2060. FIG. 22B shows the second position of the orthopedic seat 2100 as having been caused to undertake a considerable amount downward rotation tilted indicated by the angle O. The downward rotation is partly a result of the weight of the lower pelvis of a user on the portion of the foundation member 12 sections 102 and 103 of the bowl portion 20, and partly a result of the hamstring portion of the distal thighs, that is, the underside of the upper thigh portion of the user legs, resting on the front lip-like section 101, causing a substantial amount of downward curvature (see also FIG. 1A for reference). Also shown is the back portion of the orthopedic seat 2100 shifting forward by distance, the bowl portion 20 is also shifted forward, and the front section 101 bends down. It should be noted that in one example, the cart 2010 may rotate or spin 360° on the arm connector 2210. In this example, the cart 2010 is capable of 6 DOF (degrees of freedom) motion (e.g., pitch, yaw and roll, etc.). In one example, arm 2205 has a length range from 6-12 inches non-extended, and a range of 10-18 inches extended, and a diameter range from ½ inch to 1 inch. It should be noted in other embodiments, other lengths and diameters are employed for the arm 2205 based on the targeted user (e.g., children, adults, athletes, etc.).

In one example, the round first and second track 2050 and 2060 rails follow the curvature of the concave wheel-like structures' 110 bottom surface. The first and second track 2050 and 2060 rails are distanced away from the surface of the orthopedic seat 2100 with enough room for the wheel system not to touch or come in contact with the foundation members' 12 bottom surface. In this example, the round first and second track 2050 and 2060 rails attach at the points E-E and L-L (see FIG. 18A for reference) at a 90° angle.

In one embodiment of the invention, the cart 2010 is attached to the first and second track 2050 and 2060 rails and coupled to a universal ball joint 2210 that is attached to a pneumatic cylinder 2205 with another universal ball joint. The cart 2010 travels from bp1 (see also FIG. 8*a* for reference) to bp2 (see also FIG. 8*b* for reference) at E-E (see FIG. 3*d* for reference) which is the equilibrium balance point. In one example, the ball joint 2210 have a diameter range between ¼-½ inch. It should be noted in other embodiments, other diameters are employed for the universal joint 2210 based on the targeted user (e.g., children, adults, athletes, etc.).

Figure 23:
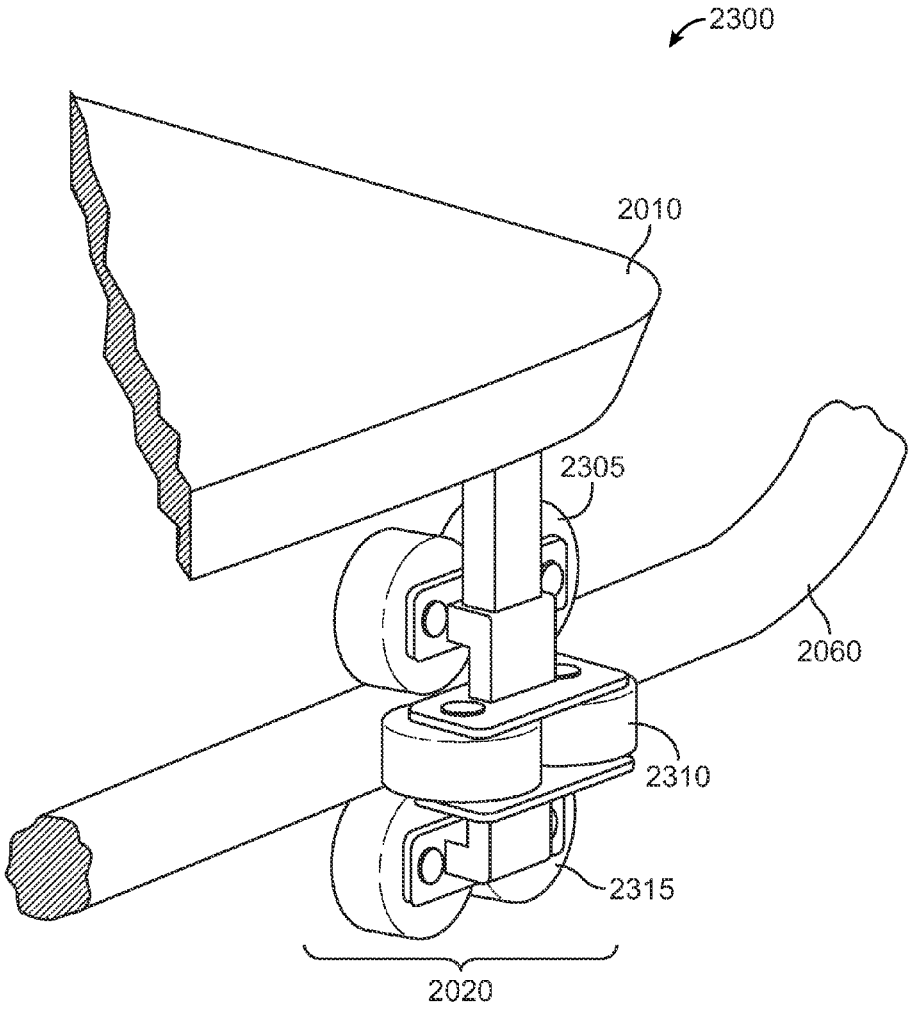
FIG. 23 shows a close-up view of motion track system coupling portion for a seating apparatus according to one embodiment of the invention.

FIG. 23 shows a perspective view of the second track 2060 with an example round rail shape onto which two (2) side-by-side wheels (2305, 2310 and 2315) roll on three sides of the round second track 2060. In this example, a combination of six wheels surrounding three-fourths of the rail assists the cart 2010 to move via rolling of the wheels 2305, 2310 and 2315 in a stable manner.

Figure 24:
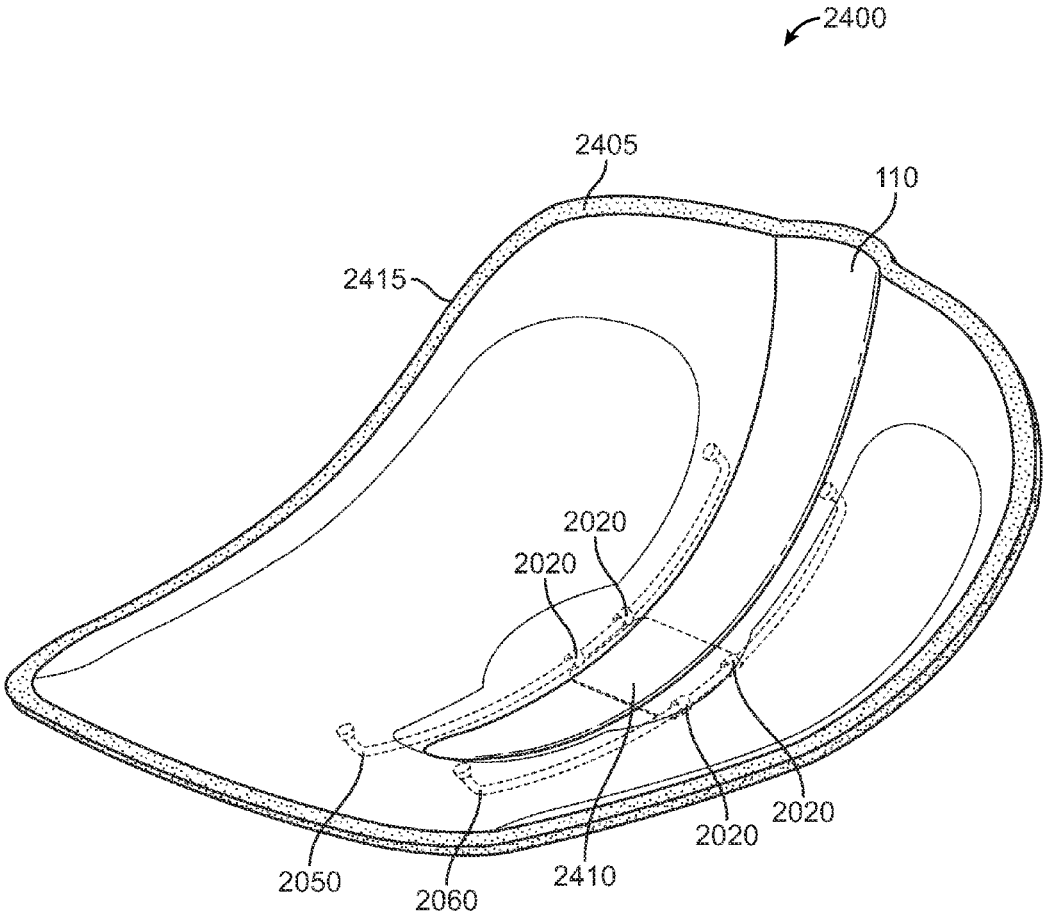
FIG. 24 shows a top view of a seating apparatus including a circumferential bezel and a motion track system according to one embodiment of the invention.

FIG. 24 shows a top perspective view of a seating apparatus 2400 (dynamic active seat pan and orthopedic orthotic) including a motion track system according to one embodiment of the invention. This top perspective view of the foundation member 2405 is a dynamic active seat pan, including an orthopedic orthotic, and includes a bezel-like member 2415 attached at its entire periphery. In one example, the bezel-like member 2415 is used for attaching flexible fabrics to the foundation member 2405 (similar to the foundation member 12 as described above). As illustrated, the concave channel 110 recess protruding from the underside of the foundation member 2405 is a downwardly extending wheel-like structure. The M shape from foundation member 2405 is similar to foundation member 12 and represents the regions 105, 104 (see FIG. 1*a* for reference) and 110. In foundation member 2405, the central bowl portion 3 that circularly extend outward from regions 102 and 103 (see FIG. 1*a* for reference) attached to the underside of the foundation member 2405 is a fixed attachment plate 2410 at the intersection of E-E (see FIG. 26A) and A-A (see FIG. 18*a* for reference). In one example, the bezel-like member 2415 has a diameter in the range of ¼ to ½ inch. It should be noted in other embodiments, other diameter are employed for the bezel-like member 2415 based on the fabric or materials necessary to hold and secure the foundation member 2405.

Figure 25:
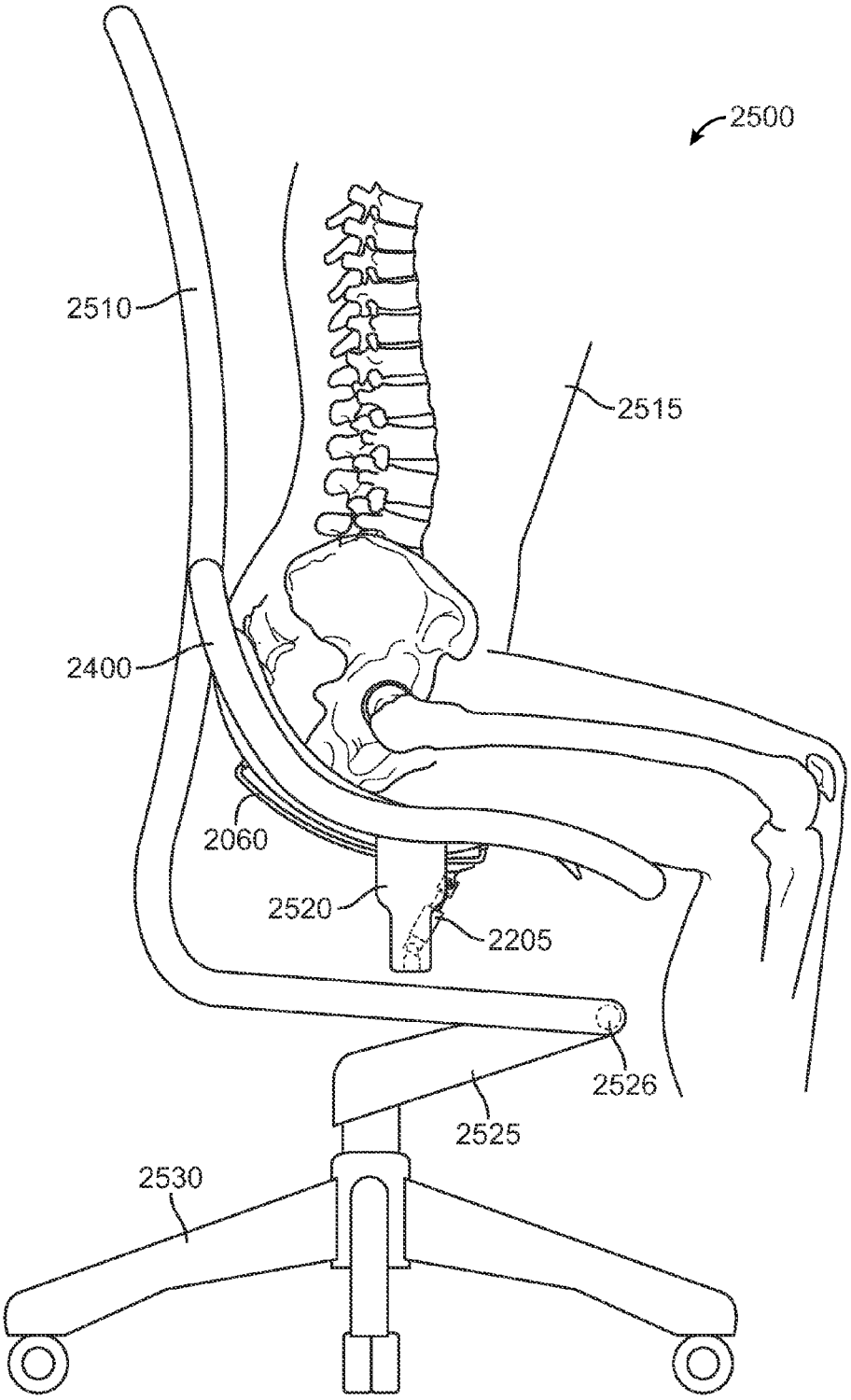
FIG. 25 shows a side view of a seating apparatus including a motion track system integrated with a trampoline like chair showing posture of a human anatomy seated in the seating apparatus according to one embodiment of the invention.

FIG. 25 shows a side view of a system 2500 including a motion track system integrated with a trampoline-like chair apparatus 2510 showing posture of a human anatomy 2515 seated in the seating apparatus 2400, according to one embodiment of the invention. In one example, attached to the fixed attachment plate is the universal joint pneumatic cylinder 2520 and arm 2205. In one example, the universal joint pneumatic cylinder 2520 and arm 2205 comprises a pneumatic-controlled lowering system. As shown in this side view with the orthotic apparatus in a secondary weight bearing state shows that the universal joints allow the cart 2410 to find its equilibrium balance point at point E-E (see FIG. 26A). As illustrated the wheel base 2530 connected to the V-shaped support member 2525 shows the pivot point 2526 for the tilt joint that attaches to the sub frame that holds up the entire chair frame. In one example, the chair frame is one continuous part which includes the seat pan and the backrest with the pneumatic support beam that is suspended. In some embodiments of the invention the frame of the chair apparatus 2510 may be made from polymer plastics, metals, a combination of both, etc. In one example, the frame of chair apparatus 2510 has a bezel-like attachment throughout its entire interior periphery from which the flexible fabric is attached.

Figure 26A:
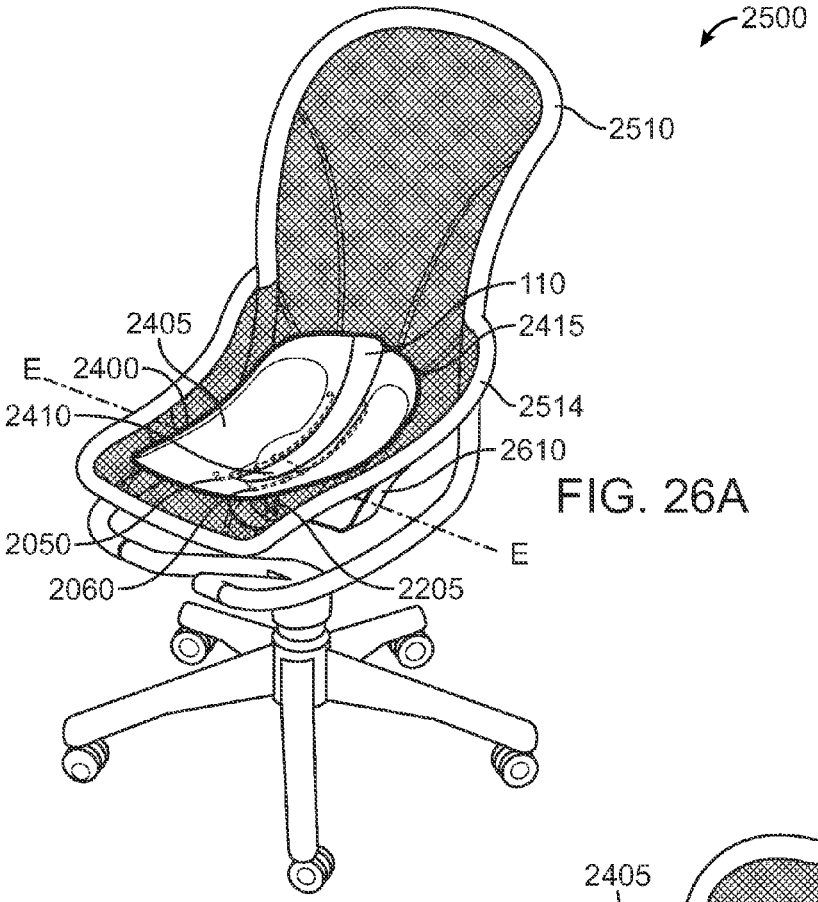
FIG. 26A shows a perspective view of a seating apparatus including a motion track system integrated with a trampoline like chair apparatus according to one embodiment of the invention.

FIG. 26A illustrates a top perspective view of the foundation 2405 integrated with the trampoline like chair apparatus 2510. As illustrated, the concave channel 110 recess protrudes from the underside of the foundation member 2405 downwardly extending as a wheel like structure. Attached to the underside of the foundation member 2405 are fixed attachment plate 2410, the universal joint pneumatic cylinder 2520 and arm 2205 at the intersection of E-E and A-A (see FIG. 19*a* for reference) and support beam 2610. It should be noted that in some embodiments of the invention, the foundation 2405 is designed with respect to skeletal and muscle, anatomical structure, and the integrated trampoline-like structure is designed for the soft tissue structures of a person's buttocks and distal thighs. In these embodiments of the invention, the skeletal and muscle anatomical design forms a dynamic active seat pan, and the trampoline-like structure forms a non-active passive seat pan, where the two seat pans are integrated and combined together.

In one example, the chair apparatus 2510 is an ergonomic workstation chair. As illustrated, the active orthopedic orthotic seat apparatus 2400 with the roller coaster track system is attached to a support beam 2610 that attaches to the mainframe of the chair apparatus 2510 at the contact attachment point for flexible fabric attached to its interior and entire orthotic seat apparatus 2400 circumference.

In one example, the chair apparatus 2510 material is multidirectionally knitted polyester fabric which has varying degrees of flexibility depending upon which area is desired to have more flexibility or less flexibility. In this example, the material attaches to the bezel-like member 2415 on the entire circumference of the foundation member 2405. In one example, the material is made by weaving methods. In one embodiment of the invention, fabric similar to Trevira fabric made from flexible polyester fibers may be used. Because the seating apparatus 2400 is suspended in a very flexible multidirectional fabric attached to the frame of the chair apparatus 2510, the chair apparatus 2510 is referred to as a trampoline-like chair structure. In one example, the very flexible fabric suspends the active orthopedic orthotic seating apparatus 2400 allowing it to move in any direction it would have if it were just placed on the seat pan. Because the seat pan of the chair apparatus 2510 is made from a very flexible fabric to hold the soft tissues that spill over from our active orthopedic orthotic seating apparatus 2400, the system 2500 is referred to as a dual seat pan.

As shown in FIG. 26A, the equilibrium balance point E-E is the weight bearing position as if a person were sitting in the chair apparatus 2510. The chair apparatus 2510 also includes a sub-frame 2515 that holds up the seating apparatus 2400 and a back rest mainframe attaches to a V-shaped support member 2525. This is the shape that allows the support beam with its universal joint pneumatic cylinder to have sufficient clearance from the V-shaped support member 2525. In this example, the V-shaped support member 2525 attaches to the sub frame 2515 at a joint. In another example, the V-shaped support member 2525 may have other shapes, such as a U-shape, a C-Shape, etc.

In one embodiment of the invention, on top of the V-shaped support member 2525 sub-frame there are two joints 2526, 2527 from which to pivot. At the joints 2526, 2527 a tensioning/tightening or loosening hinge allows the entire frame of the chair apparatus 2510 to tilt forward or to tilt backward at the joints 2526, 2527. In one example, when the frame of the chair apparatus 2510 tilts back, a sufficient clearance exists for the support beam 2610 with the universal joint pneumatic cylinder base 2520 to fit between the V-shaped support member 2525 s.

Figure 26B:
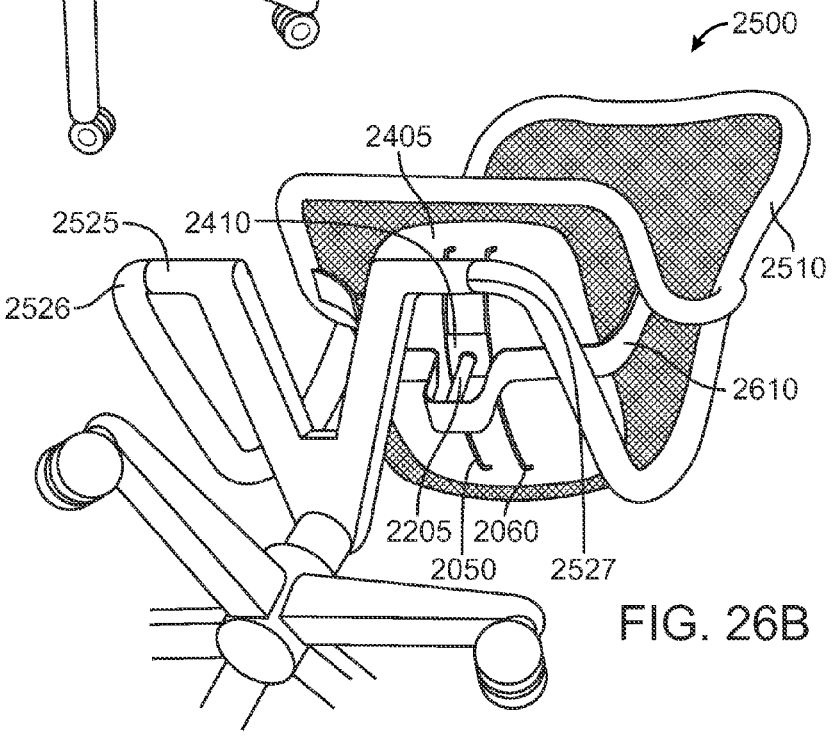
FIG. 26B shows a bottom perspective view of a seating apparatus including a motion track system integrated with a trampoline like chair apparatus according to one embodiment of the invention.

FIG. 26B shows a bottom perspective view of the seating apparatus 2400 (dynamic active seat pan and orthopedic orthotic). In one example, the support beam 2610 stabilizes the universal joint pneumatic cylinder 2520 and arm 2205 as it is coupled to the frame portion of the chair system 2500. It should be noted that while a chair system 2500 is illustrated, other types of seating may include the seating apparatus 2400, such as various sized chairs, armchairs, stools, etc.

The active orthopedic orthotic seating apparatus 2400 with cart and rail track system attached to a pneumatic cylinder with universal ball joints 2205 on both top and bottom of pneumatic cylinder 2520 allows for two distinct functions to occur. The cart and rail track system allows the person sitting in the system 2500 to first sit down upon the seating apparatus 2400 directly on top and dispositions correctly to the skeletal system. To activate the orthotic seating apparatus 2400, a person needs to skootch back into the chair apparatus 2510. The cart and rail track system allows the initial activation movement.

In one example, the cart and rail track system in combination with the pneumatic cylinder 2520 and universal joints 2205 has a highly advantageous number of attributes. In one example, the orthotic seating apparatus 2400 sits higher than any other surface of the seat pan, where the levitated orthotic seating apparatus 2400 shows a person where to sit on the seat pan correctly and also allows for the pneumatic cylinder 2520 to slowly lower the pelvis into the flexible sub seat pan of the seating apparatus 2400. In this example, this controlled lowering system slowly lowers the pelvis, which to those with back pain is a comfortable way to slow a person's body when going from a standing to sitting position. In another example, the controlled lowering system allows a user to skootch back into the chair apparatus 2510 with greater efficiency and before the body weight completely presses down on the sub-seat pan.

In one embodiment of the invention, the system 2500 includes armrests (not shown) that are stationary, movable, adjustable, etc. In one example, the chair apparatus 2510 includes a wheeled base. In other examples, the chair apparatus 2510 includes stationary feet, may be attached permanently to a floor, etc.

Figure 27A:
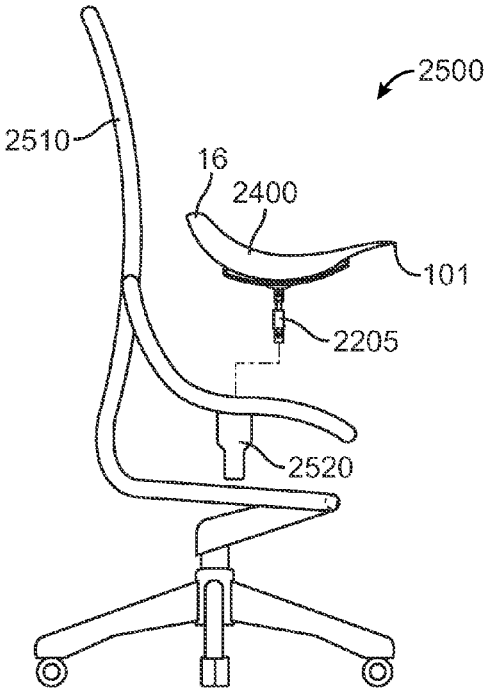
FIG. 27A shows an exploded cross-sectional side view of a seating apparatus including a motion track system integrated with a trampoline like chair apparatus according to one embodiment of the invention.

FIG. 27A shows a side cross-sectional view of the system 2500 including the seat apparatus 2400 taken at a location parallel to the center line A (see FIG. 1*a* for reference), indicating the relationship of the front portion 101 to the rear portion 16 indicating the first position of the device 100. As illustrated, the weight of a user is not being born by the seating apparatus 2400. In one example, the universal joint pneumatic cylinder 2520 and arm 2205 are adapted to couple together as shown.

Figure 27B:
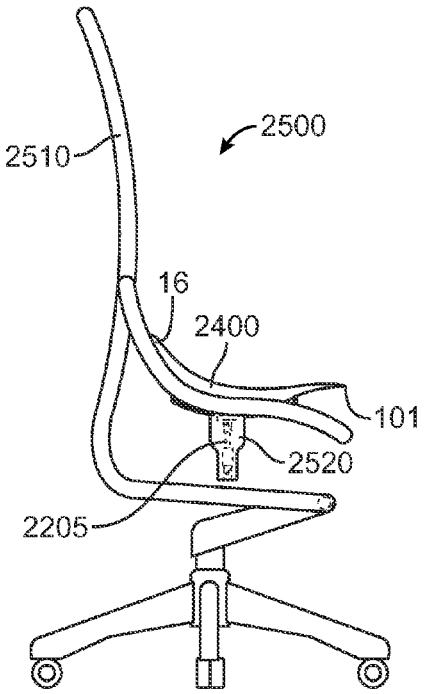
FIG. 27B shows a cross-sectional side view of a seating apparatus including a motion track system integrated with a trampoline like chair apparatus shown in one position according to one embodiment of the invention.
Figure 27C:
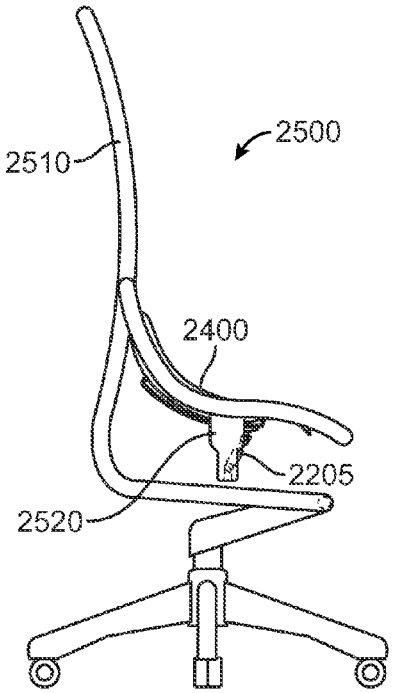
FIG. 27C shows a cross-sectional side view of a seating apparatus including a motion track system integrated with a trampoline like chair apparatus shown in another position according to one embodiment of the invention.

FIGS. 27B-C show side cross-sectional views indicating two positions or states of the seat apparatus 2400. FIG. 27B shows a first position of the seat apparatus 2400 wherein weight of a user is not being born by the seat apparatus 2400. As shown, because the cart 2410 rolls effortlessly along the first and second tracks 2050, 2060 that follow the shape and curve of the concave channel 110 wheel like structure, the seat apparatus 2400 finds a balance point along the track. As illustrated, the first position is an elevated position showing the seating apparatus 2400 and chair apparatus 2510 ready to accept the pelvis of the user, which in turn will slowly lower the body into the position shown in FIG. 27C.

FIG. 27C shows the second position of the seat apparatus 2400 as having been caused to undertake a considerable amount downward rotation tilted (e.g., indicated by the angle O in FIG. 22B). In one embodiment of the invention, the downward rotation is partly a result of the weight of the lower pelvis of the user on the portion of the foundation member 2405 sections 102, 103 (see FIG. 1*a*) of the bowl portion 20, and the presence of the likes of the user, with the hamstring portion of the distal thighs, i.e. the underside of the upper thigh portion of the user legs, resting on the front lip like section 101, causing a substantial amount of downward curvature.

Figure 28A:
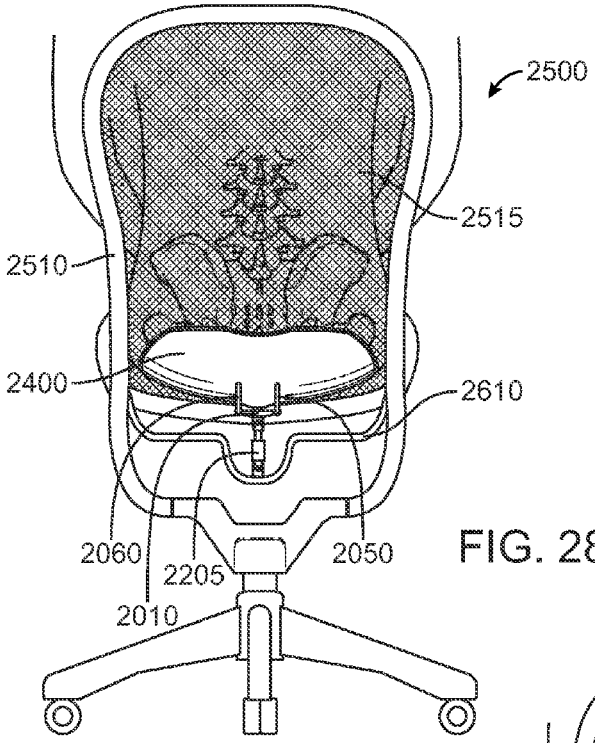
FIG. 28A shows a rear view of a seating apparatus including a motion track system integrated with a trampoline like chair apparatus showing posture of a human anatomy in a one position according to one embodiment of the invention.
Figure 28B:
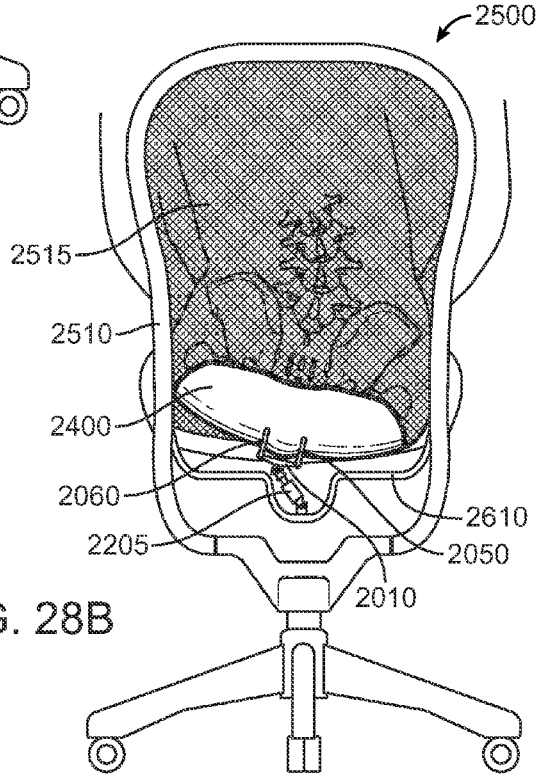
FIG. 28B shows a rear view of a seating apparatus including a motion track system integrated with a trampoline like chair apparatus showing posture of a human anatomy in a another position according to one embodiment of the invention.

FIGS. 28A-B illustrates rear views of the system 2500 showing the dynamic difference when the seating apparatus 2400 goes from its original non-weight-bearing state (FIG. 28A) into a secondary state (FIG. 28B). As illustrated, the second position exhibits the shift of the central balance point from location bp1 forward to location bp2 (see FIG. 22A-B). As the seating apparatus moves into the second position, the back portion 16 shifts forward by distance Z, the bowl portion 20 is shifted forward, and the front section 101 bends down (see FIG. 8*a* for reference).

In one example, the active orthopedic orthotic seating apparatus 2400 with the cart and track system is attached to the support beam 2610 that attaches to the mainframe of the chair, which is the contact attachment point for the flexible fabric. In this example, the flexible fabric is attached to its interior and the entire orthotic chair apparatus's 2510 circumference. FIG. 28A shows an anatomy 2515 sitting in a relatively upright position. FIG. 28B shows an anatomy 2515 where the person has leaned to the left. As the person leans, the universal joints 2205 of the pneumatic cylinder 2520 pneumatic system allow the orthotic seating apparatus 2400 to roll and maintain the continual relationship. In one example, the orthotic seating apparatus 2400 of the system 2500 tilts, cups, cradles and applies torsion on its axis to continually apply dynamic support to stabilize the pelvis of the user, which holds the pelvis in a correct lordotic curve through a wide range of motion for a sitting person and holds the user in a constant perpetuating system. In one example, the flexible fabric of the secondary seat pan holds the soft tissues of a person that are flowing over the side of the orthotic seating apparatus 2400.

Figure 29A:
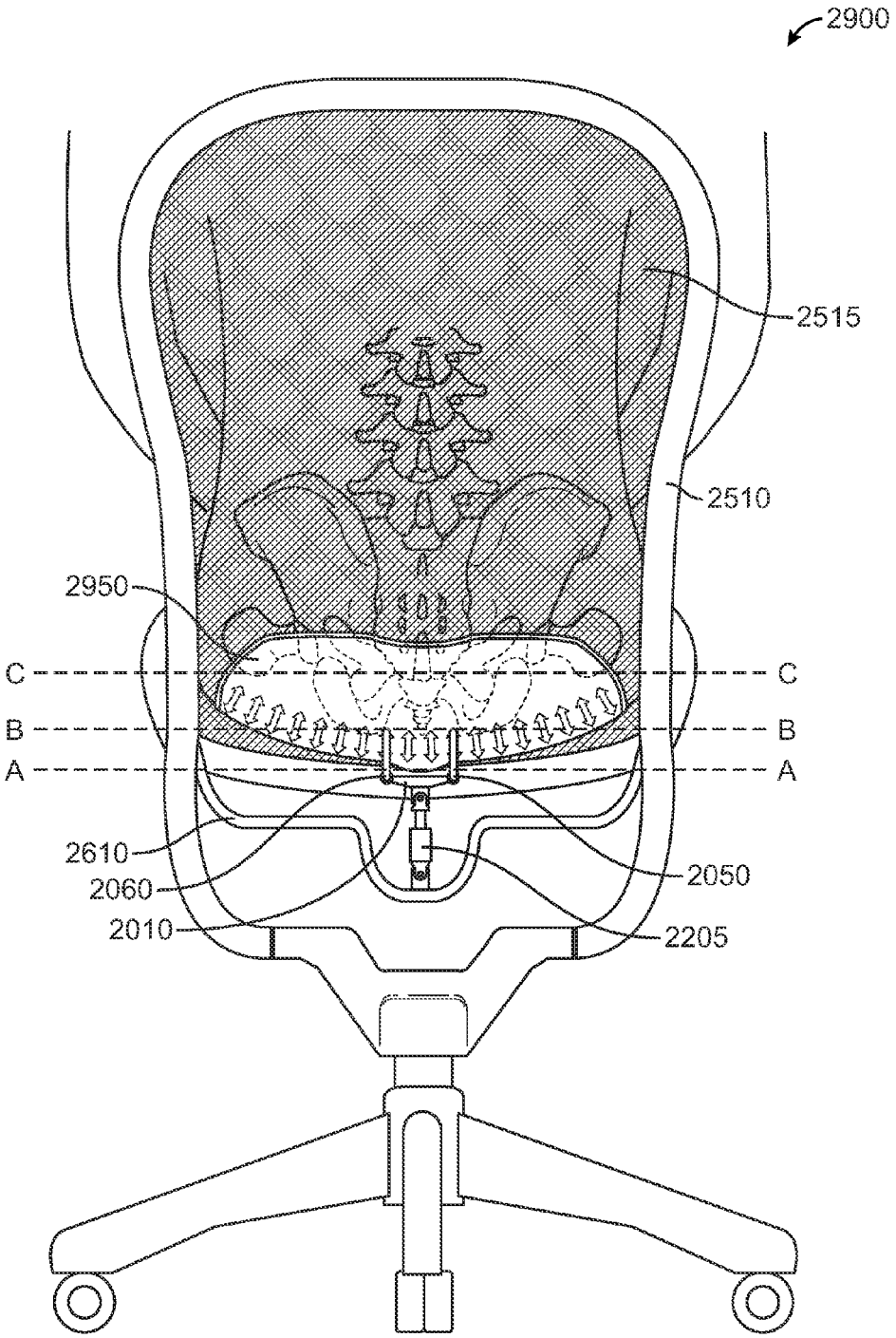
FIG. 29A shows a rear view of a seating apparatus including a motion track system integrated with a trampoline like chair apparatus showing posture of a human anatomy in one position with cross-sections A, B and C according to one embodiment of the invention.
Figure 29B:
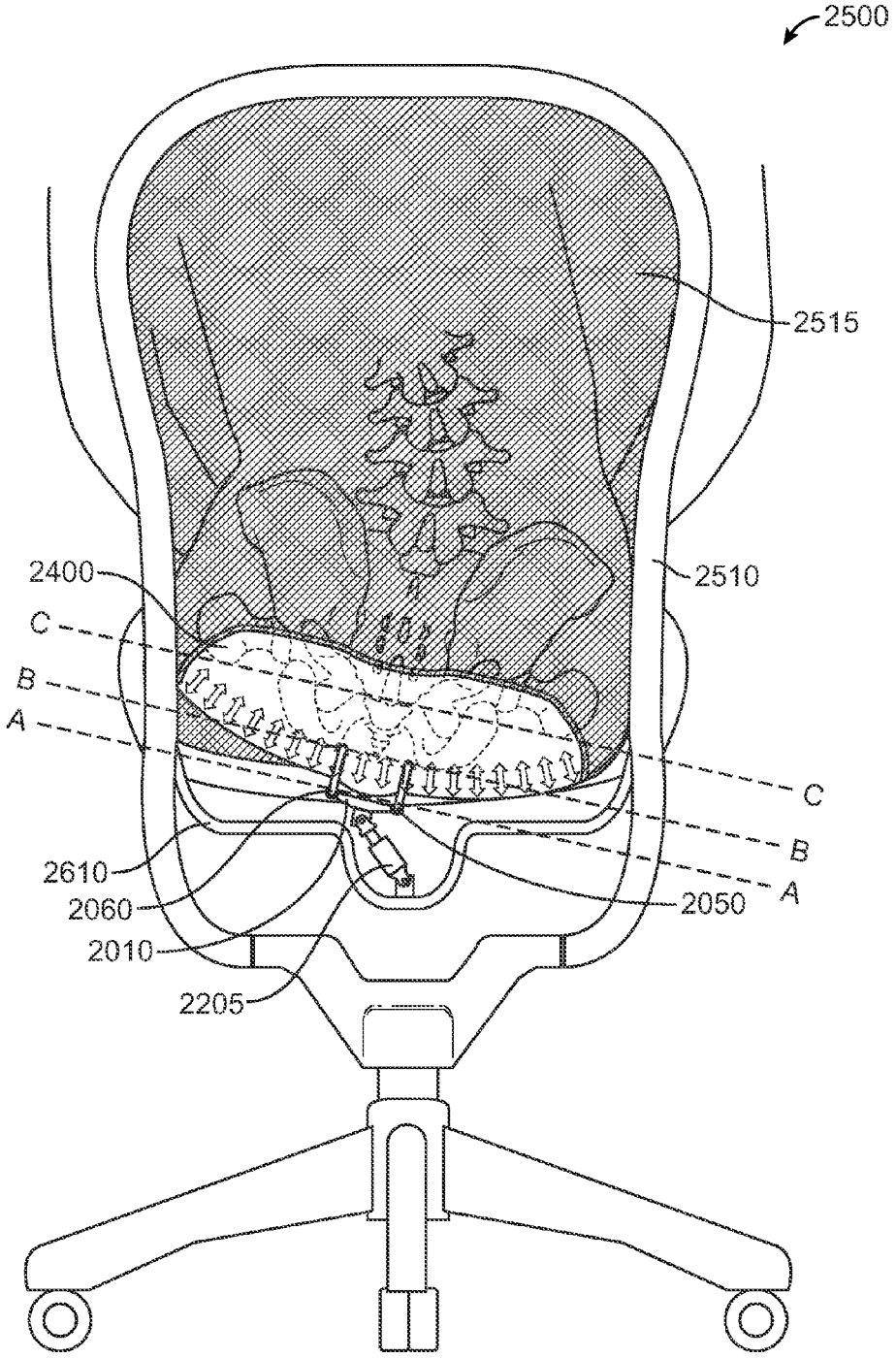
FIG. 29B shows a rear view of a seating apparatus including a motion track system integrated with a trampoline like chair apparatus showing posture of a human anatomy in another position with cross-sections A, B and C according to one embodiment of the invention.
Figure 29C:
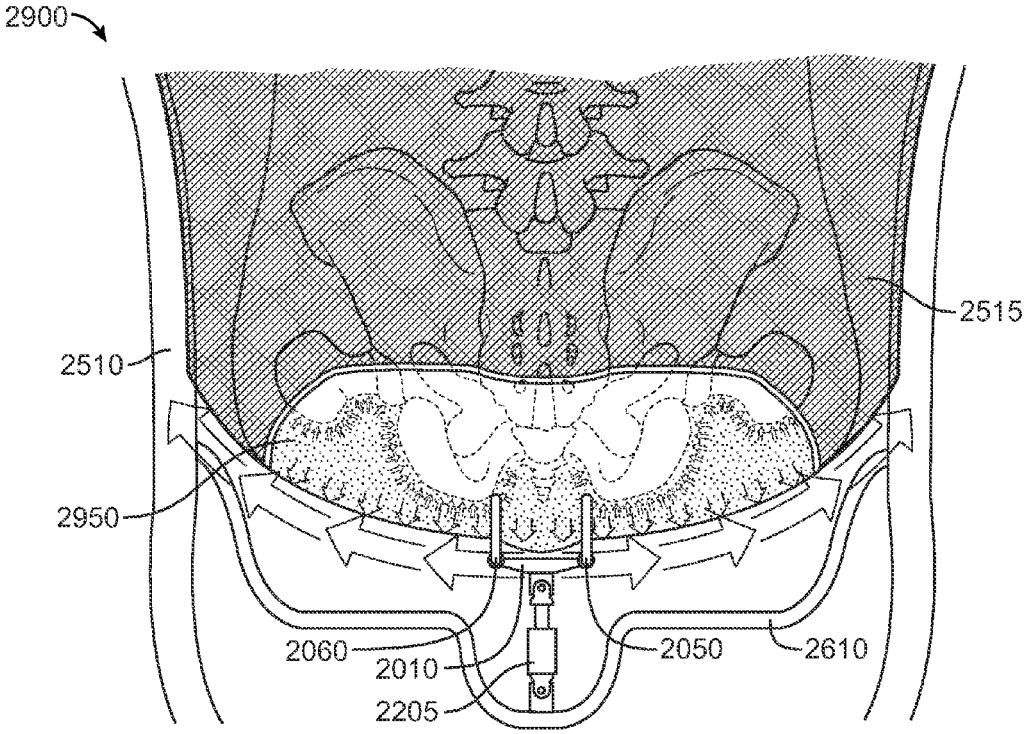
FIG. 29C shows a rear view of a seating apparatus including a motion track system integrated with a trampoline like chair apparatus showing posture of a human anatomy in one position, and showing direction of forces according to one embodiment of the invention.
Figure 29D:
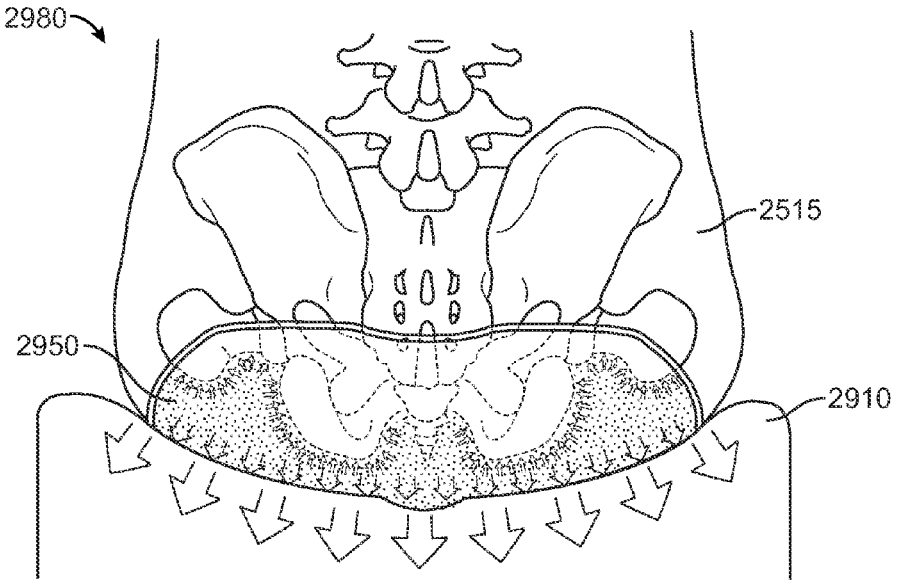
FIG. 29D shows a rear view of a seating apparatus with a cushion apparatus showing posture of a human anatomy in one position, and showing direction of forces according to one embodiment of the invention.

FIG. 29A shows a rear view of an exoskeleton seating system 2900 including a motion track system integrated with a trampoline-like chair apparatus 2510 showing the posture of a human anatomy 2515 in a first position with cross-sections A, B, and C according to one embodiment of the invention. In one embodiment of the invention the cross-sections A, B, C illustrate how the skeleton maintains an equal, parallel relationship to the active orthotic seating apparatus 2400, where the pressures that are holding up the pelvis in floated muscle tissue are evenly distributed upward into the pelvic bones, while at the same time the upper body weight is transferred down into the seating apparatus 2400. This equal, parallel relationship to the active orthotic seating apparatus 2400 is maintained even when the body (human anatomy 2515) shifts as shown in FIG. 29B, which shows a rear view of an exoskeleton seating system 2900 including a motion track system integrated with a trampoline like chair apparatus 2510 showing posture of a human anatomy 2515 in a second position with cross-sections A, B, and C. FIG. 29C shows a rear view of an exoskeleton seating system 2900 including a motion track system integrated with a trampoline-like chair apparatus 2510 showing posture of a human anatomy 2515 in the first position and showing direction of forces. FIG. 29D shows a rear view of an exoskeleton seating system 2980 integrated with a cushion apparatus 2910 showing posture of a human anatomy 2515 in the first position, and showing direction of forces according to one embodiment of the invention.

In one example, the fusion of pelvic motion in conjunction with the exoskeleton seating apparatus 2950, and the exoskeleton seating apparatus's 2950 conjunction with the sub seat pan creates a functional system between the user's body and the exoskeleton orthotic seating apparatus 2950. This symbiotic functional system between the body and the exoskeleton attributes of the seating apparatus 2950 integrated with the sub seat pan forms a kinematic system of sitting. In one example, while the pelvis is cradled and held in the center of gravity balance equilibrium point, the upper body weight moves down through the pelvis, then through the muscle tissues. The muscle tissue being held this way distributes the weight evenly into the total surface of the exoskeleton seating apparatus 2950 as shown by the up/down arrows shown in FIGS. 29A-B and D. The exoskeleton seating apparatus 2950 then transfers this weight and pressure into the sub seat pan of the chair 2510 and cushion 2910. Because of this transfer of pressures to the bottom surface of the foundation members, a unique event occurs. The exoskeleton seating apparatus 2950 becomes an exoskeleton shell.

In one implementation, there is a mirrored positive action because of the exoskeleton effect. The same muscle tissues that transfers the upper body weight downward (shown by the downward arrows) into the apparatus evenly applies pressure up into the pelvis bones (shown by the upward arrows). The muscle tissue evenly distributes pressure no matter what the roll, lean, rotation or slump of a user, i.e., of all potential ranges of motion of the pelvis of a sitting person. This evenly applied pressure up into the pelvis bones is what assists to float the pelvis without putting pressure on the many tuberous places of the pelvic bones.

In one example, the angle of the seating apparatus 2950 is parallel to the angle base of the ischeal tuberosities B-B and is parallel to the angle C-C of the upper pelvis and hip sockets. In one implementation, it is important to understand that the relationship between transferring upper body weight down through the pelvic bones into the muscle tissue evenly into the orthotic seating apparatus 2950 has a "mirrored relationship" back up through the cupped muscles and pelvic bones. Because the upper body weight is carried evenly through the pelvis and muscle tissue, it holds the pelvic bones evenly back up through the entire pelvis. Because the pelvis is being held at its bottom with inward cradling, so as not to allow pelvic bone spreading outward, (see FIG. 10D for reference) the pressures that emanate upwardly from the seating apparatus 2950 that are being held evenly around the entire lower pelvic structure are substantially decreased by the evenly distributed pressures into the exoskeleton attributes of the seating apparatus 2950.

In one example, acting as an active orthotic area of the seat pan, the seating apparatus 2950 distributes the weight and pressure from the user into the static seat pan. The seating surface's secondary portion of the dual seat pan carries the greatest pressures, not the surface of the human skin. Once the soft tissues have been cupped and the pelvis has been cradled and rotated forward, stabilization occurs. Once the stabilization occurs, the center of gravity point is established and all body weight is transferred from the bones through the soft tissues and into the seating apparatus 2950. In one example, the seating apparatus 2950 acts as a bowl and distributes the weight evenly throughout the pelvic bones. In one implementation, the ischeal tuberosities are always perpendicular to the seating apparatus 2950 angle, which keeps the angles perpendicular throughout the pelvis and hip sockets. When the body moves, the seating apparatus 2950 maintains the distribution of the weight through its exoskeleton shell.

In one example, because muscle tissue is 70% water and fat tissue is 35% water, human skin acts much like a latex balloon filled with water. In this example, imagine that a large water balloon is placed in a bowl. The water balloon is large enough to fill and overflow the bowl. Now imagine pressing down on the water balloon in the bowl. As the balloon is pressed down, the balloon presses back against one's fists surrounding them filling in any gaps. This is because the balloon is held against the sides of the bowl and the balloon can stretch and fill, searching for any place where there is no pressure or hard surface (i.e., least resistance). The pressure of the fists pushing into the water balloon is transferred into the balloon skin, which in turn transfers the pressure into the bowl. In this example, the distribution of pressure around the water balloon is evenly distributed into the bowl. Because a human's muscles and fat tissues are predominately water, they are very similar to the water balloon example. Human skin acts similar to a latex balloon. In one implementation, when a user sits in the "bowl like" seating apparatus 2950, the muscle tissues fill the bowl and the sitting bones are much like the pressure of the fists filling the bowl. This is similar to the ischial tuberosities pushing down into the muscle and soft tissues into the bowl-like seating apparatus 2950. Because the water filled muscle and fat tissue fills the bowl of the seating apparatus 2950 and the ischial tuberosities are suspended in the muscle tissue so that the upper body weight is transferred through watery muscle tissues and into the skin. The "balloon like" skin transfers the pressure into the seating apparatus 2950. Thus the seating apparatus 2950 becomes an exoskeleton shell. In one example, the exoskeleton shell is integrated with the secondary seat pan; the surface of the seating apparatus 2950 has taken on all the pressure of the upper body and transfers those pressures into the secondary seat pan. All along, the suspended pelvis in a "balloon" of muscle tissue, floats stabilized and cradled.

Figure 30:
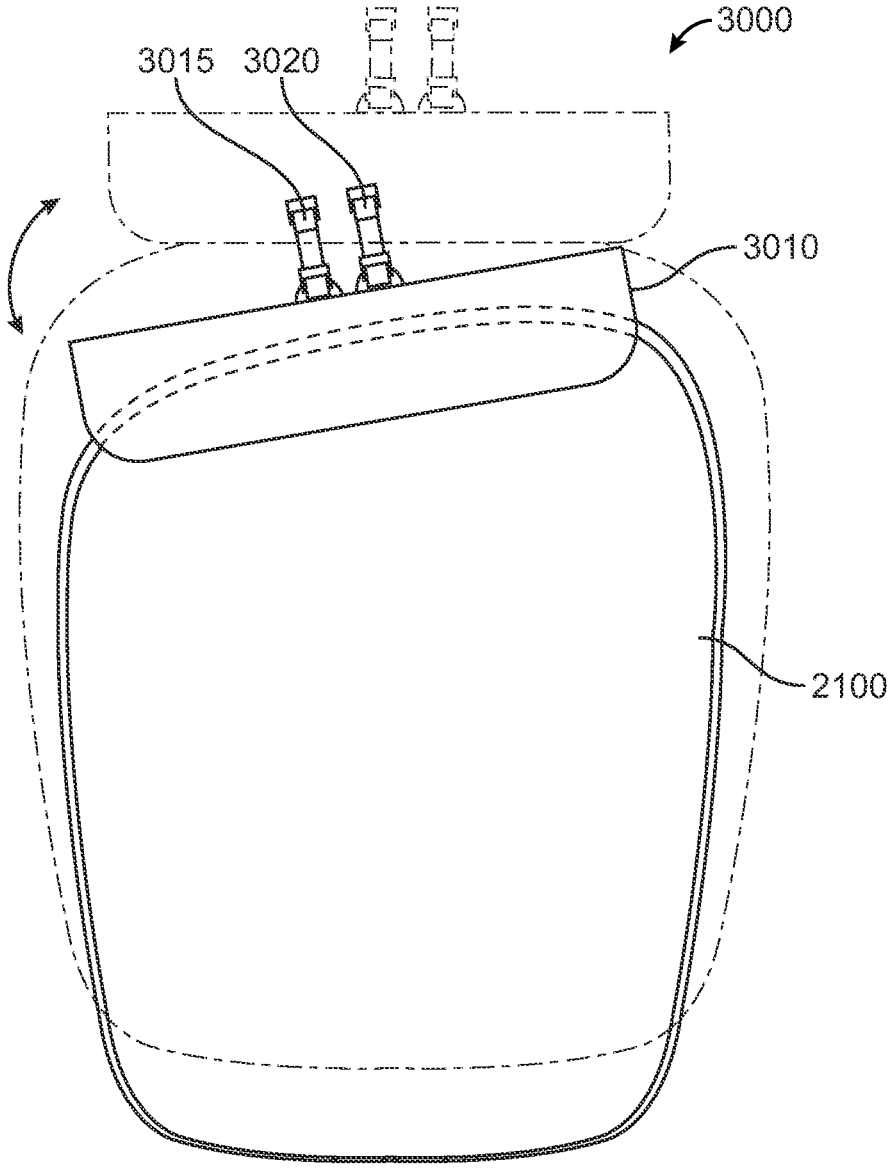
FIG. 30 shows a top view of a seating apparatus including an active orthopedic apparatus and mechanically controllable lumbar support according to one embodiment of the invention.

FIG. 30 shows a top view of a seating system 3000 including an active orthopedic apparatus foundation member 2100, and mechanically controllable lumbar support pad 3010 according to one embodiment of the invention. As illustrated, FIG. 30 shows how the foundation member 2100, when responding to a person's twisting and flexing, causes torsioning of the rear segment of the bowl portion of foundation member 2100. In one example, the lumbar support arms 3015, 3020 are attached on either side of the center line A-A to maintain lumbar support throughout the range of motion while torsion occurs to the bowl portion of foundation member 2100. This unique kinematic design of the lumbar support pad 3010 allows for a range of motion to be significantly expanded compared to typical lumbar support members. In one example, not only does the mechanical aspect of the support arms 3015, 3020 maintain asymmetrical pressure on the lumbar support pad 3010, the lumbar support pad 3010 is applied at a same angle of the users back throughout the user's motion because of the arrangement between the foundation member 2100 that follows the torsion and twist. This allows a person sitting on a chair including the foundation member 2100 to no longer have to rotate against the chair as with a typical chair, but instead the user can move in conjunction with the seat pan and the lumbar support pad 3100 follows and maintains support. In one example, the support arms 3015, 3020 include multiple segments and universal joints. In another embodiment the support arms 3015, 3020 include pneumatic pistons, shock absorbers, etc. In one example, the lumbar support pad 3010 has dimensions in the range of 5-12 inches in width, 10-12 inches in length, and 3-4 inches in height. It should be noted in other embodiments, other lengths, widths and heights are employed for the lumbar support pad 3010 based on the targeted user (e.g., children, adults, athletes, etc.). In one example, the support arms 3015, 3020 have dimensions that range from 4-12 inches in length, and ½-1 inch in diameter. It should be noted in other embodiments, other lengths and diameters are employed for the support arms 3015, 3020 based on the targeted user (e.g., children, adults, athletes, etc.).

Figure 31:
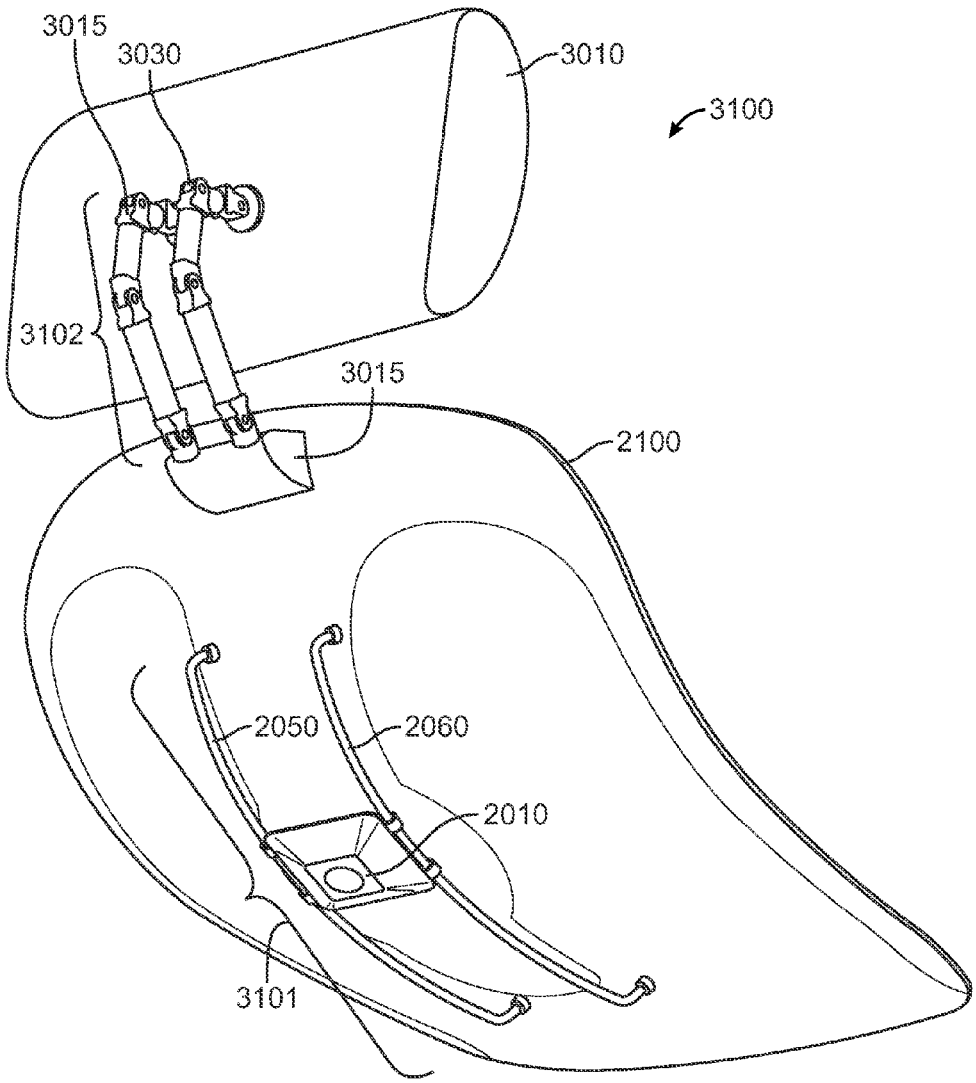
FIG. 31 shows a bottom perspective view of a seating apparatus including an active orthopedic apparatus and motion track system and mechanically controllable lumbar support according to one embodiment of the invention.

FIG. 31 shows a bottom perspective view of a seating apparatus 3100 including a seating apparatus 2400 (dynamic active seat pan and orthopedic orthotic), motion track system 3101, and mechanically controllable lumbar support system 3102, according to one embodiment of the invention. In this embodiment of the invention, the active orthopedic orthotic seating apparatus 2400 is coupled with the tracks, including first track 2050 and second track 2060, cart 2010, and the mechanical lumbar support system 3102, including arms 3015, 3020, the lumbar pad 3010, and seating apparatus coupling portion 3105.

A typical lumbar support can only be positioned to certain places against the lower back and can be adjusted in some manner to become larger by means, such as an inflatable bladder or a spring ratcheting that requires manual twisting of a knob. In one embodiment of the invention, the lumbar support pad 3010 has relationship to the orthotic foundation member 2100, so as the foundation member 2100 twists and turns on its axis, the lumbar support pad 3010 maintains its position with the lower spine as a person moves. In one example, the lumbar support arms 3015, 3020 are mechanical devices, such as pistons, pneumatic pistons, chains, cabling, etc., and continually apply pressure to a seated person's lower back regardless of how a person desires to move around or lean forward in the seating apparatus 3100.

In one example, FIG. 31 shows two support arms 3015 and 3020 to support the lumbar pad 3010. In this example, due to the two support arms 3015 and 3020, an asymmetrical support system is created when a person sitting in the seating apparatus 3100 twists and leans (e.g., lean to the left or right side), and the support arms 3015 and 3020 will respond differently to the pressure on their given side of lumbar pad 3010. In this example, asymmetrical support is always maintained at a 90° angle to the line of the top of a person's pelvis. In one example, because the two support arms 3015 and 3020 are attached to the back of the orthotic foundation member 2100, when a person twists or turns the support arms 3015 and 3020 follow to the left or right and allow for a three-dimensional range of motion for the lumbar support pad 3010.

Figure 32A:
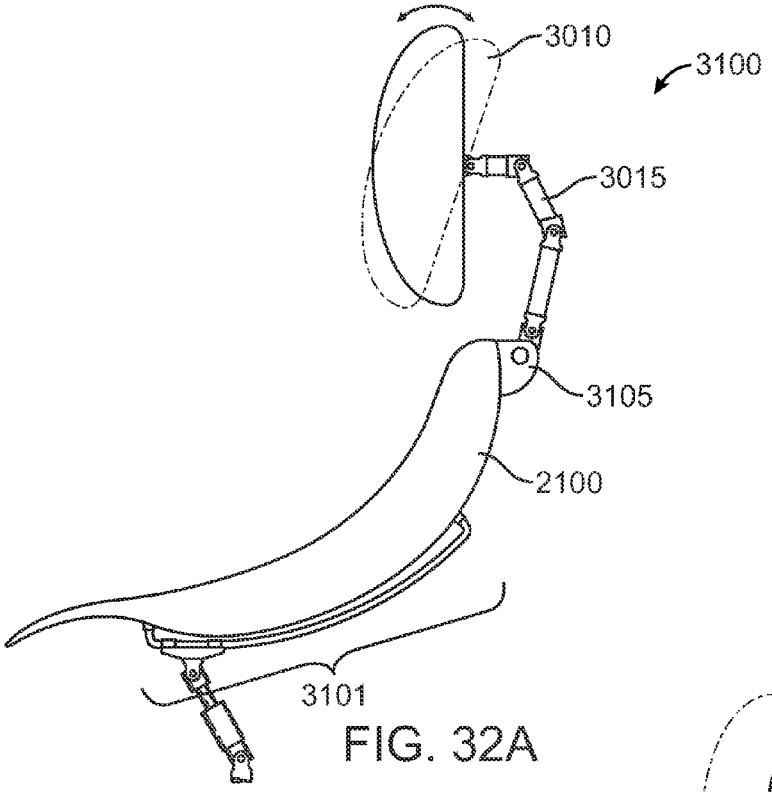
FIG. 32A shows a side view of a seating apparatus including an active orthopedic apparatus, motion track system and mechanically controllable lumbar support showing direction of motion according to another embodiment of the invention.
Figure 32B:
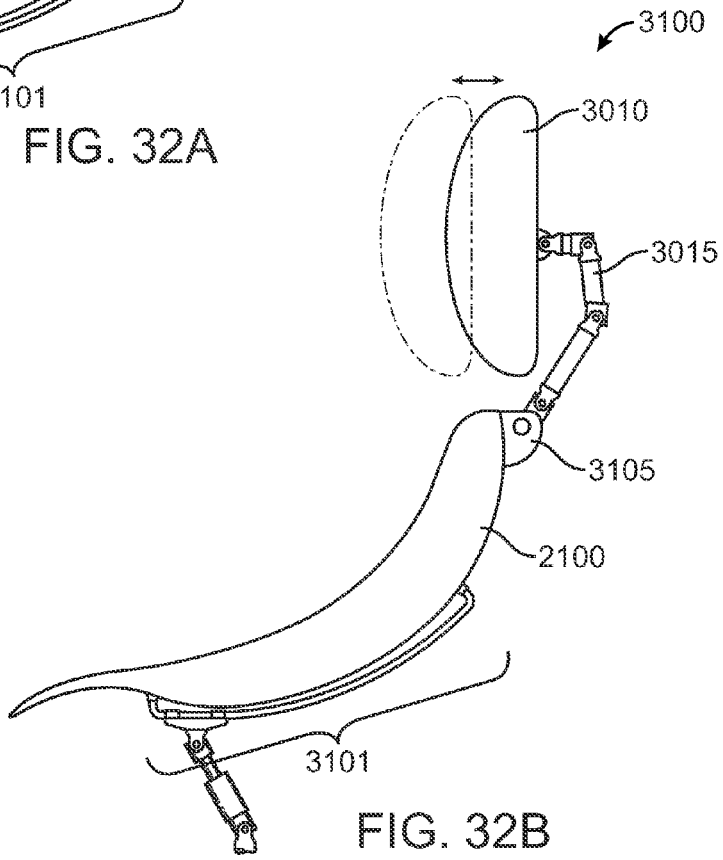
FIG. 32B shows a side view of a seating apparatus including an active orthopedic apparatus, motion track system and mechanically controllable lumbar support showing direction of motion according to another embodiment of the invention.

FIG. 32A shows a side view of a seating apparatus 3100 including an active orthopedic apparatus foundation member 2100, motion track system 3101, and mechanically controllable lumbar support pad 3010 shown with vertical angular adjustment according to one embodiment of the invention. FIG. 32B shows a side view of the seating apparatus 3100 including an active orthopedic apparatus foundation member 2100, motion track system 3101, and mechanically controllable lumbar support pad 3010 shown with forward/backward adjustment according to another embodiment of the invention. In one example, due to the universal rotating joints, the lumbar support pad 3010 may tilt sideways, move in and out, and rotate up/down and side-to-side. As a person moves, such as twisting and turning, on the foundation member 2100, the lumbar support arms 3015 and 3020 react to apply pressure for support to the lower lumbar region with a smooth three-dimensional motion with one another. In this example, the lumbar support always applies a counter pressure to the natural pattern of movement for maintaining application of additional support to maintain forward lordosis.

Figure 33A:
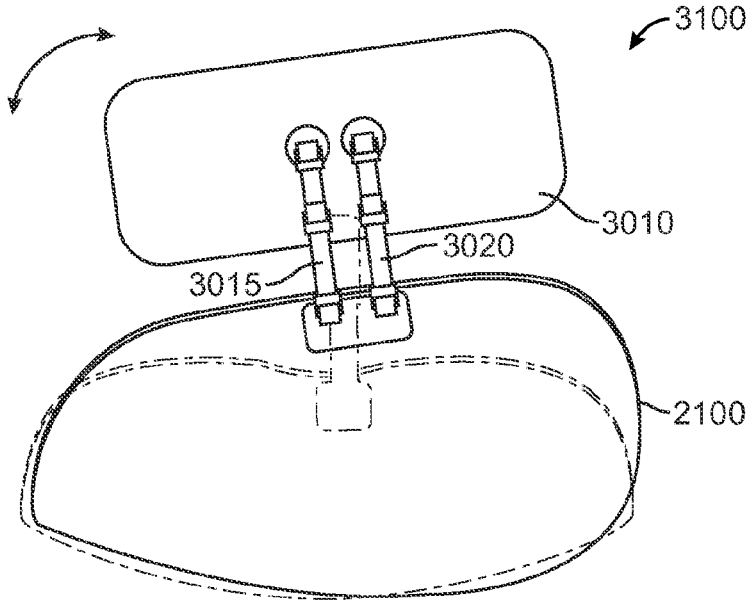
FIG. 33A shows a rear view of a seating apparatus including an active orthopedic apparatus and mechanically controllable lumbar support shown integrated with a seating apparatus shown reacting to a user's movement in a first position according to one embodiment of the invention.
Figure 33B:
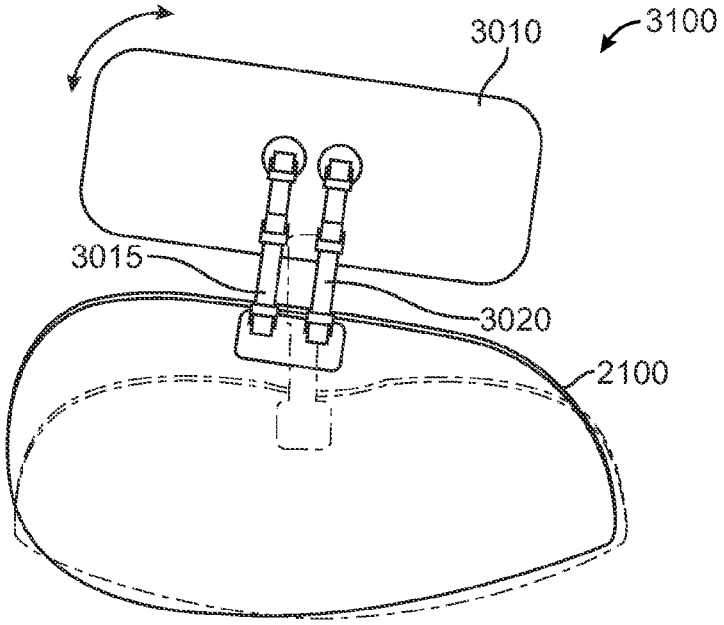
FIG. 33B shows a rear view of a seating apparatus including an active orthopedic apparatus and mechanically controllable lumbar support shown integrated with a seating apparatus shown reacting to a user's movement in a second position according to one embodiment of the invention.

FIG. 33A shows a rear view of a seating apparatus 3100 including an active orthopedic apparatus foundation member 2100, motion track system 3101, and mechanically controllable lumbar support pad 3010, shown in a first position, according to one embodiment of the invention. This illustration shows the foundation member 2100 and lumbar support 2100 conforming as a person moves when seated on the seating apparatus 3100 in a first direction. FIG. 33B shows a rear view of the seating apparatus 3100 including an active orthopedic apparatus foundation member 2100, motion track system, and mechanically controllable lumbar support pad 3010 shown as a person moves when seated on the seating apparatus 3100 in the opposite direction as shown in FIG. 33A.

Figure 34A:
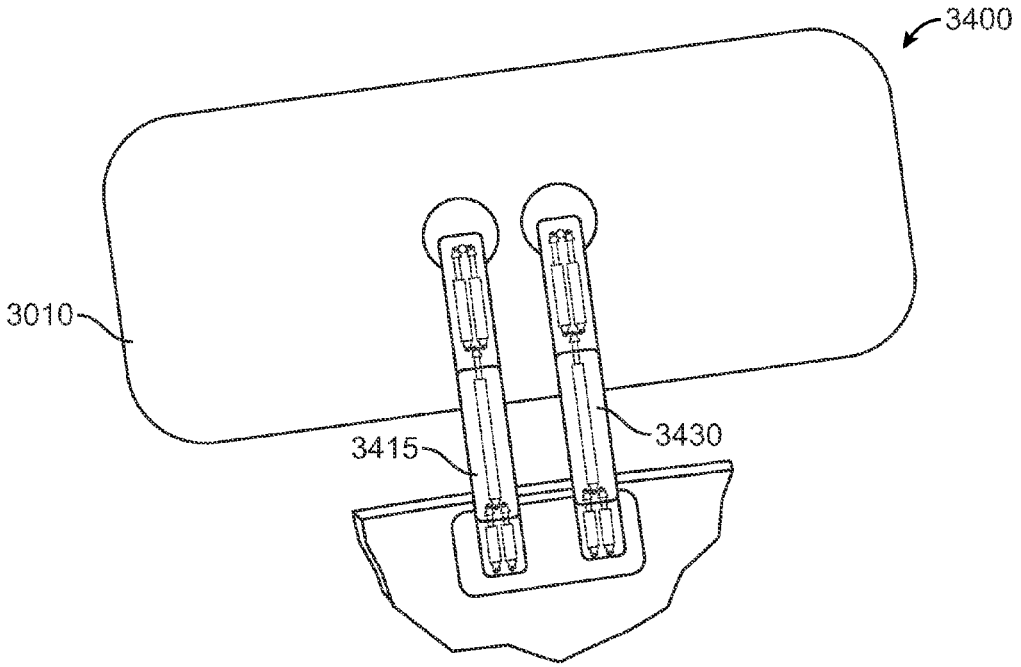
FIG. 34A shows a rear view of a mechanically controllable lumbar support according to one embodiment of the invention.
Figure 34B:
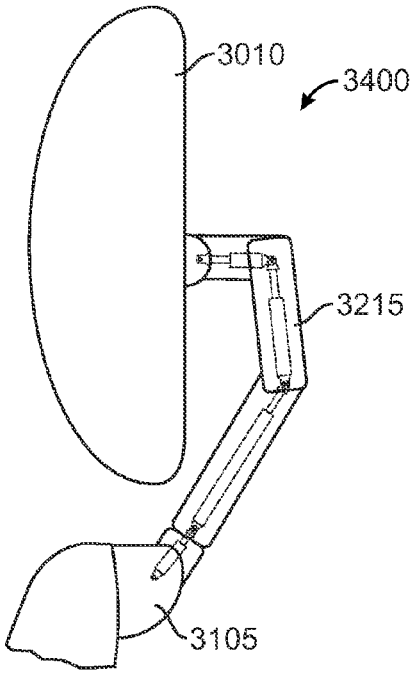
FIG. 34B shows a rear view of a mechanically controllable lumbar support according to one embodiment of the invention.

FIG. 34A shows a rear view of a mechanically controllable lumbar support system 3400 according to another embodiment of the invention. FIG. 34B shows a side view of a mechanically controllable lumbar support system 3400. In one example, the first support arm 3415 and the second support arm 3430 include a combination of pneumatic pistons that are connected together at joints and surrounded with a mechanical body. In one example, the support arms 3415 and 3430 each include three (3) or more (e.g., 4, 5, 6, etc.) pistons and joint connections between the pistons. The sizes of the pistons and joints may vary depending on the targeted user. For example, if the targeted users are adults, the pistons and joints may be larger than when the targeted users are children. In one embodiment of the invention, further mechanical levering and or pistons may be enhanced by other materials, such as temperature sensitive, shape memory, hydraulic, pneumatic, etc. "embedded intelligence." In these embodiments of the invention, the inherent properties of the materials themselves will respond and adapt to the individuals unique requirements.

Figure 35A:
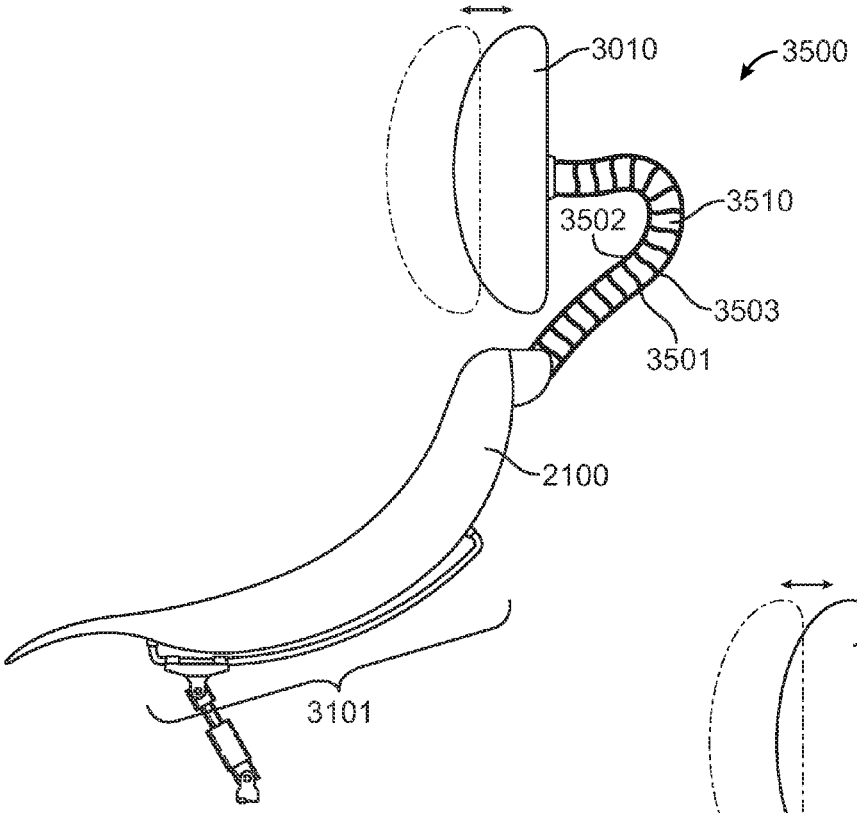
FIG. 35A shows a side view of a seating apparatus integrated with a-memory retentive lumbar support pad with an arm shown in a first position according to one embodiment of the invention.
Figure 35B:
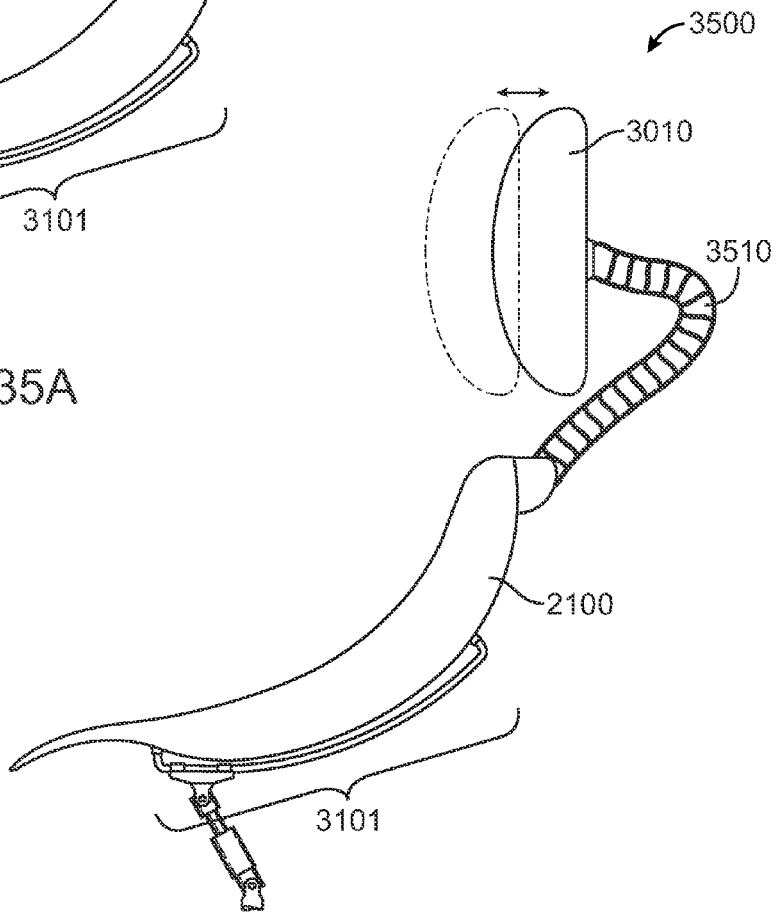
FIG. 35B shows a side view of a seating apparatus integrated with a memory retentive lumbar support pad with an arm shown in another position according to one embodiment of the invention.

FIGS. 35A-B show a side view of a seating apparatus 3500 including an active orthopedic apparatus foundation member 2100, motion track system 3101, and memory retentive lumbar support pad 3010 according to one embodiment of the invention. As illustrated, the lumbar support pad 3010 is connected to the memory-retentive, controlled lumbar support arms 3510. In one example, the support arm 3510 is molded in a specific first shape and given its structure and design so that it would not only bend under applied pressures, but move forward against those pressures. In one example, the memory retentive "living" support arms 3510 include two walls 3501, 3502 running somewhat parallel to one another, with cross members 3503 arranged somewhat evenly between them. In one example, the cross members 3503 each have a pseudo "S" shape that gives them the ability to withstand pressure and respond to pressure as the two parallel bars respond to pressure. The shape of the interior cross members 3503 flex upon attempting to return to their original shapes. This gives the lumbar support arms 3510 the ability to continually apply pressure back against the lower lumbar region of a user's spine that is seated in the seating apparatus 3500. FIG. 34A shows the support arm 3510 arranged in a first position, while FIG. 35B shows the support arm 3510 in a second position. In one example, the seating apparatus 3500 includes two support arms 3510. In other examples, the seating apparatus may have one support arm 3510, three supports arms 3510, etc Due to the advancement of materials and manufacturing processes, I foresee that memory-retentive "living" support arms can be further enhanced by materials that will have "embedded intelligence and or information inherent in the materials themselves" that will respond and adapt to the individual's unique requirements. These "embedded intelligence and/or information" do not require mechanical joints to adapt to the individual and further enhance the lumbar support while a person is moving.

Figure 36:
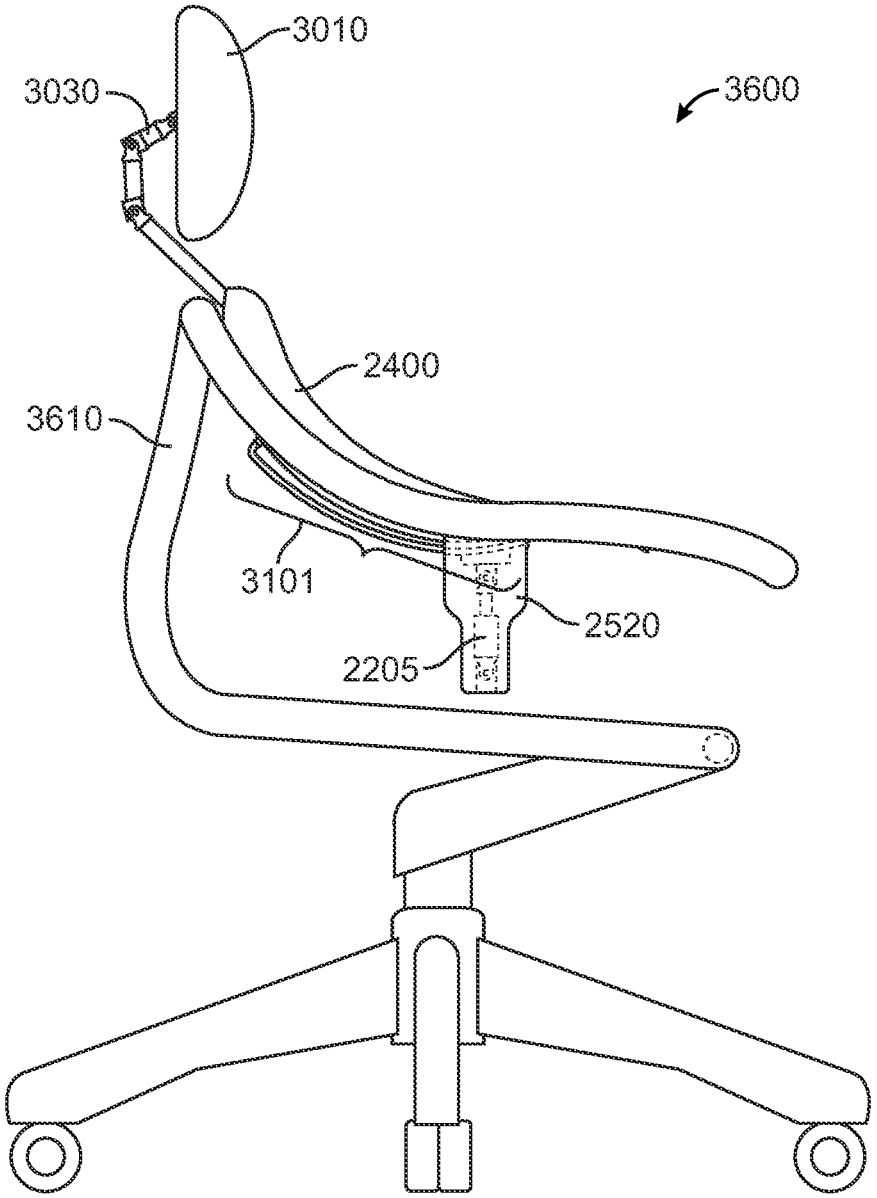
FIG. 36 shows a side view of a seating apparatus including an active orthopedic apparatus, motion track system integrated in a chair/stool apparatus, with a mechanically controllable lumbar support according to one embodiment of the invention.

FIG. 36 shows a side view of a seating apparatus 3600 including an active orthopedic seating apparatus 2400 (dynamic active seat pan and orthopedic orthotic), motion track system 3101 integrated in a trampoline like chair apparatus 3610, and a mechanically controllable lumbar support pad 3010 coupled to the seating apparatus 2400 according to one embodiment of the invention. In one example, the lumbar support pad 3010 adjusts to angles of a person's body to maintain contact with the lower lumbar region. In one example, the chair apparatus 3610 has similar frame and support features as the chair apparatus 2510, as described with other embodiments and examples, with the addition of the lumbar support pad 3010. As illustrated, the seating apparatus 3600 includes an optional fixed attachment plate coupled to a universal joint pneumatic cylinder 2520 and arm 2205 for pneumatically controlled lowering.

Figure 37A:
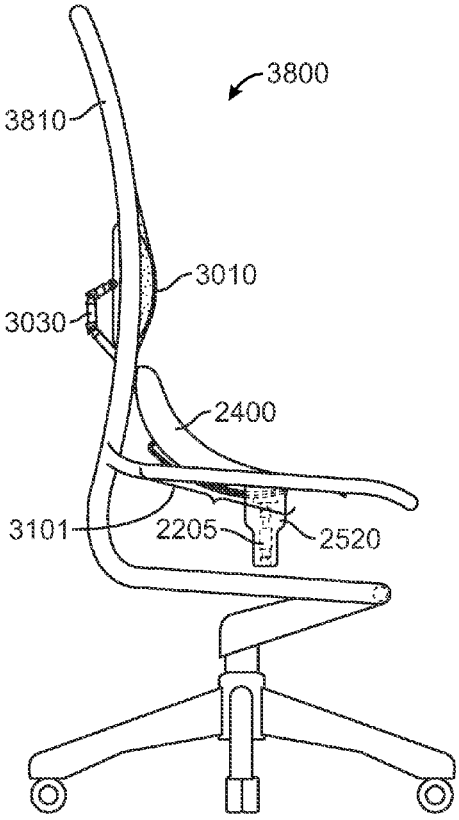
FIG. 37A shows a side view of a seating apparatus including an active orthopedic apparatus, motion track system and mechanically controllable lumbar support integrated in a trampoline like chair apparatus according to one embodiment of the invention.
Figure 37B:
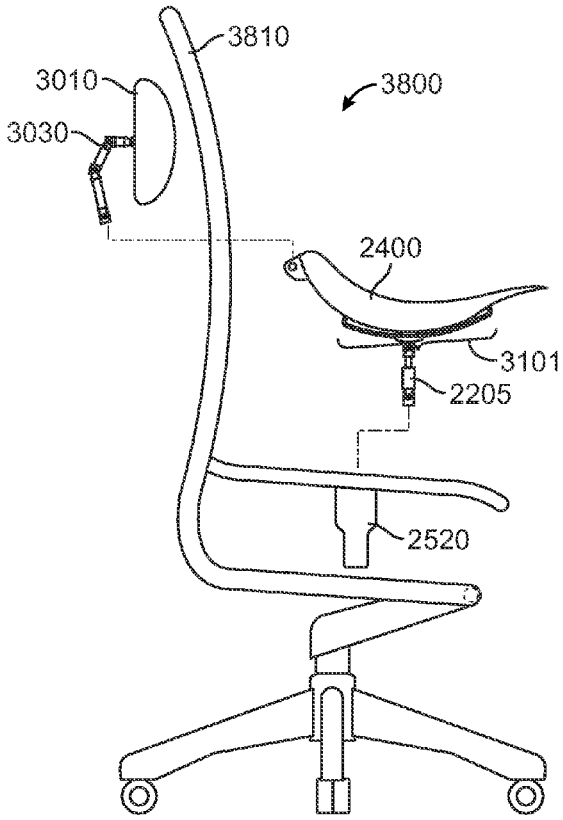
FIG. 37B shows an exploded side view of the apparatus shown in FIG. 37A.

FIG. 37A shows a side view of a seating apparatus 3800 including an active orthopedic seating apparatus 2400, motion track system 3101, and mechanically controllable lumbar support pad 3010 integrated in a trampoline-like chair apparatus 3810 having a high back, according to one embodiment of the invention. FIG. 37B shows an exploded side view of the apparatus shown in FIG. 37A. In one example, the chair apparatus 3810 is an ergonomic workstation chair. In one example, the active orthopedic orthotic seating apparatus 3800 with the roller coaster track system 3101 is attached to a support beam 2610 (see FIGS. 38A-B) that attaches to the mainframe of the chair apparatus 3810 and is the contact attachment point for the flexible fabric that is attached to its interior and entire orthotic apparatus's circumference, similarly as with the embodiments and examples for system 2500 as previously described. In one example, the lumbar support pad 3010 is connected to the active orthopedic seating apparatus 2400 with a mechanical arm 3030 that manipulates the lumbar support pad 3010. In one example, the fabric is covering the lumbar support pad 3010 is very flexible so that the lumbar support 3010 can push through the fabric to maintain an asymmetrical lower lumbar support member.

Figure 38A:
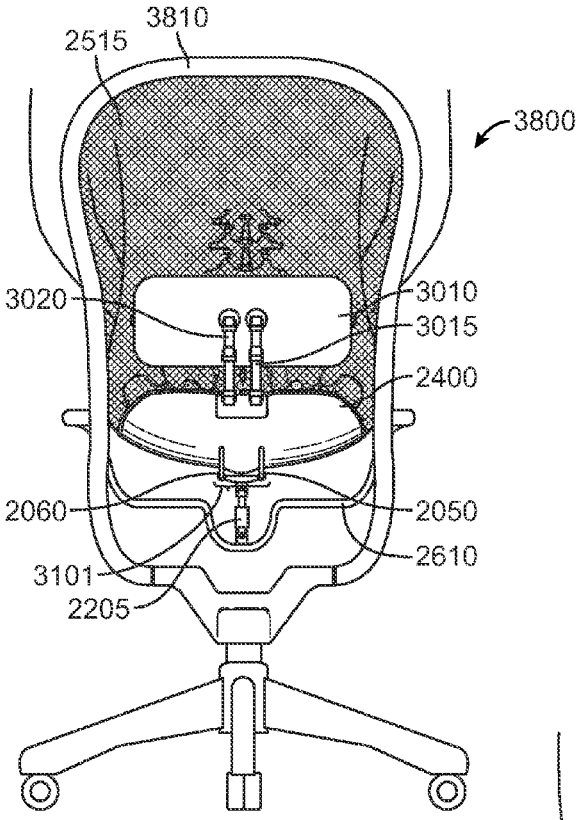
FIG. 38A shows a rear view of a seating apparatus including an active orthopedic apparatus, motion track system and mechanically controllable lumbar support integrated in a trampoline like chair apparatus showing a human anatomy in one position according to one embodiment of the invention.
Figure 38B:
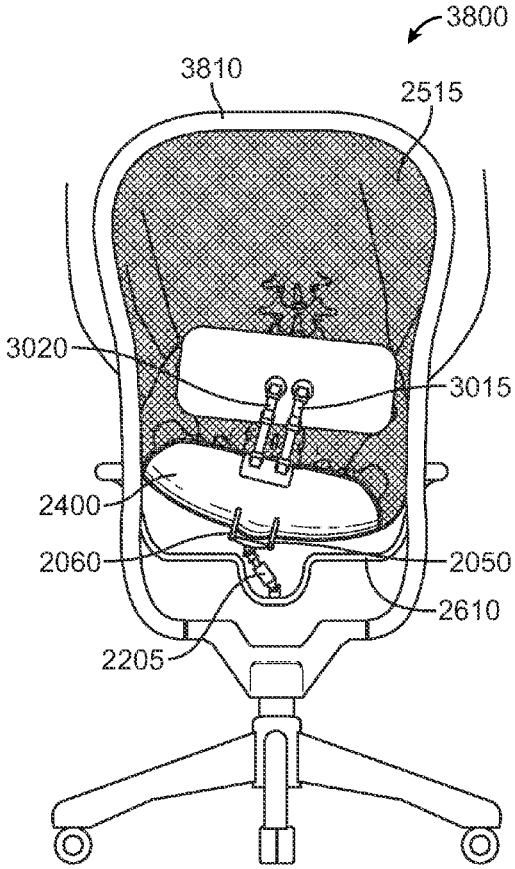
FIG. 38B shows a rear view of a seating apparatus including an active orthopedic apparatus, motion track system and mechanically controllable lumbar support integrated in a trampoline like chair apparatus showing a human anatomy in another position according to one embodiment of the invention.

FIG. 38A shows a rear view of a seating apparatus 3800 including an active orthopedic seating apparatus 2400, motion track system 3101 and mechanically controllable lumbar support pad 3010 integrated in a trampoline like chair apparatus 3810 showing a human anatomy 2515 in a first position according to one embodiment of the invention. FIG. 38B shows a rear view of the seating apparatus of FIG. 38B showing the human anatomy 2515 in a second position. In one example, whether a user seated in a seating system 3800 twists to the left or right, the orthotic foundation member 2405 of the seating apparatus 2400 not only responds to the twisting of the user while sitting, the foundation member 2405 flexes causing torsioning of the rear segment of the bowl portion, such that upward and inward motion of the upper edges of the rear and lateral segments of the bowl portion of the foundation member 2405 follow the twisting of the users lower pelvic area for applying an upward and inward compressive force to cause a forward rotational tilt of the users lower pelvic area into a lordotic position while maintaining the bowl portion in the second position with essentially consistent dynamic pelvic area support. In the second position, the user's center of gravity shifts forward away from the sacrum onto the tips of the ischial tuberosities of the user's lower pelvic area. While the shifting is occurring, the lumbar support arms 3015, 3020 move along with the torsioning of the foundation member 2405 to maintain a tilt of the pelvis and a rotation of the pelvis. This example, therefore, maintains of tilt of the rotation of the pelvis and continual forward asymmetrical pressure upon the lower lumbar.

Figure 39A:
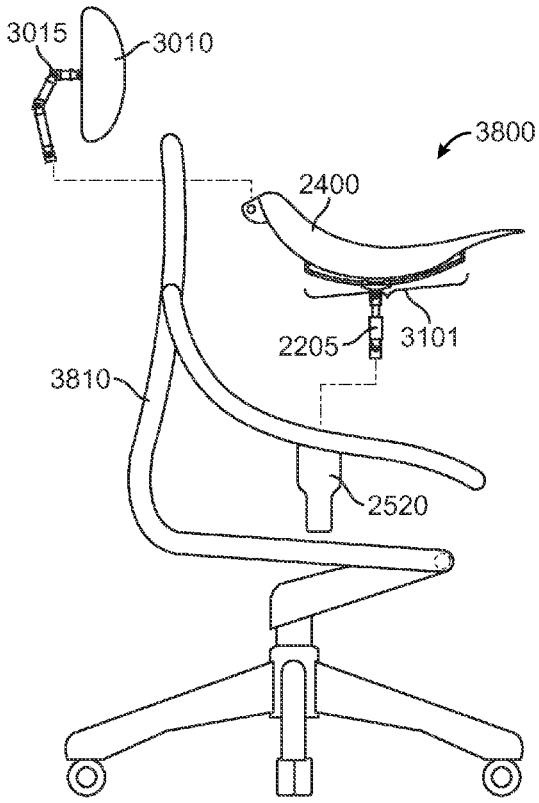
FIG. 39A shows an exploded side view of a seating apparatus including an active orthopedic apparatus, motion track system and mechanically controllable lumbar support integrated in another trampoline like chair apparatus according to one embodiment of the invention.
Figure 39B:
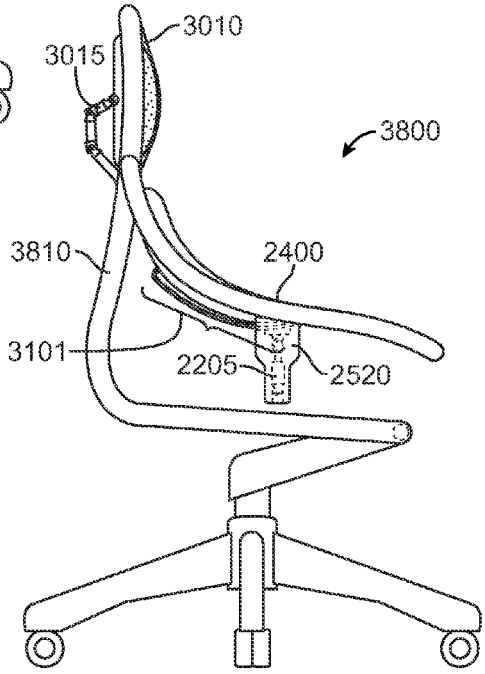
FIG. 39B shows an integrated side view of the apparatus shown in FIG. 39A.

FIG. 39A shows an exploded side view of a chair system 3800 including an active orthopedic seating apparatus 2400, motion track system 3101, and mechanically controllable lumbar support pad 3010 integrated in another trampoline-like chair apparatus 3810 according to one embodiment of the invention. FIG. 39B shows an integrated side view of the system 3800 shown in FIG. 39A. As shown, the chair system 3800 includes a lower back portion than the chair system shown in FIGS. 37A-B. FIG. 39A shows a first position of the seating apparatus 2400 where no weight would be born by the system 3800. FIG. 39B shows the seating apparatus 2400 in a second position where a user's weight is born tipping the front section 101 down and moving the cart 2010 over the first track 2050 and second track 2060 and using the universal joint pneumatic cylinder 2520 and arm 2205 for pneumatically controlled lowering.

Figure 40A:
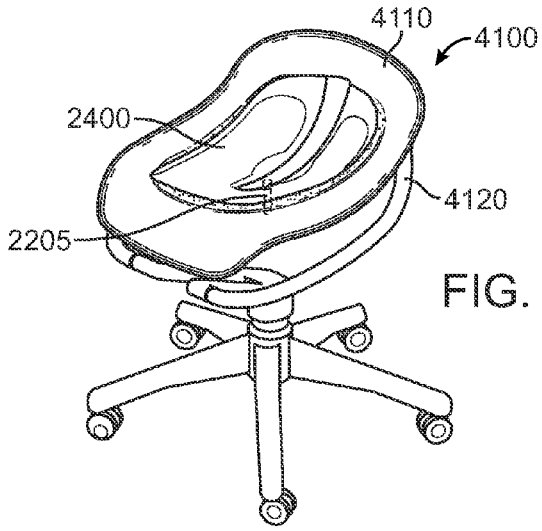
FIG. 40A shows a perspective view of a seating apparatus including an active orthopedic apparatus and motion track system integrated in a cushion and chair apparatus according to one embodiment of the invention.

FIG. 40A shows a perspective view of a seating system 4100 including an active orthopedic seating apparatus 2400 (without a motion track system) integrated in a cushion 4110 and chair apparatus 4120, according to one embodiment of the invention. In one example, the foam's contour is molded specifically to accept the seating apparatus 2400 including the active orthotic foundation member 2405, by molding the foam's 4110 contour to have transitional points that are less dramatic than if it were a portable embodiment (i.e., seating apparatus 2400 by itself). In this example, the foam 4110 is contoured to have a depression that matches the shape of the orthotic seating apparatus 2400. One embodiment of the invention includes a fixed universal and pneumatic joint 2205 that attaches at the E-E equilibrium balance point (see FIG. 18*a* for reference). In one example, a space 4101 (see FIG. 40D) is allowed in the foam 4110 to allow the attachment of the fixed universal and pneumatic joint 2205 to move freely.

Figure 40B:
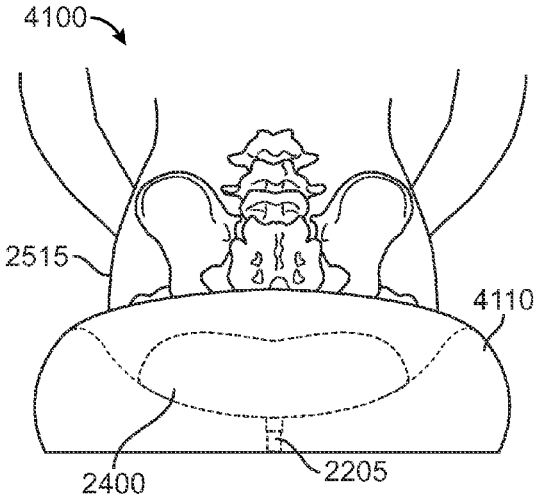
FIG. 40B shows a rear view of a seating apparatus including an active orthopedic apparatus integrated in a cushion, showing a human anatomy in one position according to one embodiment of the invention.
Figure 40C:
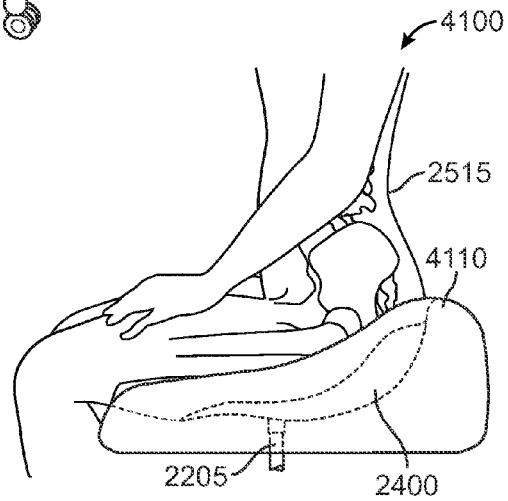
FIG. 40C shows a side view of the seating apparatus shown in FIG. 40B.
Figure 40D:
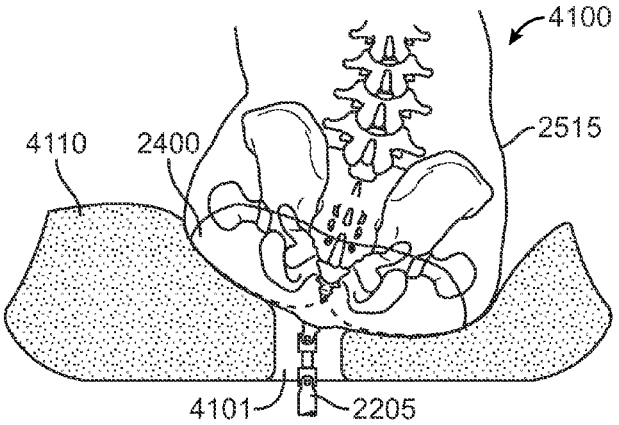
FIG. 40D shows a rear view of a seating apparatus including an active orthopedic apparatus integrated in a cushion, showing a human anatomy in another position according to one embodiment of the invention.

FIG. 40B shows a rear view of the seating system 4100 including an active orthopedic seating apparatus 2400 integrated in a cushion 4110, showing a human anatomy 2515 in a first position according to one embodiment of the invention. This example shows a person (human anatomy 2515) sitting in an upright position, balanced naturally, without any upper body movement. FIG. 40C shows a side view of the seating system 4100 shown in FIG. 41B. FIG. 40D shows a rear view of the seating system 4100 including an active orthopedic seating apparatus 2400 integrated in a cushion 4110, showing a human anatomy 2515 in a second position, according to one embodiment of the invention.

In one example, the sub-seat pan cushion 4110 is made from foam or other soft cushion materials. In another example, the cushion 4110 may be an air bladder(s), a number of semi-rigid materials, such as a resilient plastic foam from which the support of the sub seat pan is formed from, for example, a matrix of polypropylene, polyurethane, polyethylene, other plastic bead materials, etc., which have been adhered together during a molding process.

In one embodiment of the invention, it can be observed that in this cross section view it is evident that the sideways tilt of the user 2515 and the implementation of the fixed universal and pneumatic joint 2205 allows the orthotic foundation member 2405 to rotate on the axis that attaches at the E-E equilibrium balance point (see FIG. 18*a* for reference). In one example, the soft foam 4110 gives way to the upper body pressure, which allows the orthotic foundation member 2405 of the seating apparatus 2400 to move in any direction, and does not inhibit its functional aspects.

Figure 41A:
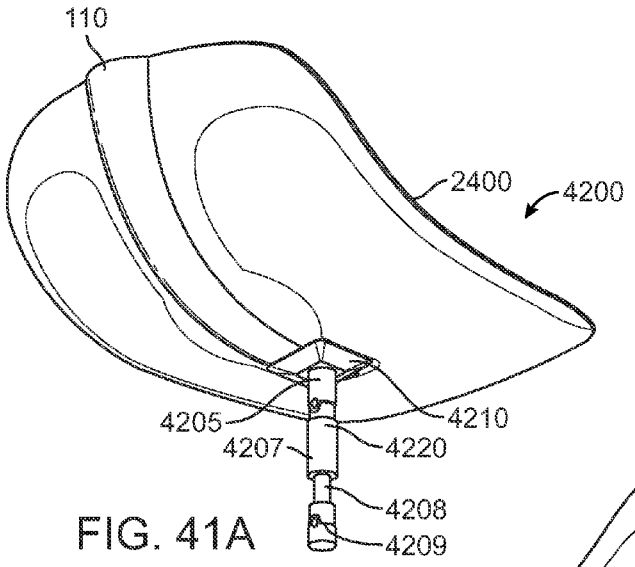
FIG. 41A shows a bottom perspective view of a seating apparatus including an active orthopedic apparatus and equilibrium balance point system according to one embodiment of the invention.

FIG. 41A shows a bottom perspective view of a seating system 4200 including an active orthopedic seating apparatus 2400 and fixed universal and pneumatic joint 4220 according to one embodiment of the invention. In one example, the universal and pneumatic joint 4220 is fixedly connected by a joint 4205 to a fixed cart 4210 that is connected to the seating apparatus 2400. In one implementation, the universal and pneumatic joint 4220 includes the joint 4205, cylinder 4207, cylinder rod 4208, and second joint 4209. In one example, the universal and pneumatic joint 4220 adjusts by pivoting of the joints 205 and 4209, and expansion/contraction of the cylinder 4207 and cylinder rod 4208, as the seating apparatus contours due to a person's movement. In this example, the base of the cylinder rod 4208 is connected to the second joint 4209.

Figure 41B:
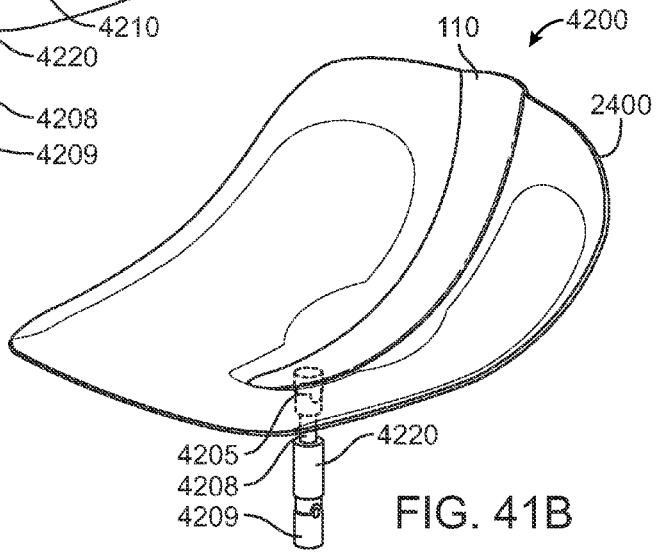
FIG. 41B shows a top view of a seating apparatus including an active orthopedic apparatus and equilibrium balance point system according to another embodiment of the invention.

FIG. 41B shows a top perspective view of a seating system 4200 including an active orthopedic seating apparatus 2400 and alternate fixed universal and pneumatic joint 4220, according to another embodiment of the invention. In one example, the universal and pneumatic joint 4220 is fixedly connected by a joint 4205 to a fixed cart 4210 that is connected to the seating apparatus 2400. In one implementation, the universal and pneumatic joint 4220 includes the first joint 4205, cylinder 4207, cylinder rod 4208 and second joint 4209. In one example, the universal and pneumatic joint 4220 adjusts by pivoting of the first joint 4205 and second joint 4209, and expansion/contraction of the cylinder 4207 and cylinder rod 4208, as the seating apparatus contours due to a person's movement. In this example, the base of the cylinder rod 4208 is connected to the first joint 4205.

Figure 41C:
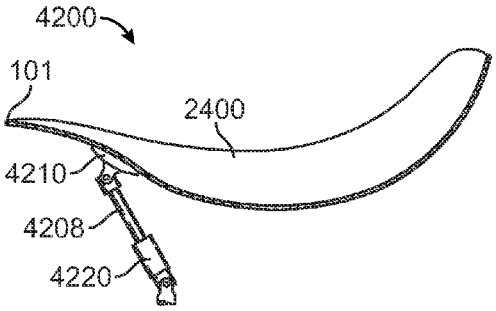
FIG. 41C shows a side view of a seating apparatus including an active orthopedic apparatus and equilibrium balance point system shown in one position according to one embodiment of the invention.
Figure 41D:
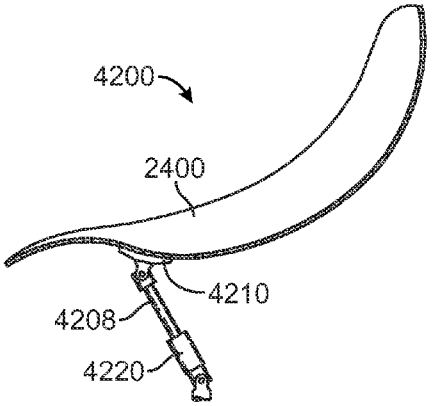
FIG. 41D shows a side view of a seating apparatus including an active orthopedic apparatus and equilibrium balance point system shown in another position according to one embodiment of the invention.

FIG. 41C shows a side view of a seating system 4200 including an active orthopedic seating apparatus 2400 and fixed universal and pneumatic joint 4220 shown in a first position without any user weight borne on the seating apparatus 2400. FIG. 41D shows a side view of a seating system 4200 including an active orthopedic seating apparatus 2400 and fixed universal and pneumatic joint 4220 shown in a second position with user weight born on the seating apparatus 2400, showing the tilt of the front section 101.

Figure 42:
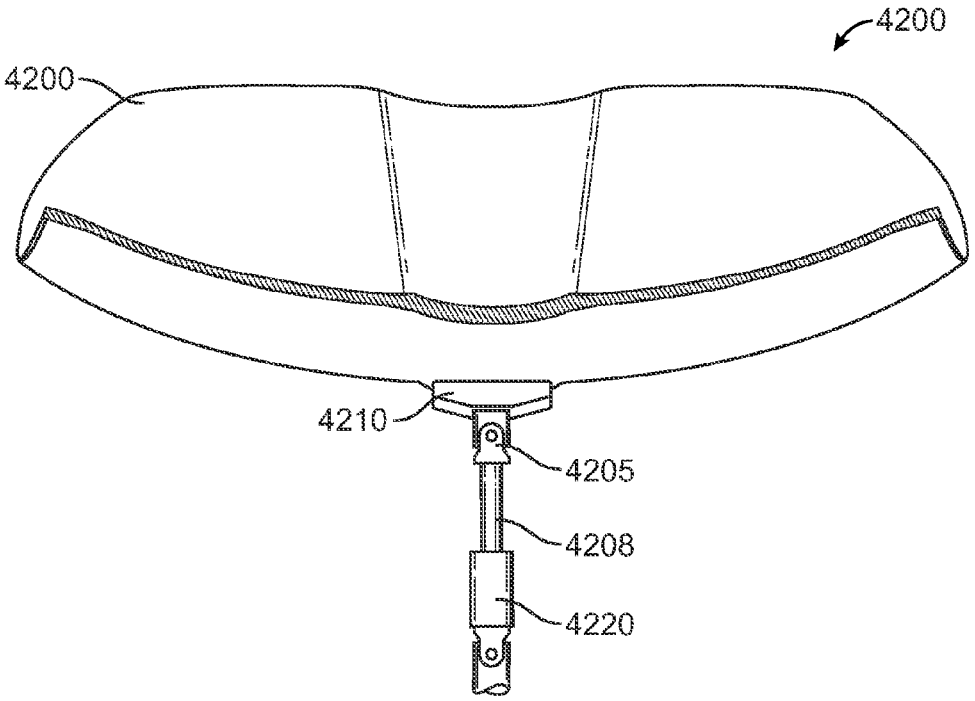
FIG. 42 shows a rear cross-sectional view of a seating apparatus including an active orthopedic apparatus and equilibrium balance point system according to one embodiment of the invention.

FIG. 42 shows a cross-sectional front view of the seating system 4200 including an active orthopedic seating apparatus 2400 and fixed universal and pneumatic joint 4220.

Figure 43A:
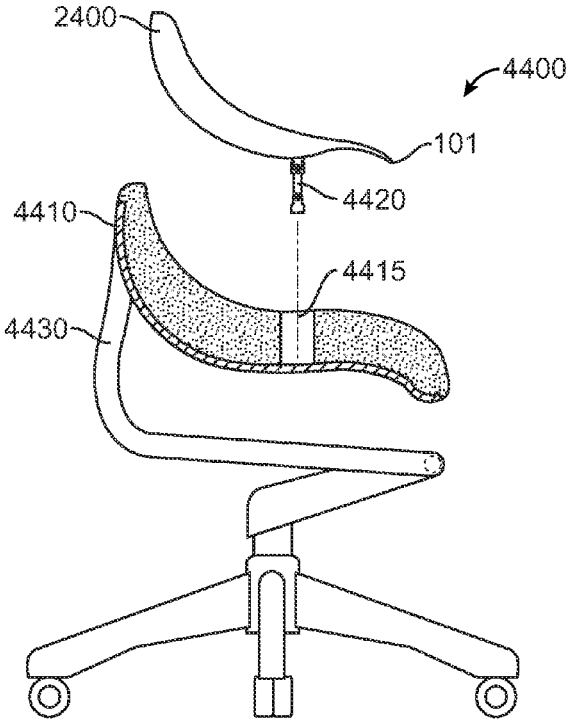
FIG. 43A shows an exploded side view of a seating apparatus including an active orthopedic apparatus and equilibrium balance point system integrated in a cushion of a chair apparatus according to one embodiment of the invention.
Figure 44A:
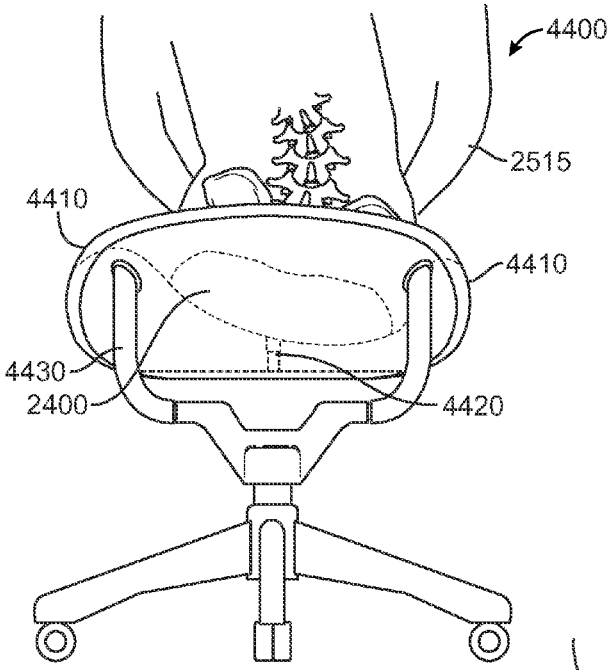
Figure 44B:
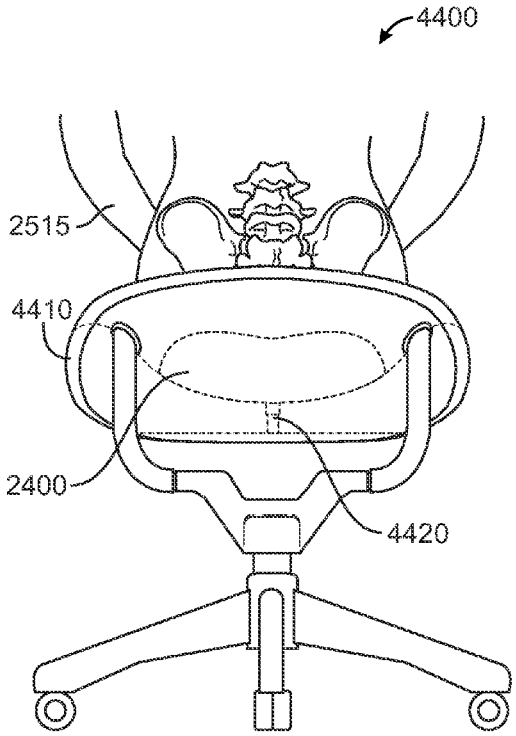

FIG. 43A shows an exploded side view of a seating system 4400 including an active orthopedic seating apparatus 2400 and equilibrium balance point system integrated in a cushion 4410 of a chair/stool apparatus 4430 according to one embodiment of the invention. FIG. 44B shows an integrated side view of the seating apparatus shown in FIG. 44A shown in a first position without weight of a user being born on the seating apparatus 2400. FIG. 44C shows an integrated side view of the seating apparatus shown in FIG. 44A shown in a second position with a user's weight being born by the seating apparatus 2400, showing the front section 101 being tilted into the cushion 4410.

Figure 43B:
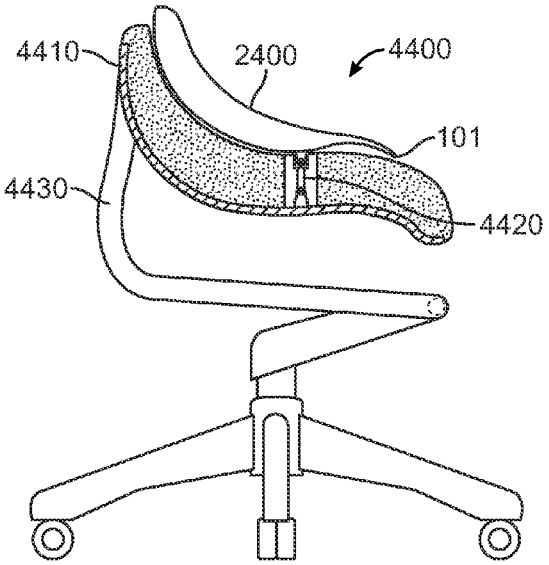
FIG. 43B shows an integrated side view of the seating apparatus shown in FIG. 43A shown in one position according to one embodiment of the invention.
Figure 43C:
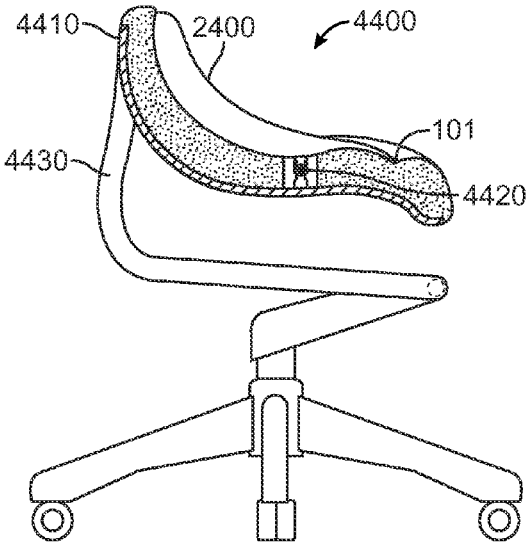
FIG. 43C shows an integrated side view of the seating apparatus shown in FIG. 43A shown in another position according to one embodiment of the invention.

In one example the seating system 4400 includes a foam sub seat pan with the fixed universal and pneumatic joint 4220, which is then adapted to a chair/stool 4430. In this example, the foam 4410 is contoured to accept the shape of the orthotic foundation member 2405 included in the seating apparatus 2400. As shown in FIG. 43B, the fixed universal and pneumatic joint 4220 has lifted the active orthotic seating apparatus 2400 away from its nesting position in the foam 4410 contoured seat pan. In this example, the lifting of the seating apparatus 2400 allows for the user to sit correctly on the seating apparatus and be lowered slowly into the sub-seat pan due to the fixed universal and pneumatic joint 4220 within the virtual cylinder 4415. In one example, to activate the orthotic seating apparatus 2400, a person needs to skootch back into the stool/chair 4430. In this example, the pneumatic levitation "controlled lowering system" provides an easy way for a person to be able to skootch onto the seating apparatus 2400 to achieve this activation movement intuitively. As shown in FIG. 43C, the orthotic seating apparatus 2400 is nestled into the weight bearing position, and the pneumatic virtual cylinder 4415 has allowed the movement via compression. The seating apparatus 2400 floats without restriction on the foam 4410 sub seat pan as an integrated unit.

In one example, the levitated orthotic seating apparatus 2400 shown in FIG. 43B shows a person where to sit on the seat pan correctly and also allows for the fixed universal and pneumatic joint 4220 and the pneumatic virtual cylinder 4415 to slowly lower the pelvis of a user into the soft foam sub seat pan. This controlled lowering system slowly lowers the user's pelvis, which to those with back pain is comfortable way to slow their body when moving from a standing to a seated position. The controlled lowering system also allows a user to skootch back into the chair/stool 4430 with greater efficiency before the body weight of the user completely presses down on the sub-seat pan.

FIG. 44A shows a rear view of a seating system 4400 including an active orthopedic seating apparatus 2400 and equilibrium balance point system integrated in a cushion 4410 of a chair/stool apparatus 4430, showing a human anatomy 2515 in a first position due to twisting of the user, according to one embodiment of the invention. FIG. 45B shows a rear view of the seating system 4400 showing a human anatomy 2515 in a second position when the user is seated upright. In one example, FIGS. 44A-B shows the active orthotic seating apparatus 2400 integrated into a foam 4410 sub seat pan, via molding the foam 4410 specifically to accept the active orthotic seating apparatus 2400 so that the transitional points around the circumference of the orthotic foundation member, such as foundation member 2405, are less dramatic than if the seating apparatus 2400 were a portable embodiment by itself. In one implementation, it is shown that the foam 4410 is contoured to have a depression that matches the shape of the orthotic seating apparatus 2400. In one example, the orthotic seating apparatus 2400 has a fixed pneumatic universal joint 4420 that attaches at the E-E equilibrium balance point (see FIG. 18*a* for reference). A space 4415 is made in the foam 4410 to allow the fixed pneumatic universal joint attachment 4420 to move freely.

As shown in FIG. 44A, it is important to observe the sideways tilt of the user and how the fixed universal joint 4420 in the virtual pneumatic cylinder 4415 allows the orthotic foundation member 2405 in the seating apparatus 2400 to rotate on the axis point. The foam 4410 gives way to the upper body pressure, which allows the seating apparatus 2400 to move in three-dimensional directions, and does not inhibit its functional aspects.

It should be noted that lumbo-sacral kyphotic flexion is driven by rotation of the pelvis and lower intervertebral joints and seated postures, and sustained lumbo-sacral spine flexion has been associated with detrimental effects to the tissues surrounding spinal joints. The embodiments of the invention use the rotation of the pelvis to create a flexion into a proper lordotic curve and reduce the injurious effects of kyphotic flexion.

In the description above, numerous specific details are set forth. However, it is understood that embodiments of the invention may be practiced without these specific details. For example, well-known equivalent components and elements may be substituted in place of those described herein, and similarly, well-known equivalent techniques may be substituted in place of the particular techniques disclosed. In other instances, well-known structures and techniques have not been shown in detail to avoid obscuring the understanding of this description.

Reference in the specification to "an embodiment," "one embodiment," "some embodiments," or "other embodiments" means that a particular feature, structure, or characteristic described in connection with the embodiment(s) is included in at least some embodiments, but not necessarily all embodiments. The various appearances of "an embodiment," "one embodiment," or "some embodiments" are not necessarily all referring to the same embodiments. If the specification states that a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

While certain exemplary embodiments have been described and shown in the accompanying drawings, it is to be understood that such embodiments are merely illustrative of, and not restrictive on, the broad invention, and that this invention not be limited to the specific constructions and arrangements shown and described, since various other modifications may occur to those ordinarily skilled in the art.

What is claimed is:

1. An orthopedic seating device for improving posture while sitting, the orthopedic device comprising:

a foundation member comprising:

a front portion configured to receive a user's upper legs;

a bowl portion configured to receive a user's lower pelvic area, the bowl portion comprising a central portion and a upwardly inclined lateral portion, wherein the lateral portion and the front portion collectively surround the central portion; and a concave recessed portion along a longitudinal midline of the foundation member;

wherein the central portion has plural regions of varying flexibility and the lateral portion has plural regions of varying flexibility, such that the concave recessed portion is least flexible relative to other regions of the foundation member;

a coupling system comprising:

a support mechanism coupled with said foundation member, the support mechanism configured for coupling to a seating apparatus.

2. The orthopedic seating device of claim 1, wherein:

the support mechanism is configured for dynamically adjusting position of the foundation member in response to the user's movement within the orthopedic seating device;

wherein the support mechanism moves from a first position to a second position in response to weight of the user bearing on the orthopedic seating device, such that in the second position, the support mechanism has a rotational tilt relative to the first position.

3. The orthopedic seating device of claim 2, wherein the support mechanism comprises an arm that includes one or more rotational joints.

4. The orthopedic seating device of claim 2, wherein the seating device comprises a cushion.

5. The orthopedic seating device of claim 2, wherein the seating device comprises one of a stool and a chair.

6. The orthopedic seating device of claim 2, wherein: the support mechanism is coupled with said concave recessed portion and from said first position to second position in response to weight of the user bearing on the orthopedic seating device; and in the second position, the foundation member has a rotational tilt relative to the first position.

7. The orthopedic seating device of claim 2, wherein:

the lateral portion has a rear segment surrounded on either side by a lateral segment, said rear and lateral segments of the lateral portion comprising tension regions extending and coupling to the front portion, said tension regions being of higher flexibility than the concave recessed portion; and said rotational tilt of the foundation member is in response to weight of a lower pelvis of the user on said central portion, and in response to weight of a hamstring portion of distal thighs of the user on said front portion, causing a downward rotational tilt of the foundation member in the second position relative to the first position.

8. The orthopedic seating device of claim 2, further comprising a bezel coupled to the circumference of the orthopedic seating device.

9. The orthopedic seating device of claim 3, wherein the arm further comprises a pneumatic cylinder and at least one universal ball joint.

10. The orthopedic seating device of claim 1, wherein the support mechanism is configured for dynamically adjusting position of the foundation member in response to the user's movement within the orthopedic seating.

11. The orthopedic seating device of claim 1, further comprising a lumbar support mechanism coupled to the orthopedic seating device with one or more lumbar coupling arms.

12. The orthopedic seating device of claim 11, wherein the one or more lumbar coupling arms include a plurality of adjustable devices.

13. The orthopedic seating device of claim 11, wherein the one or more lumbar coupling arms comprise adjustable mechanical positional arms.

14. The orthopedic seating device of claim 11, wherein at least a portion of the lumbar support mechanism is disposed within the seating device.

15. An orthopedic seating device for improving posture while sitting, the orthopedic device comprising:

a foundation member; and a seating apparatus; and a coupling system for coupling the seating apparatus with the foundation member;

wherein the foundation member comprises:

a front portion configured to receive a user's upper legs;

a bowl portion configured to receive a user's lower pelvic area, the bowl portion comprising a central portion and a upwardly inclined lateral portion, wherein the lateral portion and the front portion collectively surround the central portion; and a concave recessed portion along a longitudinal midline of the foundation member;

wherein the central portion has plural regions of varying thickness and the lateral portion has plural regions of varying thickness, such that the concave recessed portion is least flexible relative to other regions of the foundation member;

wherein the coupling system comprises:

a support mechanism coupled with said foundation member, the support mechanism configured for coupling to a seating apparatus and dynamically adjusting position of the foundation member in response to the user's movement within the orthopedic seating device;

wherein the foundation member moves from a first position to a second position in response to weight of the user bearing on the orthopedic seating device, such that in the second position, the foundation member has a rotational tilt relative to the first position;

wherein the bowl portion is configured to rotate on the coupling system between a first position when the user's lower pelvic area is not disposed in the bowl portion, and a second position, rotationally forward of the first position, when the user's lower pelvic area is disposed in the bowl portion, to thereby cause a forward rotational tilting of the user's lower pelvic area into a forward lordotic position after the lower pelvic area is placed in the bowl portion.

16. The orthopedic seating device of claim 15, wherein:

the lateral portion has an arcuate rear segment with an upper edge, surrounded on either side by a lateral segment with an upper edge, said rear and lateral segments forming rear and lateral segments of the bowl portion, respectively;

said rear and lateral segments of the lateral portion comprise tension regions of lower flexibility than other regions of the bowl portion having higher flexibility; and said tension regions extending and coupling to the front portion such that application of a downward force on the front portion causes an upward and inward movement of the upper edges of said rear and lateral segments of the bowl portion, wherein said regions of higher flexibility allow upward and inward movement of said tension regions.

17. The orthopedic seating device of claim 15, wherein:

the foundation member has axes including a longitudinal axis extending centrally from the rear segment of the bowl portion through the front portion, and a lateral axis intersection the longitudinal axis proximate the front portion; and the concave recessed portion extending from the upper edge of the rear segment of the lateral portion through the central portion to the front portion along said axes, the concave recessed portion comprising a region of similar flexibility to the tension regions;

the bowl portion has an underside, at least a portion of which is arcuate along an underside of the concave recessed portion, and configured to rotate between the first position and the second position.

18. The orthopedic seating device of claim 17, wherein the bowl portion further comprises an upwardly inclined portion along the front portion, said upwardly inclined portion impeding forward motion of ischial tuberosities in the pelvic area and causing user's lower pelvic area to pivot forward into a forward lordotic position in the second position of the bowl portion on a center of gravity balance equilibrium point, wherein ischial tuberosities atop said center of gravity balance equilibrium point are maintained in response to user motion while the lower pelvic area is in the bowl portion.

19. The orthopedic seating device of claim 18, wherein:

said tension regions comprise essentially planar regions along the upper edges of the rear and lateral segments of the bowl portion, said tension regions being of relatively lower flexibility than other regions of the lateral portion to provide upward and inward tensioning upon application of a downward force on the front portion.

20. The orthopedic seating device of claim 19, wherein:

the central portion comprises a pelvic landing region intersecting said concave recessed portion and extending outwardly from the concave recessed portion, the pelvic landing region having a similar flexibility as the concave recessed portion;

the central potion further comprises regions of higher flexibility surrounding the pelvic landing region.

21. The orthopedic seating device of claim 20, wherein:

the front portion comprises a region adjacent the lateral and central portions, said front portion region being of higher flexibility than the tension regions of the lateral portion.

22. The orthopedic seating device of claim 21, wherein:

said upward and inward movement of the upper edges of the rear and lateral segments of the bowl portion cause cupping and cradling of gluteus muscles in the user's lower pelvic area in the bowl portion.

23. The orthopedic seating device of claim 22, wherein:

with the user's lower pelvic area disposed in the bowl portion, twisting movement of the user while sitting causes torsion of the foundation member along said axes which causes torsioning of the rear segment of the bowl portion such that said upward and inward motion of the upper edges of the rear and lateral segments of the bowl portion follow twisting of the user's lower pelvic area for applying an upward and inward compressive force to cause a forward rotational tilting of the user's lower pelvic area into a lordotic position, while maintaining the bowl portion in said second position.

24. The orthopedic seating device of claim 23, wherein said regions of varying flexibility comprise regions of varying thickness in the foundation member, such that a thicker region is less flexible than a relatively thinner region.

25. The orthopedic seating device of claim 24, wherein the foundation member comprises a memory-retentive plastic including said regions of varying thickness.

26. An orthopedic seating device for improving posture while sitting, the orthopedic seating device comprising:

a foundation member having regions of varying flexibility, comprising:

a front portion comprising at least one individual front section configured to receive a user's upper legs;

a central portion configured to receive a user's lower pelvic area;

a lateral portion comprising a pair of upwardly inclined lateral sections flanking and partially surrounding the central portion;

a concave recessed portion along a longitudinal midline of the foundation member, such that at least a segment of the concave recessed portion is less flexible relative to other regions of the foundation member; and a lumbar support mechanism coupled to the foundation member;

wherein the central portion has plural regions of varying flexibility and each lateral section has plural regions of varying flexibility, such that the concave recessed portion is least flexible relative to other regions of the foundation member, the lateral section and the front section collectively surround the central portion such that the central portion and the lateral portion together form a bowl portion configured to receive a user's lower pelvic area and to apply an upwardly and inwardly compressive force when the lower pelvic area of the user is disposed in the bowl portion.

27. The orthopedic seating device of claim 26, wherein the bowl portion is configured to rotate between a first position when the user's lower pelvic area is not disposed in the bowl portion, and a second position, rotationally forward of the first position, when the user's lower pelvic area is disposed in the bowl portion, to thereby cause a forward rotational tilting of the user's lower pelvic area into a forward lordotic position after the user's lower pelvic area is placed in the bowl portion.

28. The orthopedic seating device of claim 26, wherein the seating device comprises a molded cushion.

29. The orthopedic seating device of claim 26, wherein the seating device comprises one of a framed stool and a framed chair.

30. The orthopedic seating device of claim 26, wherein the lumbar support mechanism is directly coupled to the foundation member with one or more lumbar coupling arms that include a plurality of adjustable devices.

31. The orthopedic seating device of claim 26, wherein the one or more lumbar coupling arms comprise adjustable mechanical positional arms.

32. The orthopedic seating device of claim 26, wherein the lumbar support mechanism comprises a pad coupled to the foundation member with one or more lumbar coupling arms, wherein at least one of the lumbar coupling arms extends transversely to the foundation member and to the pad.

33. The orthopedic seating device of claim 32, wherein the one or more lumbar coupling arms include adjustable mechanisms for adjusting the length of each lumbar coupling arm for raising and lowering the lumbar support mechanism relative to the foundation member.

34. The orthopedic seating device of claim 32, wherein the one or more lumbar coupling arms comprise adjustable mechanisms for adjusting angle of the lumbar support mechanism relative to the foundation member.

35. The orthopedic seating device of claim 32, wherein at least a portion of the lumbar support pad is disposed within the seating device.

* * * * *